US007465008B2

(12) United States Patent
Nunokawa et al.

(10) Patent No.: US 7,465,008 B2
(45) Date of Patent: Dec. 16, 2008

(54) PRINTING APPARATUS, PRINTING METHOD, AND COMPUTER-READABLE MEDIUM

(75) Inventors: Hirokazu Nunokawa, Nagano-ken (JP); Tatsuya Nakano, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 11/126,379

(22) Filed: May 11, 2005

(65) Prior Publication Data

US 2006/0146082 A1 Jul. 6, 2006

(30) Foreign Application Priority Data

May 12, 2004 (JP) ..... 2004-142629
May 25, 2004 (JP) ..... 2004-155228

(51) Int. Cl.
*B41J 2/205* (2006.01)

(52) U.S. Cl. ..... 347/15; 347/41

(58) Field of Classification Search ..... 347/15, 347/43, 12, 41; 358/1.2, 1.9
See application file for complete search history.

(56) References Cited

U.S. PATENT DOCUMENTS 5,767,876 A * 6/1998 Koike et al. ..... 347/43
6,084,604 A * 7/2000 Moriyama et al. ..... 347/15
6,325,489 B2 * 12/2001 Endo ..... 347/43
2001/0035892 A1 * 11/2001 Goh ..... 347/40
2002/0105557 A1 * 8/2002 Teshigawara et al. ..... 347/15

FOREIGN PATENT DOCUMENTS

JP 2863393 B2 12/1998
JP 2001-341295 A 12/2001

* cited by examiner

*Primary Examiner*—Lamson D Nguyen
(74) *Attorney, Agent, or Firm*—Sughrue Mion, PLLC

(57) ABSTRACT

The appearance of images printed by draft printing or the like is improved. Provided are, for example, a print head having a first dot formation section and a second dot formation section that are provided at positions that are offset from one another in a predetermined direction and that respectively form dots of different colors as said dots; and a controller for printing said image with the print head in a first resolution and in a second resolution that is lower than the first resolution based on data of pixels constituting said image to be printed, wherein, when the image is to be printed in the second resolution, the controller causes the first dot formation section and the second dot formation section to form the respective dots based on data of the same pixel in each printing operation.

15 Claims, 38 Drawing Sheets

D: DOT PITCH (DOT SPACING AT HIGHEST RESOLUTION)

| | COLOR PRINTING | MONOCHROME PRINTING |
|---|---|---|
| REGULAR PRINT MODE | COLOR-COLOR CONVERSION TABLE | BLACK-COLOR CONVERSION TABLE |
| DRAFT PRINT MODE | | COMPOSITE BLACK-COLOR CONVERSION TABLE |

Fig.28

D: DOT PITCH (DOT SPACING AT HIGHEST RESOLUTION)

PRINTING APPARATUS, PRINTING METHOD, AND COMPUTER-READABLE MEDIUM

CROSS-REFERENCE TO RELATED APPLICATIONS

The present application claims priority upon Japanese Patent Application No. 2004-142629 filed on May 12, 2004, and Japanese Patent Application No. 2004-155228 filed on May 25, 2004, which are herein incorporated by reference.

BACKGROUND OF THE INVENTION

1. Field of the Invention

The present invention relates to printing apparatuses, printing methods and computer-readable media.

2. Description of the Related Art

Inkjet printers are known as one type of printing apparatus that prints images by forming dots on a medium. Inkjet printers print images by forming dots on a medium by ejecting inks of two or more different colors, such as yellow (Y), cyan (C), magenta (M) and black (Bk), onto a medium.

Such printing apparatuses are provided with a print mode called "draft print mode." This draft print mode is a mode that is executed when making a test print, for example when one wants to have a look at the arrangement or constitution or the overall impression of an image to be printed, and the raster constituting the printed image is thinned out at a predetermined ratio. Thus, it is possible to keep the amount of ink that is used low, and to print an image at high speed by drastically increasing the print speed.

However, such draft printing has the following problems. That is, when the image is printed at high speed, a portion of the image is not printed, and omitted when printing, which leads to a decrease in the printing density, so that there is the problem that the printed image is coarse and thin. Therefore, even though the image can be printed with high speed, the appearance of the printed image is not very good, which limits the opportunities at which a user will find it useful.

SUMMARY OF THE INVENTION

In view of the above circumstances, it is thus an object of the present invention to improve the appearance of images printed by draft printing or the like.

A main aspect of the present invention is a printing apparatus comprising:

a carry mechanism performing a carry operation of carrying a medium in a predetermined direction;

a print head performing, in alternation with the carry operation, a printing operation of printing an image by forming dots on the medium while moving in a direction intersecting the predetermined direction, the print head having a first dot formation section and a second dot formation section that are provided at positions that are offset from one another in the predetermined direction and that respectively form dots of different colors as the dots; and a controller for printing the image with the print head in a first resolution and in a second resolution that is lower than the first resolution based on data of pixels constituting the image to be printed, wherein, when the image is to be printed in the second resolution, the controller causes the first dot formation section and the second dot formation section to form the respective dots based on data of the same pixel in each printing operation.

Another main aspect of the present invention is a printing method comprising:

a step of performing a carry operation in which a medium is carried in a predetermined direction;

a step of performing, in alternation with the carry operation, a printing operation of printing an image by forming dots on the medium with a print head while the print head is moved in a direction intersecting the predetermined direction; and a step of forming dots of different colors, as the dots, respectively with a first dot formation section and a second dot formation section provided on the print head at positions that are offset from one another in the predetermined direction based on data of pixels constituting the image to be printed, wherein when the second resolution is set, the first dot formation section and the second dot formation section are caused to form the respective dots based on data of the same pixel in each printing operation.

A further main aspect of the present invention is a computer-readable medium for operating a printing apparatus, the medium comprising:

a code for causing the printing apparatus to perform a carry operation in which a medium is carried in a predetermined direction;

a code for causing the printing apparatus to perform, in alternation with the carry operation, a printing operation of printing an image by forming dots on the medium with a print head while the print head is moved in a direction intersecting the predetermined direction; and a code for causing the printing apparatus to form dots of different colors, as the dots, respectively with a first dot formation section and a second dot formation section provided on the print head at positions that are offset from one another in the predetermined direction based on data of pixels constituting the image to be printed, wherein when printing the image in a second resolution that is lower than a first resolution, the first dot formation section and the second dot formation section are caused to form the respective dots based on data of the same pixel in each printing operation.

A further main aspect of the present invention is a printing apparatus comprising:

a first nozzle ejecting black ink;

a second nozzle ejecting ink of a color other than black; and a controller for printing an image on a medium in a first resolution and a second resolution that is lower than the first resolution by ejecting ink onto the medium from at least one of the first nozzle and the second nozzle based on print data, wherein, when the image is to be printed in the second resolution based on print data for monochrome printing, the controller prints the image by ejecting the ink of the other color from the second nozzle onto the medium.

A further main aspect of the present invention is a printing method comprising:

a step of setting either one of a first resolution and a second resolution that is lower than the first resolution as a resolution of an image to be printed by ejecting ink onto a medium based on print data from at least one of a first nozzle ejecting black ink and a second nozzle ejecting ink of a color other than black; and a step of printing the image by ejecting onto the medium the ink of the other color from the second nozzle when the second resolution has been set and the image is to be printed based on print data for monochrome printing.

A further main aspect of the present invention is a computer-readable medium for operating a printing apparatus, the medium comprising:

a code for printing an image on a medium in either one of a first resolution and a second resolution that is lower than the first resolution by ejecting ink onto the medium from at least one of a first nozzle ejecting black ink and a second nozzle ejecting ink of a color other than black based on print data; and a code for causing the printing apparatus to print the image by ejecting the ink of the other color from the second nozzle which ejects the ink of the color other than black onto the medium when the image is to be printed in the second resolution based on print data for monochrome printing.

BRIEF DESCRIPTION OF THE DRAWINGS

For a more complete understanding of the present invention and the advantages thereof, reference is now made to the following description taken in conjunction with the accompanying drawings.

FIG. 28 is a table listing the color conversion tables that are looked up by the printer driver.

DETAILED DESCRIPTION OF THE INVENTION

Figure 1:
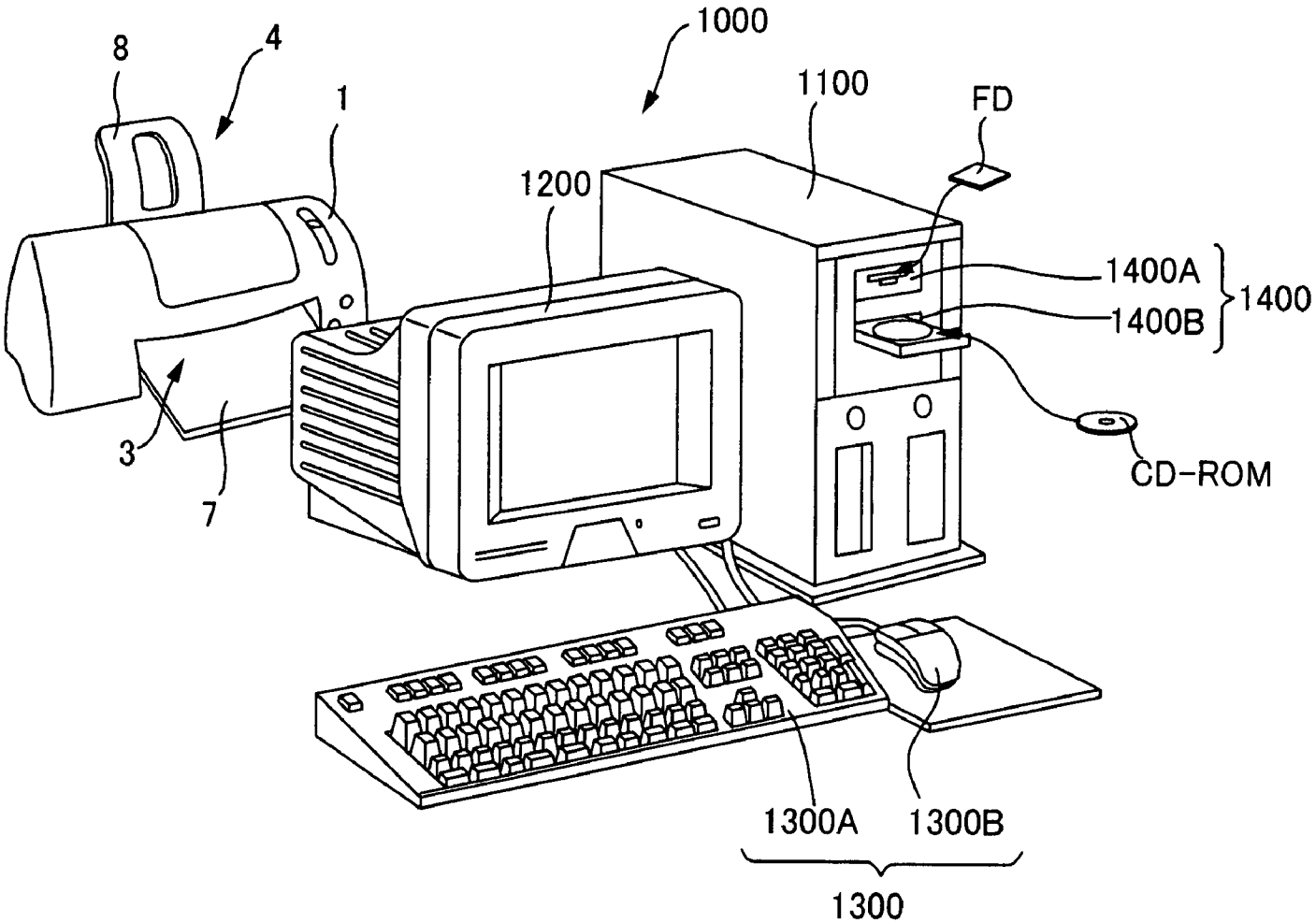
FIG. 1 is an explanatory diagram of the overall configuration of an embodiment of a printing apparatus.

At least the following matters will be made clear by the explanation in the present specification and the description of the accompanying drawings.

A printing apparatus according to the present invention comprises:

a carry mechanism performing a carry operation of carrying a medium in a predetermined direction;

a print head performing, in alternation with the carry operation, a printing operation of printing an image by forming dots on the medium while moving in a direction intersecting the predetermined direction, the print head having a first dot formation section and a second dot formation section that are provided at positions that are offset from one another in the predetermined direction and that respectively form dots of different colors as the dots; and a controller for printing the image with the print head in a first resolution and in a second resolution that is lower than the first resolution based on data of pixels constituting the image to be printed, wherein, when the image is to be printed in the second resolution, the controller causes the first dot formation section and the second dot formation section to form the respective dots based on data of the same pixel in each printing operation.

With such a printing apparatus, when printing an image in a second resolution that is lower than a first resolution, the first dot formation section and the second dot formation section form dots based on the data of the same pixels in each printing operation, so that the positions of the dots formed by the first dot formation section and the second dot formation are offset from each other. Thus, even when printing by draft printing or the like, the print density can be increased, the darkness of the printed image can be made darker, and print results with a pleasant appearance can be achieved.

In this printing apparatus, it is preferable that printing the image in the second resolution includes printing the image in a predetermined high-speed print mode.

With such a printing apparatus, if printing the image in a predetermined high-speed print mode is included in this manner, then it is possible to improve the appearance of images printed in the predetermined high-speed print mode.

In this printing apparatus, it is preferable that the predetermined high-speed print mode is a draft print mode.

With such a printing apparatus, it is possible to improve the appearance of images printed in the draft print mode.

In this printing apparatus, it is preferable that the print head is provided with, in addition to the first dot formation section and the second dot formation section, one or a plurality of other dot formation sections each forming dots of a color that is different from that of the first dot formation section and the second dot formation section.

With such a printing apparatus, if other dot formation sections are provided in this manner, then it is possible to form dots of other colors on the medium.

In this printing apparatus, it is preferable that when the controller prints the image in the second resolution, the other dot formation section forms each of the dots based on the data of the same pixel as the first dot formation section and the second dot formation section in each printing operation.

With such a printing apparatus, if also the other dot formation section(s) form(s) the dots based on data of the same pixels as the first dot formation section and the second dot formation section, then it is possible to increase the print density even further, to increase the darkness of the printed image, and thus to achieve print results of even better appearance.

It is preferable that this printing apparatus further comprises, as the other dot formation section, a third dot formation section provided at the same position in the predetermined direction as either one of the first dot formation section and the second dot formation section.

With this printing apparatus, if such a third dot formation section is provided, it is possible to increase the print density, and to achieve print results of even better appearance.

It is preferable that this printing apparatus further comprises, as the other dot formation section, a fourth dot formation section provided at a position that is offset in the predetermined direction with respect to both the first dot formation section and the second dot formation section.

With this printing apparatus, if such a fourth dot formation section is provided, then it is possible to increase the print density, and to achieve print results that are darker and of better appearance.

In this printing apparatus, it is preferable that the color of the dots formed by either one of the first dot formation section and the second dot formation section is black.

With this printing apparatus, if either one of the first dot formation section and the second dot formation section forms black dots, then print results that are dark and of better appearance can be achieved.

In this printing apparatus, it is preferable that the color of the dots formed by either one of the first dot formation section and the second dot formation section is black, and the color of the dots formed by the other one of the first dot formation section and the second dot formation section is cyan or magenta.

With this printing apparatus, if either one of the first dot formation section and the second dot formation section forms black dots and the other one forms cyan or magenta dots, then print results of better appearance can be achieved.

In this printing apparatus, it is preferable that the color of the dots formed by either one of the first dot formation section and the second dot formation section is darker than the color of the dots formed by the other dot formation section.

With this printing apparatus, if the color of the dots formed by either one of the first dot formation section and the second dot formation section is darker than the color of the dots formed by the other dot formation section, then the print density can be further increased, and print results that are dark and of better appearance can be achieved.

In this printing apparatus, it is preferable that the third dot formation section and the first dot formation section or the second dot formation section provided at the same position as the third dot formation section in the predetermined direction are a dot formation section forming black dots and a dot formation section forming yellow dots.

With this printing apparatus, if black and yellow dots are formed by dot formation sections having the same position in the predetermined direction, then inversion irregularities can be prevented and print results of better appearance can be achieved.

In this printing apparatus, it is preferable that among the first dot formation section, the second dot formation section, and the fourth dot formation section, the dot formation section that is positioned in the middle in the predetermined direction is a dot formation section forming black dots.

With this printing apparatus, if the dot formation positioned in the middle in the predetermined direction forms black dots, then print results of better appearance can be achieved.

In this printing apparatus, it is preferable that the dot formation sections other than the dot formation section that is positioned in the middle are a dot formation section forming cyan dots and a dot formation section forming magenta dots.

With this printing apparatus, if the dot formation sections other than the dot formation section positioned in the middle are a dot formation section forming cyan dots and a dot formation section forming magenta dots, then print results of better appearance can be achieved.

In this printing apparatus, it is preferable that among the first dot formation section, the second dot formation section, and the fourth dot formation section, the dot formation section that is positioned at an end in the predetermined direction is a dot formation section forming black dots.

With this printing apparatus, if the dot formation section that is positioned at the end is a dot formation section forming black dots, then the dots formed by the other dot formation sections protrude from the black dots, so that the color hue can be easily adjusted.

In this printing apparatus, it is preferable that the dot formation sections other than the dot formation section that is positioned at the end are a dot formation section forming cyan dots and a dot formation section forming magenta dots.

With this printing apparatus, if the other dot formation sections other than the dot formation section positioned at the end are a dot formation section forming cyan dots and a dot formation section forming magenta dots, then the color hue can be easily adjusted.

In this printing apparatus, it is preferable that the print head is provided with a fifth dot formation section that: forms dots of the same color as the dots formed by the first dot formation section or the second dot formation section; and when printing the image in the second resolution, forms each of the dots based on data of pixels that are different to the pixels of the first dot formation section or the second dot formation section in each printing operation.

With this printing apparatus, if such a fifth dot formation section is provided, then it is possible to print an image with greater efficiency on the medium.

In this printing apparatus, it is preferable that a plurality of the fifth dot formation sections are provided.

With this printing apparatus, it is possible to print an image with even greater efficiency on the medium.

In this printing apparatus, it is preferable that the fifth dot formation section and the first dot formation section or the second dot formation section forming dots of the same color as the dots formed by the fifth dot formation section are arranged with a space between each other in the predetermined direction.

With this printing apparatus, it is possible to print an image with even greater efficiency on the medium.

In this printing apparatus, it is preferable that the dot formation sections form the dots by ejecting ink onto the medium.

With this printing apparatus, if dots are formed by the dot formation sections ejecting ink onto a medium, then this can be applied advantageously.

Furthermore, in accordance with the present invention, a printing method can be realized that comprises:

a step of performing a carry operation in which a medium is carried in a predetermined direction;

a step of performing, in alternation with the carry operation, a printing operation of printing an image by forming dots on the medium with a print head while the print head is moved in a direction intersecting the predetermined direction; and a step of forming dots of different colors, as said dots, respectively with a first dot formation section and a second dot formation section provided on the print head at positions that are offset from one another in the predetermined direction based on data of pixels constituting the image to be printed, wherein when the second resolution is set, the first dot formation section and the second dot formation section are caused to form the respective dots based on data of the same pixel in each printing operation.

With this printing method, when printing an image in a second resolution, which is lower than a first resolution, the first dot formation section and the second dot formation section form dots based on the data of the same pixels, in each printing operation, so that the positions of the dots formed respectively by the first dot formation section and the second dot formation section are offset from one another. Thus, even when printing by draft printing or the like, it is possible to increase the print density, to make the darkness of the printed image darker, and to achieve print results with good appearance.

Furthermore, in accordance with the present invention, a computer-readable medium for operating a printing apparatus can be realized that comprises:

a code for causing the printing apparatus to perform a carry operation in which a medium is carried in a predetermined direction;

a code for causing the printing apparatus to perform, in alternation with the carry operation, a printing operation of printing an image by forming dots on the medium with a print head while the print head is moved in a direction intersecting the predetermined direction; and a code for causing the printing apparatus to form dots of different colors, as the dots, respectively with a first dot formation section and a second dot formation section provided on the print head at positions that are offset from one another in the predetermined direction based on data of pixels constituting the image to be printed, wherein when printing the image in a second resolution that is lower than a first resolution, the first dot formation section and the second dot formation section are caused to form the respective dots based on data of the same pixel in each printing operation.

With such a computer-readable medium, when printing an image in a second resolution that is lower than a first resolution, the first dot formation section and the second dot formation section form dots based on the data of the same pixels, in each printing operation, so that the positions of the dots formed respectively by the first dot formation section and the second dot formation section are offset from one another. Thus, even when printing by draft printing or the like, it is possible to increase the print density, to make the darkness of the printed image darker, and to achieve print results with good appearance.

Furthermore, in accordance with the present invention, a printing apparatus can be realized that comprises:

a first nozzle ejecting black ink;

a second nozzle ejecting ink of a color other than black; and a controller for printing an image on a medium in a first resolution and a second resolution that is lower than the first resolution by ejecting ink onto the medium from at least one of the first nozzle and the second nozzle based on print data, wherein, when the image is to be printed in the second resolution based on print data for monochrome printing, the controller prints the image by ejecting the ink of the other color from the second nozzle onto the medium.

With such a printing apparatus, when printing an image with a second resolution based on print data for monochrome printing, the image is printed by ejecting ink of another color onto the medium from the second nozzle, so that it is possible to eject more ink than in the conventional case of printing by ejecting only black ink. Thus, even when an image is printed in the second resolution, which is lower than the first resolution, the decrease in the print density can be suppressed, and it is possible to keep the darkness of the printed image from becoming much lower. Thus, it is possible to improve the appearance of the printed image.

In this printing apparatus, it is preferable that printing the image in the second resolution includes printing the image in a predetermined high-speed print mode.

With such a printing apparatus, if printing the image in a predetermined high-speed print mode is included in this manner, then it is possible to improve the appearance of images printed in the predetermined high-speed print mode.

In this printing apparatus, it is preferable that the predetermined high-speed print mode is a draft print mode.

With such a printing apparatus, if the predetermined high-speed print mode is a draft print mode, then it is possible to improve the appearance of images printed in the draft print mode.

In this printing apparatus, it is preferable that, when the image is to be printed in the second resolution based on the print data for monochrome printing, the controller prints the image by ejecting, in addition to the ink of the other color, the black ink from the first nozzle onto the medium.

With this printing apparatus, if also black ink is ejected, then it is possible to make the darkness of the printed image even darker, so that the appearance of the printed image can be further improved.

In this printing apparatus, it is preferable that a plurality of nozzles respectively ejecting ink of at least two different colors is provided as the second nozzle.

With this printing apparatus, if a plurality of nozzles ejecting ink of at least two different colors is provided as the second nozzle, then it is possible to make the darkness of the printed image even darker, so that the appearance of the printed image can be further improved.

In this printing apparatus, it is preferable that a nozzle ejecting ink of at least one of the colors cyan, magenta, and yellow is provided as the second nozzle.

With this printing apparatus, if a nozzle ejecting ink of at least one of the colors cyan, magenta and yellow is provided, then it is possible to make the darkness of the printed image even darker, so that the appearance of the printed image can be further improved.

In this printing apparatus, it is preferable that a cyan nozzle ejecting cyan ink, a magenta nozzle ejecting magenta ink, and a yellow nozzle ejecting yellow ink are provided as the second nozzle.

With this printing apparatus, if a cyan nozzle, a magenta nozzle and a yellow nozzle are provided in this manner, then it is possible to make the darkness of the printed image even darker, so that the appearance of the printed image can be further improved.

In this printing apparatus, it is preferable that, when the image is to be printed in the second resolution based on the print data for monochrome printing, the controller causes the cyan nozzle, the magenta nozzle, and the yellow nozzle to eject the inks onto the medium, respectively.

With this printing apparatus, if ink is ejected respectively from the cyan nozzle, the magenta nozzle and the yellow nozzle, then it is possible to make the darkness of the printed image even darker, so that the appearance of the printed image can be further improved.

In this printing apparatus, it is preferable that, when the controller prints the image in the second resolution based on the print data for monochrome printing, the inks ejected respectively from the cyan nozzle, the magenta nozzle, and the yellow nozzle overlap one another on the medium.

With this printing apparatus, if the inks ejected respectively from the cyan nozzle, the magenta nozzle and the yellow nozzle overlap one another, then it is possible to produce black, and thus it is possible to make the darkness of the printed image even darker, so that the appearance of the printed image can be further improved.

It is preferable that this printing apparatus further comprises a carry mechanism carrying the medium in a predetermined direction; and a print head that is provided with the first nozzle and the second nozzle and that is movable in a direction intersecting the predetermined direction; wherein the image is printed on the medium by performing in alternation: a printing operation of ejecting ink from at least one of the first nozzle and the second nozzle while the print head is moved in the intersecting direction; and a carry operation of carrying the medium with the carry mechanism.

With this printing apparatus, it is possible to print images smoothly by executing the printing operation and the carry operation in alternation in this manner.

In this printing apparatus, it is preferable that, the first nozzle and the second nozzle are provided at positions that are offset from one another in the predetermined direction.

With this printing apparatus, if the first nozzle and the second nozzle are provided at positions that are offset from one another in the predetermined direction, then it is possible to eject ink onto different points from the first nozzle and the second nozzle. Thus, it is possible to make the darkness of the printed image darker, so that the appearance of the printed image can be further improved.

In this printing apparatus, it is preferable that at least one of the first nozzle and the second nozzle is provided in plurality.

With this printing apparatus, if at least one of the first nozzle and the second nozzle are provided in plurality, then images can be printed on the medium more efficiently.

In this printing apparatus, it is preferable that the first nozzles or the second nozzles, which are provided in plurality, are arranged with a space between one another in the predetermined direction; and a space between pixels constituting an image to be printed in the second resolution is equal to the space between the nozzles.

With this printing apparatus, when the space between pixels constituting the image printed in the second resolution is equal to the space between the nozzles, then it is possible to make the darkness of the printed image darker, so that the appearance of the printed image can be further improved.

Furthermore, in accordance with the present invention, a printing method can be realized that comprises:

a step of setting either one of a first resolution and a second resolution that is lower than the first resolution as a resolution of an image to be printed by ejecting ink onto a medium based on print data from at least one of a first nozzle ejecting black ink and a second nozzle ejecting ink of a color other than black; and a step of printing the image by ejecting onto the medium the ink of the other color from the second nozzle when the second resolution has been set and the image is to be printed based on print data for monochrome printing.

With this printing method, when printing an image in the second resolution based on print data for monochrome printing, the image is printed by ejecting ink of another color onto the medium from the second nozzle, so that it is possible to eject more ink than in the conventional case of printing by ejecting only black ink. Thus, even when an image is printed in the second resolution, which is lower than the first resolution, the decrease in the print density can be suppressed, and it is possible to keep the darkness of the printed image from becoming much lower. Thus, it is possible to improve the appearance of the printed image.

Furthermore, in accordance with the present invention, a computer-readable medium for operating a printing apparatus can be realized that comprises:

a code for printing an image on a medium in either one of a first resolution and a second resolution that is lower than the first resolution by ejecting ink onto the medium from at least one of a first nozzle ejecting black ink and a second nozzle ejecting ink of a color other than black based on print data; and a code for causing the printing apparatus to print the image by ejecting the ink of the other color from the second nozzle which ejects the ink of the color other than black onto the medium when the image is to be printed in the second resolution based on print data for monochrome printing.

With such a computer-readable medium, when printing an image in the second resolution based on print data for monochrome printing, the image is printed by ejecting ink of another color onto the medium from the second nozzle, so that it is possible to eject more ink than in the conventional case of printing by ejecting only black ink. Thus, even when an image is printed in the second resolution, which is lower than the first resolution, the decrease in the print density can be suppressed, and it is possible to keep the darkness of the printed image from becoming much lower. Thus, it is possible to improve the appearance of the printed image.

===Outline of Printing Apparatus===

An overview of a printing system provided with an inkjet printer 1 and a computer 1100 is described below as an embodiment of the printing apparatus according to the present invention.

FIG. 1 is an explanatory drawing showing the external structure of this printing system. The printing system 1000 is provided with an inkjet printer 1 and a computer 1100. The computer 1100 includes a display device 1200, input devices 1300, and recording/reproducing devices 1400. The inkjet printer 1 prints by ejecting ink towards a medium, such as paper, cloth or film.

The computer 1100 and the inkjet printer 1 are connected either wirelessly or through a cable or the like, such that they can exchange data. The computer 1100 creates the print data of the image to be printed with the inkjet printer 1 and outputs the print data to the inkjet printer 1. A display device 1200 displays a user interface, such as an application program or a printer driver. The input devices 1300 are for example a keyboard 1300A and a mouse 1300B, and are used to operate the application program or adjust the settings of the printer driver, for example, in accordance with the user interface that is displayed on the display device 1200. The recording/reproducing devices 1400 include a flexible disk drive 1400A and a CD-ROM drive 1400B, for example.

A printer driver (not shown in the drawings) is installed on the computer 1100. The printer driver is a program for achieving the function of displaying the user interface on the display device 1200, and the function of converting image data that has been output from the application program into print data. This printer driver is stored and distributed on a recording medium (computer-readable recording medium) such as a flexible disk FD or a CD-ROM, or it is distributed through a communication means such as the Internet.

===Printer Driver===

<Regarding the Printer Driver>

Figure 2:
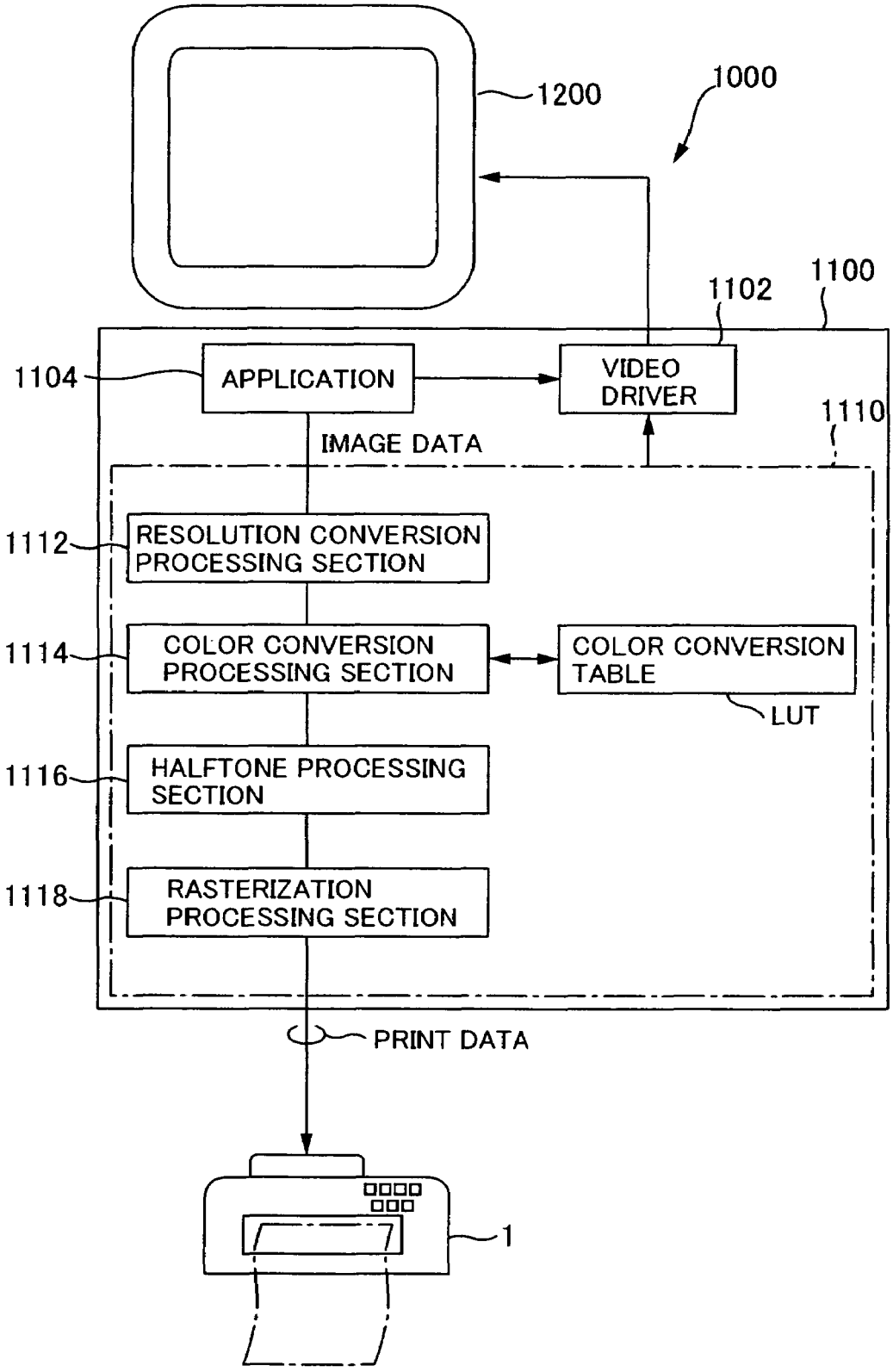
FIG. 2 is an explanatory diagram outlining processes carried out by a printer driver.

FIG. 2 is a schematic explanatory diagram of basic processes carried out by the printer driver. Structural elements that have already been described are assigned identical reference numerals and thus their further description is omitted.

On the computer 1100, computer programs such as a video driver 1102, an application program 1104, and the printer driver 1110 operate under an operating system installed on the computer 1100. The video driver 1102 has the function of displaying, for example, the user interface on the display device 1200 in accordance with display commands from the application program 1104 and the printer driver 1110. The application program 1104, for example, has a function for image editing or the like and creates data related to an image (image data). A user can give an instruction to print an image edited in the application program 1104 via the user interface of the application program 1104. Upon receiving the print instruction, the application program 1104 outputs the image data to the printer driver 1110.

The printer driver 1110 receives the image data from the application program 1104, converts the image data into print data, and outputs the print data to the inkjet printer 1. Here, "print data" refers to data in a format that can be interpreted by the inkjet printer 1 and that includes various command data and pixel data. Also, "command data" refers to data for instructing the inkjet printer 1 to carry out a specific operation. Furthermore, "pixel data" refers to data related to pixels that constitute an image to be printed (print image), for example, data related to dots to be formed in positions on the medium S corresponding to certain pixels (data for dot color and size, for example).

The printer driver 1110 is provided with a resolution conversion processing section 1112, a color conversion processing section 1114, a halftone processing section 1116 and a rasterization processing section 1118, in order to convert the image data that is output from the application program 1104 into print data. The following is a description of the processes carried out by the various processing sections 1112, 1114, 1116 and 1118 of the printer driver 1110.

The resolution conversion processing section 1112 performs a resolution conversion process in which image data (text data, image data, etc.) output from the application program 1104 is converted to a resolution for printing on the medium S. In the resolution conversion process, for example, when the resolution for printing an image on paper is specified as 720×720 dpi, then the image data received from the application program 1104 is converted to image data of a resolution of 720×720 dpi. It should be noted that after the resolution conversion process, the image data are multi-gradation RGB data (for example with 256 gradations) that are expressed in RGB color space. Hereinafter, RGB data obtained by subjecting image data to resolution conversion processing is referred to as "RGB image data."

The color conversion processing section 1114 performs a color conversion process in which RGB data is converted to CMYK data that is expressed in CMYK color space. It should be noted that CMYK data is data that correspond to the ink colors of the inkjet printer 1. The color conversion process is carried out by the printer driver 1110 referencing a table (a color conversion look-up table LUT) in which gradation values of RGB image data are associated with gradation values of CMYK image data. By this color conversion process, the RGB data for each of the pixels is converted to CMYK data that corresponds to the ink colors. It should be noted that after the color conversion process, the data is CMYK data with 256 gradations expressed in CMYK color space. Hereinafter, CMYK data obtained by subjecting RGB image data to color conversion processing is referred to as "CMYK image data."

The halftone processing section 1116 performs a halftone process in which data of a high number of gradations is converted to data of a number of gradations that can be formed by the inkjet printer 1. By halftone processing, for example data expressing 256 gradations are converted to 1-bit data expressing two gradations or 2-bit data expressing four gradations. In halftone processing, pixel data is created such that the inkjet printer 1 can form dispersed dots using methods such as dithering, gamma correction, and error diffusion. During halftone processing, the halftone processing section 1116 references a dither table when performing dithering, references a gamma table when performing gamma correction, and references an error memory for storing the diffused error when performing error diffusion. Halftone processed data have a resolution (for example, 720×720 dpi) equivalent to the above-mentioned RGB data. Halftone processed data is made from, for example, 1-bit or 2-bit data for each pixel. Hereinafter, in regard to halftone processed data, 1-bit data is referred to as binary data and 2-bit data is referred to as multi-value data.

The rasterization processing section 1118 performs a rasterization process in which image data in a matrix form is changed to data in an order that is suitable for transfer to the inkjet printer 1. Thus, the rasterized data is output to the inkjet printer 1.

<Regarding the Settings of the Printer Driver>

Figure 3:
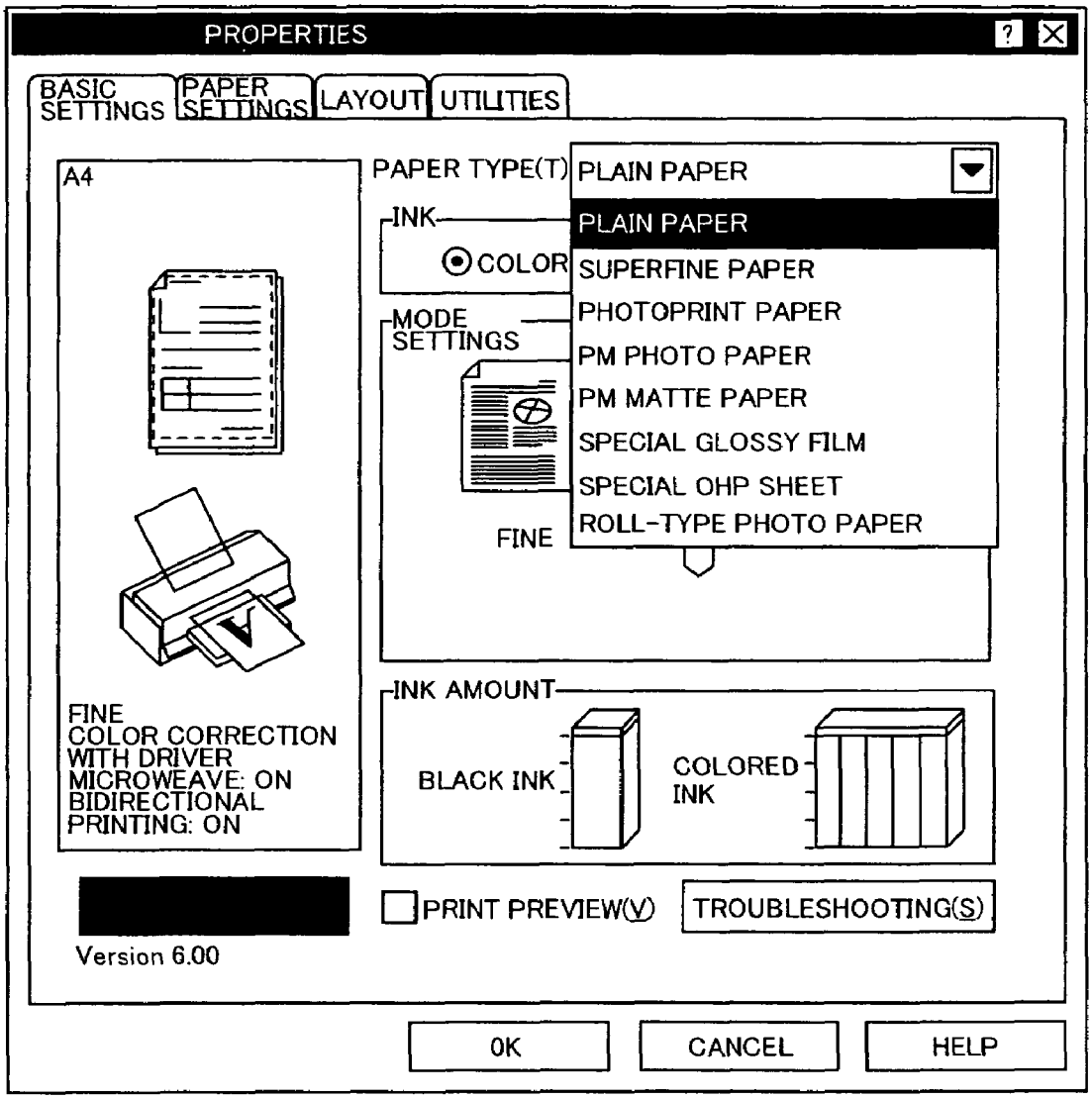
FIG. 3 is an explanatory diagram of a user interface of the printer driver.

FIG. 3 is an explanatory diagram of the user interface of the printer driver 1110. The user interface of the printer driver 1110 is displayed on a display device via the video driver 1102. The user can use the input device 1300 to change the various settings of the printer driver 1110.

From this screen, the user can select the print resolution (the dot spacing when printing). For example, the user can select from this screen 720 dpi or 360 dpi as the print resolution. The printer driver 1110 carries out resolution conversion processing in accordance with the selected resolution and converts the image data to print data.

Furthermore, from this screen, the user can select the print paper (medium) to be used for printing. For example, the user can select plain paper or glossy paper as the print medium. Since the way ink is absorbed and the way ink dries varies if the type of medium (paper type) varies, the amount of ink suitable for printing also varies. For this reason, the printer driver 1110 converts the image data to print data in accordance with the selected paper type.

The user can also select the print mode from this screen. The printer driver 1110 converts the image data to print data such that the data is in a format corresponding to the print mode selected by the user. A more detailed explanation of the print modes that can be selected by the user is given further below.

In this way, the printer driver 1110 converts image data to print data in accordance with conditions that are set via the user interface. It should be noted that, in addition to performing various settings of the printer driver 1110, the user can also be notified, through this screen, of such information as the amount of ink remaining in the cartridges.

===Inkjet Printer Configuration===

As shown in FIG. 1, the inkjet printer 1 has a structure in which a medium S, such as print paper or the like, that is supplied from the rear side is ejected to the front side. At its rear side, the inkjet printer 1 is provided with a paper supply section 4 in which the medium S to be printed is set. This paper supply section 4 is provided with a paper supply tray 8 for supporting the medium S. At its front side, the inkjet printer 1 is provided with a paper discharge section 3 onto which the printed medium S is ejected. This paper discharge section 3 is provided with a paper discharge tray 7 for holding the printed medium S that has been ejected.

Figure 4:
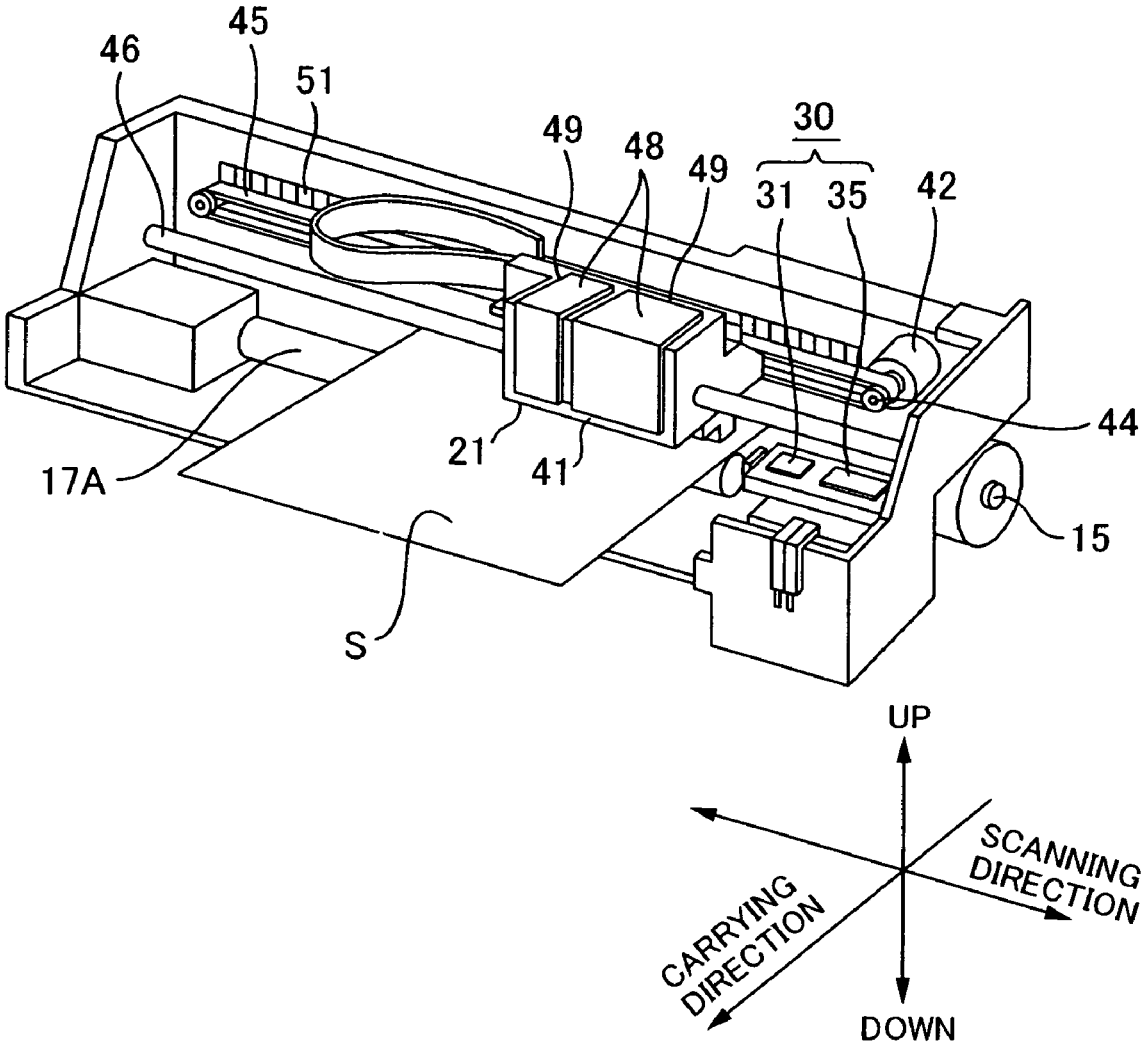
FIG. 4 is a perspective view showing the internal mechanisms of the inkjet printer.
Figure 5:
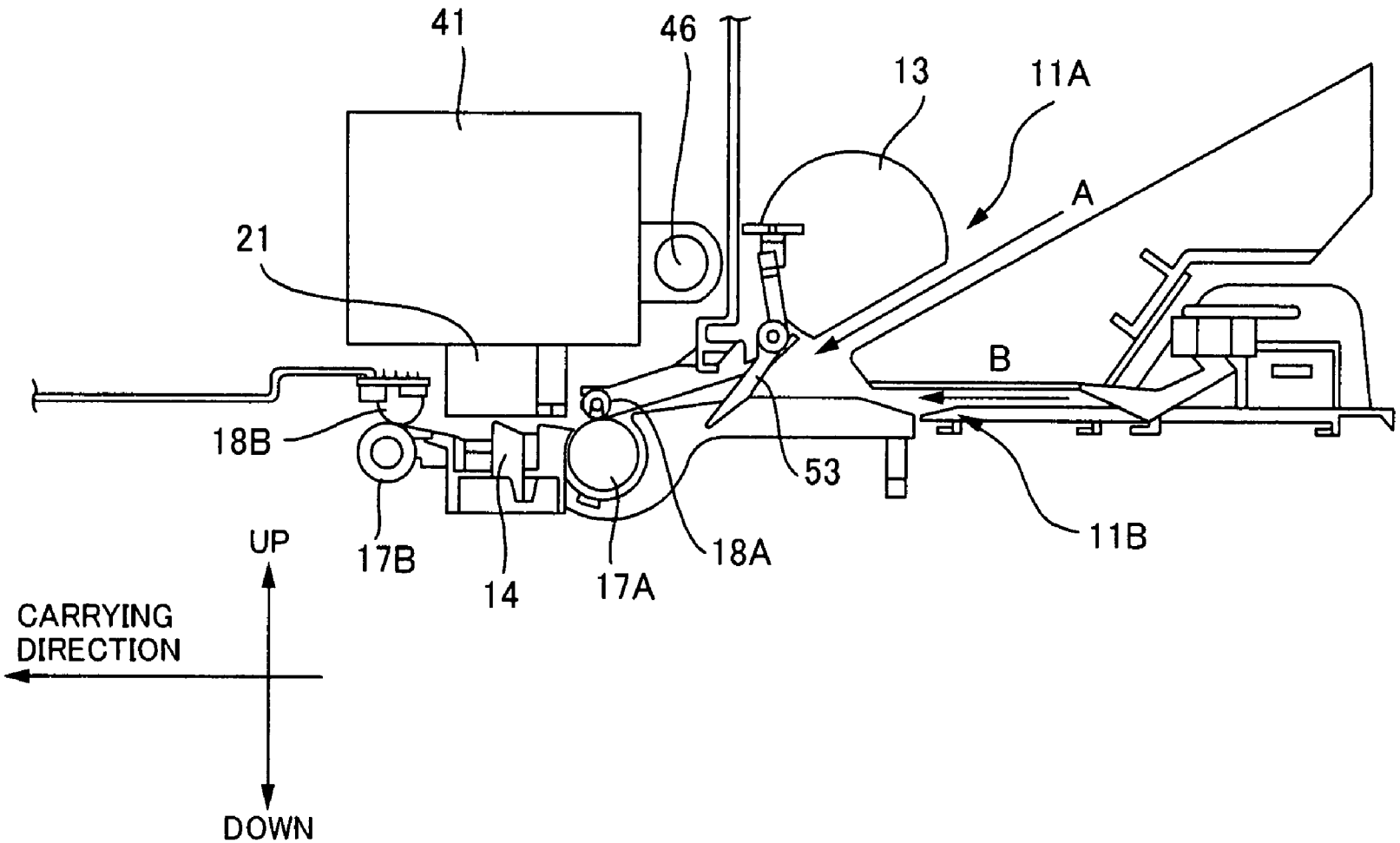
FIG. 5 is a transverse sectional view showing the internal mechanisms of the inkjet printer.
Figure 6:
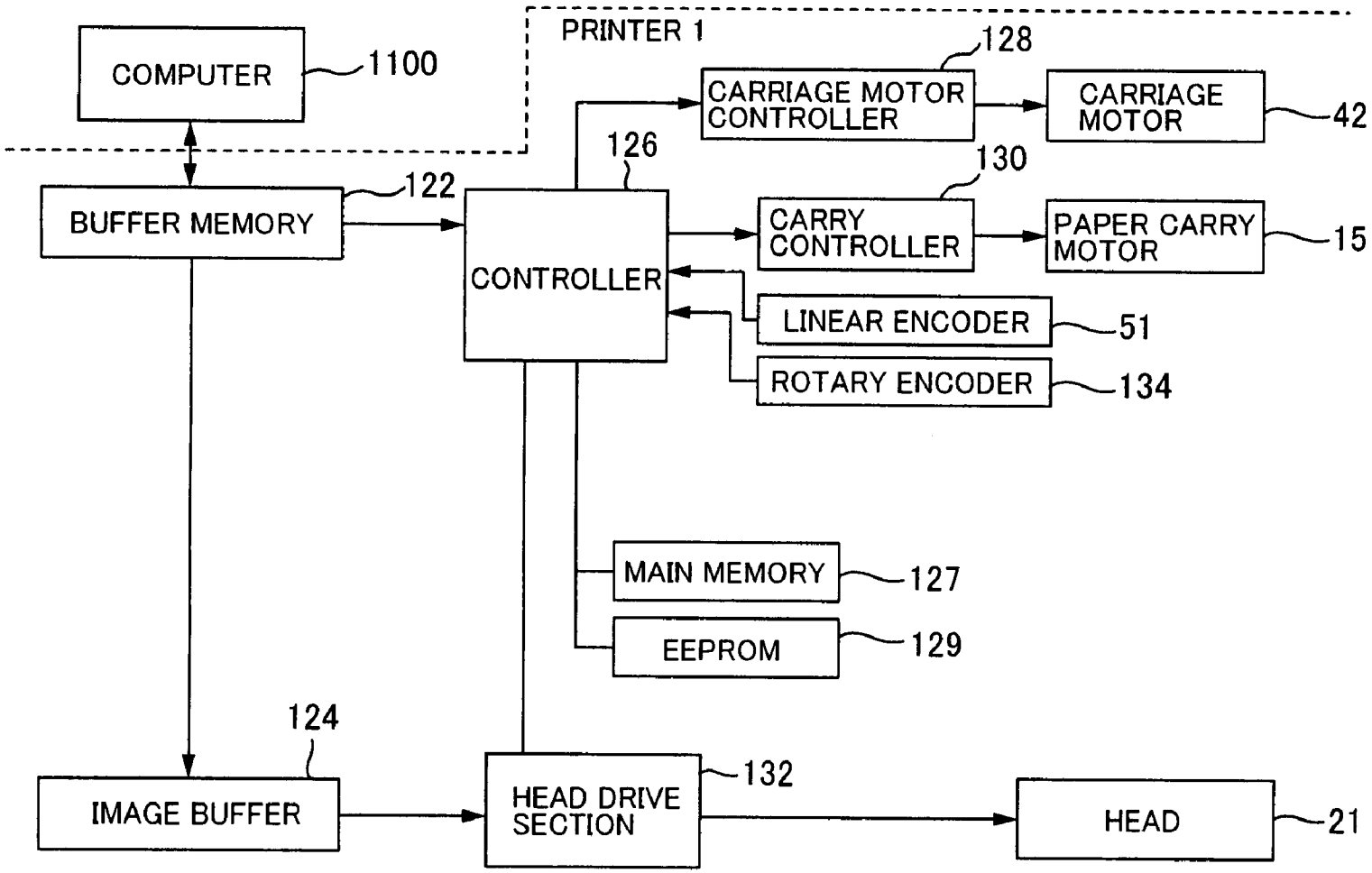
FIG. 6 is a block diagram showing a system configuration of the inkjet printer.

The following is a description of the internal configuration of the inkjet printer 1. FIGS. 4 to 6 illustrate the internal configuration of the inkjet printer 1. FIG. 4 illustrates the printing mechanism of the inkjet printer 1. FIG. 5 illustrates the carry mechanism of the inkjet printer 1. FIG. 6 is a block diagram illustrating the system configuration of the inkjet printer 1.

As shown in FIG. 4, the inkjet printer 1 is provided internally with a carriage 41. This carriage 41 is arranged such that it can move relatively to the lateral direction in the drawing (also referred to as "carriage movement direction" in the following; corresponds to the "direction intersecting the predetermined direction" of the present invention). A carriage motor (hereafter also referred to as "CR motor") 42, a pulley 44, a timing belt 45, and a guide rail 46 are provided in the vicinity of the carriage 41. The carriage motor 42 is constituted by a DC motor or the like and functions as a driving force for moving the carriage 41 relatively along the carriage movement direction. Furthermore, the timing belt 45 is connected to the carriage motor 42 via the pulley 44 and a portion of it is also connected with the carriage 41, such that the carriage 41 is moved relatively along the carriage movement direction by the rotational driving of the carriage motor 42. The guide rail 46 guides the carriage 41 along the carriage movement direction.

In addition to these, also provided in the vicinity of the carriage 41 are a linear encoder 51 that detects a position of the carriage 41, a carry roller 17A for carrying a medium S along a direction intersecting with the movement direction of the carriage 41 (corresponds to the "predetermined direction" of the present invention), and a paper feed motor 15 that rotationally drives the carry roller 17A.

On the other hand, ink cartridges 48 that store the various inks and a head 21 (corresponds to the "print head" of the present invention) that carries out printing on the medium S are provided on the carriage 41. The ink cartridges 48 store colored inks such as yellow (Y), magenta (M), cyan (C), and black (K) for example, and are mounted removably in a carriage mounting section 49 provided in the carriage 41. On the other hand, in this embodiment, the head 21 carries out printing by ejecting ink on the medium S. For this reason, a multitude of nozzles for ejecting ink are provided in the head 21. A detailed description of the ink ejecting mechanism of the head 21 is given later.

Additionally, a cleaning unit 30 for clearing clogging of the nozzles of the head 21 is arranged inside the inkjet printer 1. The cleaning unit 30 has a pump device 31 and a capping device 35. The pump device 31 sucks out ink from the nozzles in order to overcome clogging of the nozzles of the head 21 and is operated by a pump motor (not shown). The capping device 35 is for sealing the nozzles of the head 21 when printing is not being performed (for example during standby) so that the nozzles of the head 21 are kept from clogging.

The following is a description concerning the configuration of the carrying section of the inkjet printer 1. As shown in FIG. 5, the carrying section has a paper insert opening 11A and a roll paper insert opening 11B, a paper supply motor (not shown), a paper supply roller 13, a platen 14, a paper feed motor (hereinafter, also referred to as PF motor) 15, a carry roller 17A and a paper discharge roller 17B, and free rollers 18A and free rollers 18B. Of these, the paper feed motor 15, the carry roller 17A and the paper discharge roller 17B constitute the carrying mechanism of the present invention.

The paper insert opening 1A is where the medium S is inserted. The paper supply motor (not shown) is a motor for carrying the medium S that has been inserted into the paper insert opening 11A into the inkjet printer 1, and is constituted by a pulse motor. The paper supply roller 13 is a roller for automatically carrying the medium S that has been inserted into the paper insert opening 11A into the inkjet printer 1 in the arrow direction A in the figure (arrow direction B in the case of roll paper), and is driven by the paper supply motor. The paper supply roller 13 has a transverse cross-sectional shape that is substantially the shape of the letter D. The peripheral length of a circumference section of the paper supply roller 13 is set longer than the carrying distance to the paper feed motor 15, so that using this circumference section, the medium S can be carried up to the paper feed motor 15.

The medium S that has been carried by the paper supply roller 13 abuts against a paper detection sensor 53. This paper detection sensor 53 is positioned between the paper supply roller 13 and the carry roller 17A, so that it detects a medium S that is supplied by the paper supply roller 13.

The medium S that is detected by the paper detection sensor 53 is carried to the platen 14. The platen 14 is a support means that supports the medium S during printing. The paper feed motor 15 is a motor for feeding paper, which is an example of a medium S, in the paper carrying direction, and is constituted by a DC motor. The carry roller 17A is a roller for feeding the medium S that has been carried into the inkjet printer 1 by the paper supply roller 13 to a printable region, and is driven by the paper feed motor 15. The free rollers 18A are provided in opposition to the carry roller 17A, and push the medium S toward the carry roller 17A by sandwiching the medium S between them and the carry roller 17A.

The paper discharge rollers 17B are rollers for discharging the medium S for which printing has finished out of the inkjet printer 1. The paper discharge rollers 17B are driven by the paper feed motor 15 through a gear wheel that is not shown in the drawings. The free rollers 18B are provided in opposition to the paper discharge rollers 17B, and push the medium S toward the paper discharge rollers 17B by sandwiching the medium S between them and the paper discharge rollers 17B.

The following is a description concerning the system configuration of the inkjet printer 1. AS shown in FIG. 6, the inkjet printer 1 is provided with a buffer memory 122, an image buffer 124, a controller 126, a main memory 127, and an EEPROM 129. The buffer memory 122 receives and temporarily stores various data such as print data sent from a computer 1100. The image buffer 124 obtains the received print data from the buffer memory 122 and stores the print data. Furthermore, the main memory 127 is constituted by a ROM and a RAM for example.

On the other hand, the controller 126 reads out a control program from the main memory 127 and carries out the overall control of the inkjet printer 1 in accordance with this control program. The controller 126 of the present embodiment is provided with a carriage motor controller 128, a carry controller 130, a head drive section 132, a rotary encoder 134, and a linear encoder 51. The carriage motor controller 128 performs drive control of the carriage motor 42 for such aspects as rotation direction, number of rotations, torque and the like. Furthermore, the head drive section 132 performs drive control of the head 21. The carry controller 130 controls the various drive motors that are arranged in the carry system, such as the paper feed motor 15 that rotatively drives the carry roller 17A.

Print data that have been transferred from the computer 1100 are temporarily held in the buffer memory 122. Necessary information contained in the print data held here is read out by the controller 126. Based on the information that is read out, the controller 126 controls the carriage motor controller 128, the carry controller 130, and the head drive section 132 in accordance with a control program while referencing output from the linear encoder 51 and the rotary encoder 134.

Print data for a plurality of color components received by the buffer memory 122 is stored in the image buffer 124. The head drive section 132 obtains the print data of the various color components from the image buffer 124 in accordance with control signals from the controller 126, and drives the various color nozzles provided in the head 21 based on the print data.

===Head===

<Regarding the Configuration of the Head>

Figure 7:
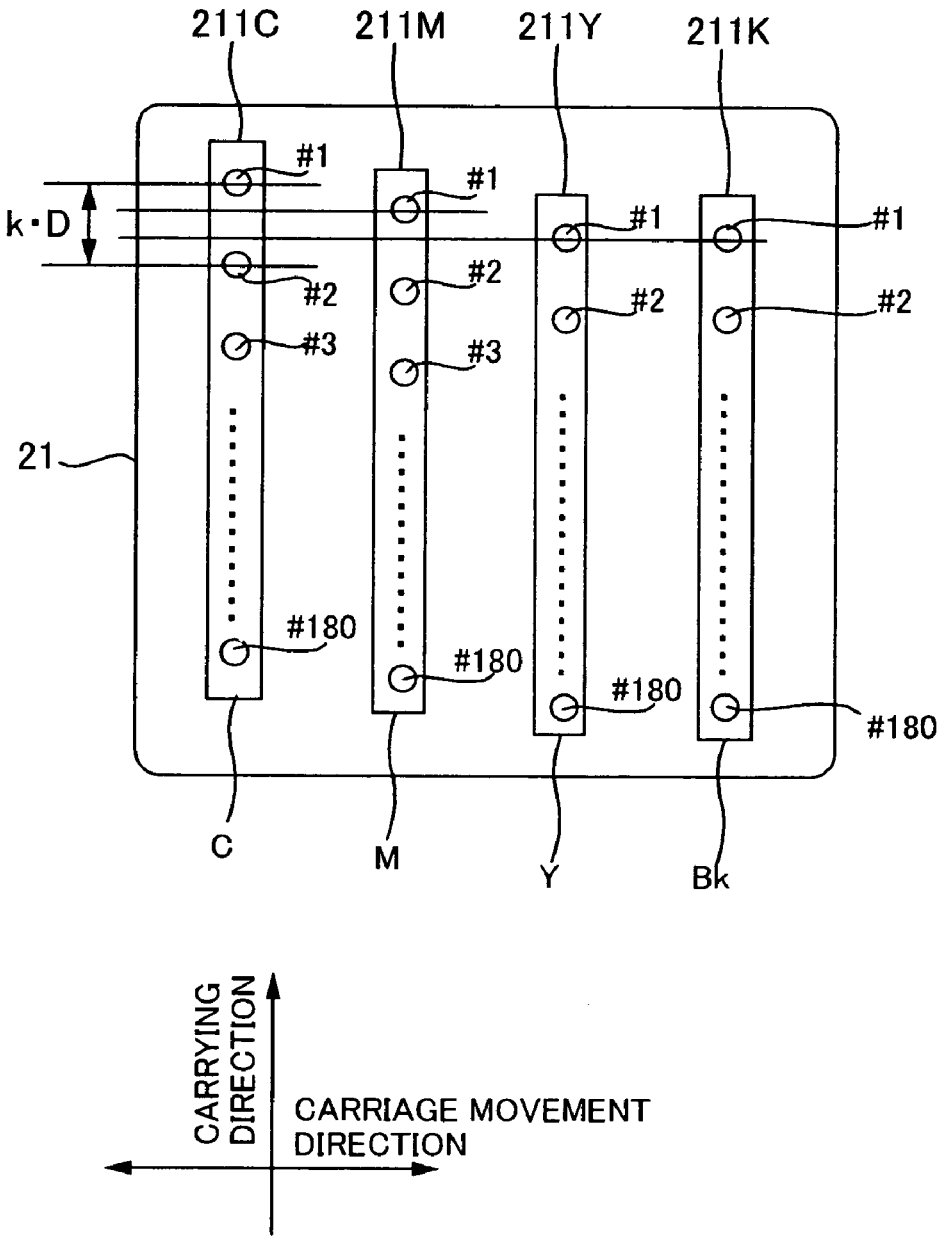
FIG. 7 is an explanatory diagram showing the arrangement of the nozzles in the head.

FIG. 7 is an explanatory diagram showing the arrangement of the nozzles in the lower surface of the head 21. A plurality of nozzle groups 211Y, 211M, 211C, and 211K ejecting ink of different colors are provided in the lower surface of the head 21 as shown in this drawing. In this embodiment, a yellow nozzle group 211Y ejecting yellow (Y) ink, a magenta nozzle group 211M ejecting magenta (M) ink, a cyan nozzle group 211C ejecting cyan (C) ink, a black nozzle group 211K ejecting black (K) ink are provided in the head 21 as nozzle groups. The nozzle groups 211Y, 211M, 211C, and 211K are each provided with a plurality (in this embodiment, 180) of nozzles #1 to #180 as ejection openings for ejecting the ink.

The nozzles #1 to #180 of each of the nozzle groups 211Y, 211M, 211C and 211K are arranged in a row at a constant spacing (nozzle pitch: k·D) in the carrying direction. Here, D is the minimum dot pitch in the carrying direction (that is, the spacing at the highest resolution of the dots formed on the medium S). Also, k is an integer of 1 or more. For example, if the nozzle pitch is 120 dpi (1/120 inch), and the dot pitch in the carrying direction is 360 dpi (1/360), then k=3.

The nozzles #1 to #180 of the nozzle groups 211Y, 211M, 211C and 211K are assigned a number (#1 to #180) that becomes smaller the more downstream the nozzle is in the carrying direction of the medium S. That is, the nozzle #1 is positioned more downstream in the carrying direction than the nozzle #180. Each nozzle (#1 to #180) is provided with a piezo element (not shown) as a drive element for driving that nozzle #1 to #180 and letting it eject ink.

When a voltage of a predetermined duration is applied between electrodes provided at both ends of the piezo elements, the piezo elements expand for the duration of voltage application and deform a lateral wall of the ink channel. As a result, the volume of the ink channel is constricted by an amount corresponding to the elongation of the piezo element, and ink corresponding to this amount of constriction becomes an ink droplet, which is ejected from the corresponding color nozzle #1 to #180.

<Regarding the Driving of the Head>

Figure 8:
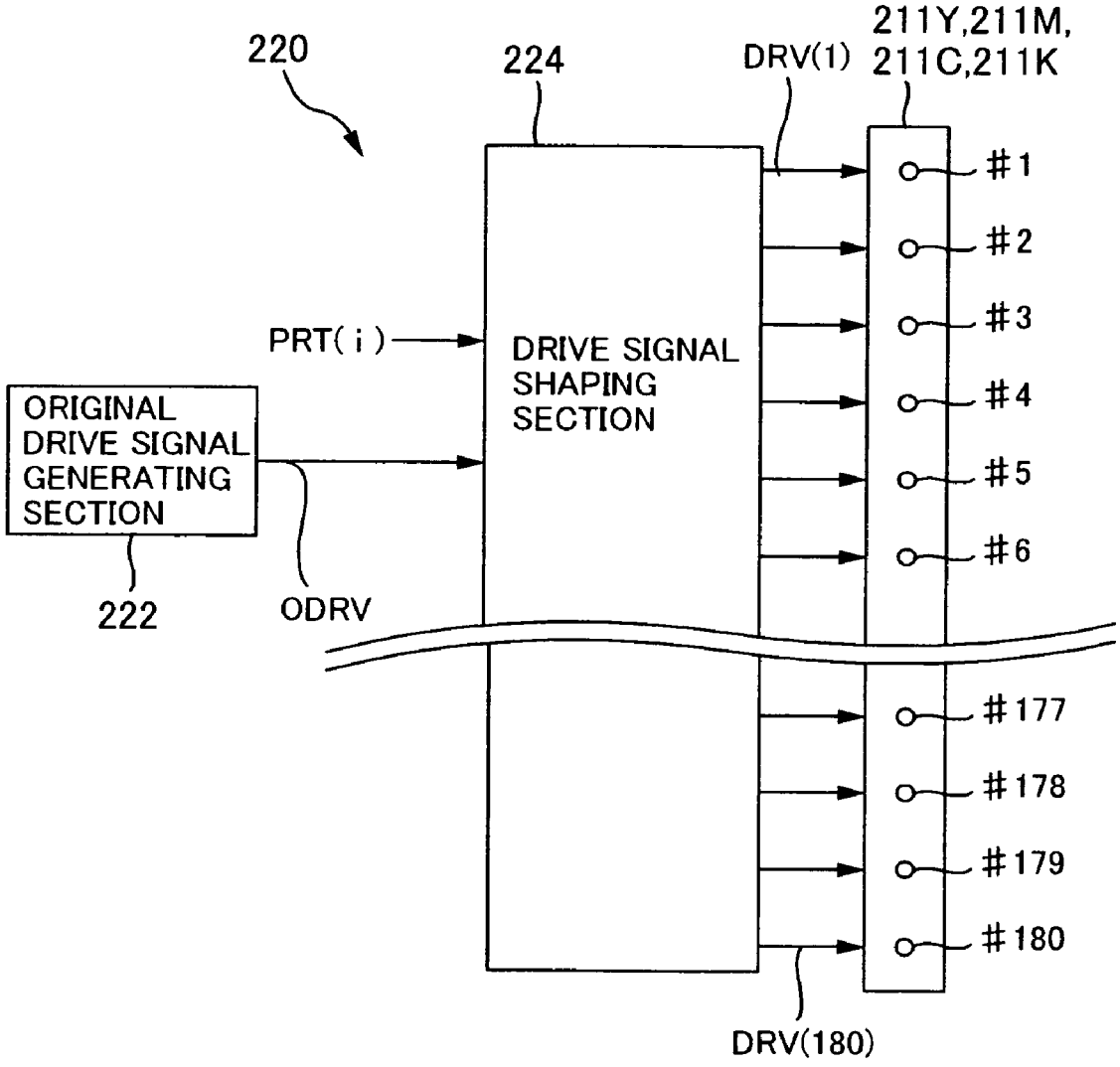
FIG. 8 is an explanatory diagram of the drive circuit of the nozzles.

FIG. 8 shows a nozzle drive circuit 220 of the nozzles #1 to #180. As shown in the diagram, this nozzle drive circuit 220 is provided with an original drive signal generation section 222 and a drive signal shaping section 224. In the present embodiment, this nozzle drive circuit 220 is provided for each of the nozzle groups. That is to say, four nozzle drive circuits 220 are provided in correspondence with the yellow ink nozzle group 211Y, the magenta ink nozzle group 211M, the cyan ink nozzle group 211C and the black ink nozzle group 211K. Moreover, the driving of the piezo elements of each of the nozzles #1 to #180 is carried out individually for each of the nozzle groups 211Y, 211M, 211C and 211K. The number in parentheses at the end of the name of the signal in the diagram indicates the number of the nozzle to which that signal is to be supplied to.

The original drive signal generation section 222 creates an original signal ODRV that is the same for the nozzles #1 to #180. This original signal ODRV is a signal that includes a plurality of pulses during the main-scanning period of a single pixel (time during which the carriage 41 crosses over the width of a single pixel).

The drive signal shaping section 224 receives the original signal ODRV from the original drive signal generation section 222 together with a print signal PRT(i). This print signal PRT(i) is a signal that specifies whether ink is ejected from the nozzles #1 to #180, as well as the size of the ink to be ejected. The print signal PRT(i) is generated based on the print data that have been sent from the external computer 1110, and is generated individually for each of the nozzles #1 to #180 of each nozzle group 211Y, 211M, 211C and 211K. Here, the signals PRT(1) to PRT(180) are generated respectively for the nozzle numbers of the nozzles #1 to #180.

The drive signal shaping section 224 shapes the original signal ODRV in correspondence with the level of the print signal PRT(i) and outputs it individually toward the piezo elements of the nozzles #1 to #180 as a drive signal DRV(i). The piezo elements of the nozzles #1 to #180 are driven in accordance with the drive signals DRV(1) to DRV(180) from the drive signal shaping section 224.

<Regarding the Drive Signals of the Head>

Figure 9:
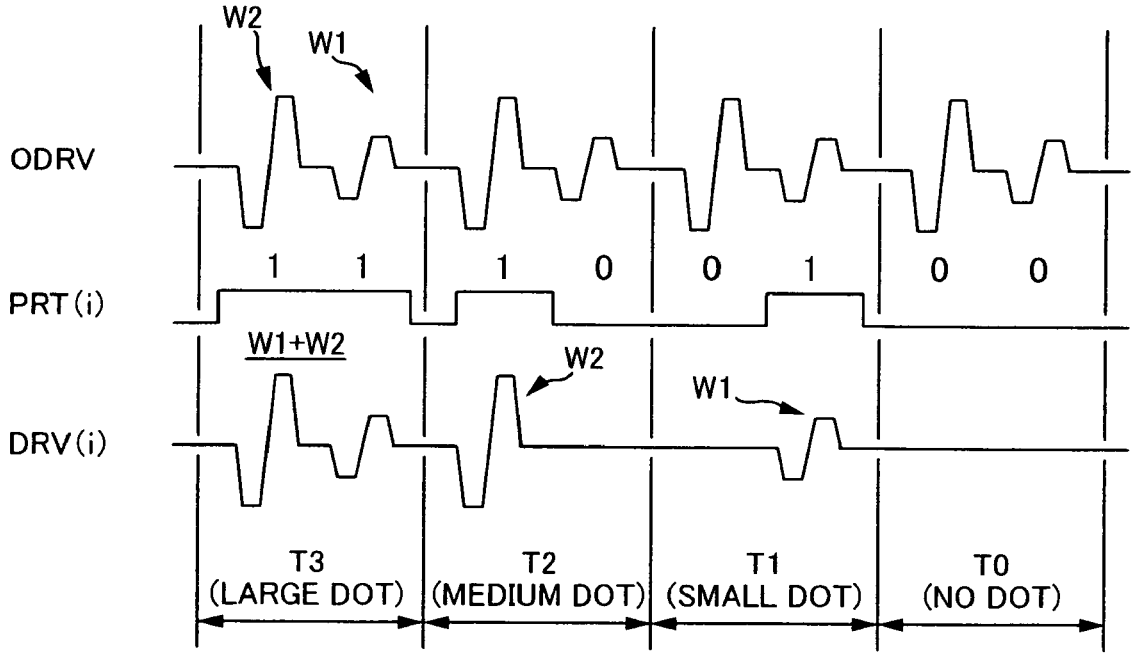
FIG. 9 is a timing chart for explaining the various signals.

FIG. 9 is a timing chart illustrating the various signals. That is, this figure shows a timing chart for the various signals, namely the original signal ODRV, the print signal PRT(i), and the drive signal DRV(i).

The original signal ODRV is a signal that is supplied from the original drive signal generation section 222 and is the same for the nozzles #1 to #180. In this embodiment, the original signal ODRV includes two pulses, namely a first pulse W1 and a second pulse W2, during the main-scanning period of a single pixel (period during which the carriage 41 crosses over the width of a single pixel). It should be noted that the original signal ODRV is output from the original signal generation section 222 to the drive signal shaping section 224.

The print signal PRT(i) is a signal corresponding to the pixel data allocated to a single pixel. That is, the print signal PRT(i) is a signal corresponding to the pixel data included in the print data. In this embodiment, the print signals PRT(i) are signals having two bits of information per pixel. It should be noted that the drive signal shaping section 224 shapes the original signal ODRV in correspondence with the signal level of the print signal PRT(i), and outputs a drive signal DRV(i).

The drive signal DRV(i) is a signal that is obtained by blocking the original signal ODRV in correspondence with the level of the print signal PRT(i). That is, when the print signal PRT(i) is at level "1", the drive signal shaping section 224 allows the pulses corresponding to the original signal ODRV to pass through, thus turning the original signal ODRV into the drive signal DRV. On the other hand, when the print signal PRT(i) is at level "0", then the drive signal shaping section 224 blocks the pulses of the original signal ODRV. It should be noted that the drive signal shaping section 224 outputs the drive signal DRV to the piezo elements that are provided for each of the nozzles #1 to #180. The piezo elements are then driven in accordance with the drive signal DRV(i).

When the print signal PRT(i) corresponds to the two bits of data "01", then only the first pulse W1 is output in the first half of the pixel period. Thus, a small ink droplet (referred to in the following as "small ink droplet") is ejected from the nozzle, and a dot of small size ("small dot") is formed on the medium S. When the print signal PRT(i) corresponds to the two bits of data "10", then only the second pulse W2 is output in the second half of a single pixel interval. Thus, a medium-sized ink droplet (referred to in the following as "medium ink droplet") is ejected from the nozzle, and a dot of about medium size ("medium dot") is formed on the medium S. When the print signal PRT(i) corresponds to the two bits of data "11", then both the first pulse W1 and the second pulse W2 are output during a single pixel interval. Accordingly, a large ink droplet is ejected from the nozzle, forming a large-sized dot (large dot) on the medium S. When the print signal PRT(i) corresponds to the two bits of data "00", then neither the first pulse W1 nor the second pulse W2 is output during the pixel period. In this case, no ink droplet of any size is ejected from the nozzle, and no dot is formed on the medium S.

As described above, in the inkjet printer according to the present embodiment, the drive signal DRV(i) in a single pixel period is shaped so that it can have four different waveforms corresponding to the four different values of the print signal PRT(i).

===Printing Operation===

Figure 10:
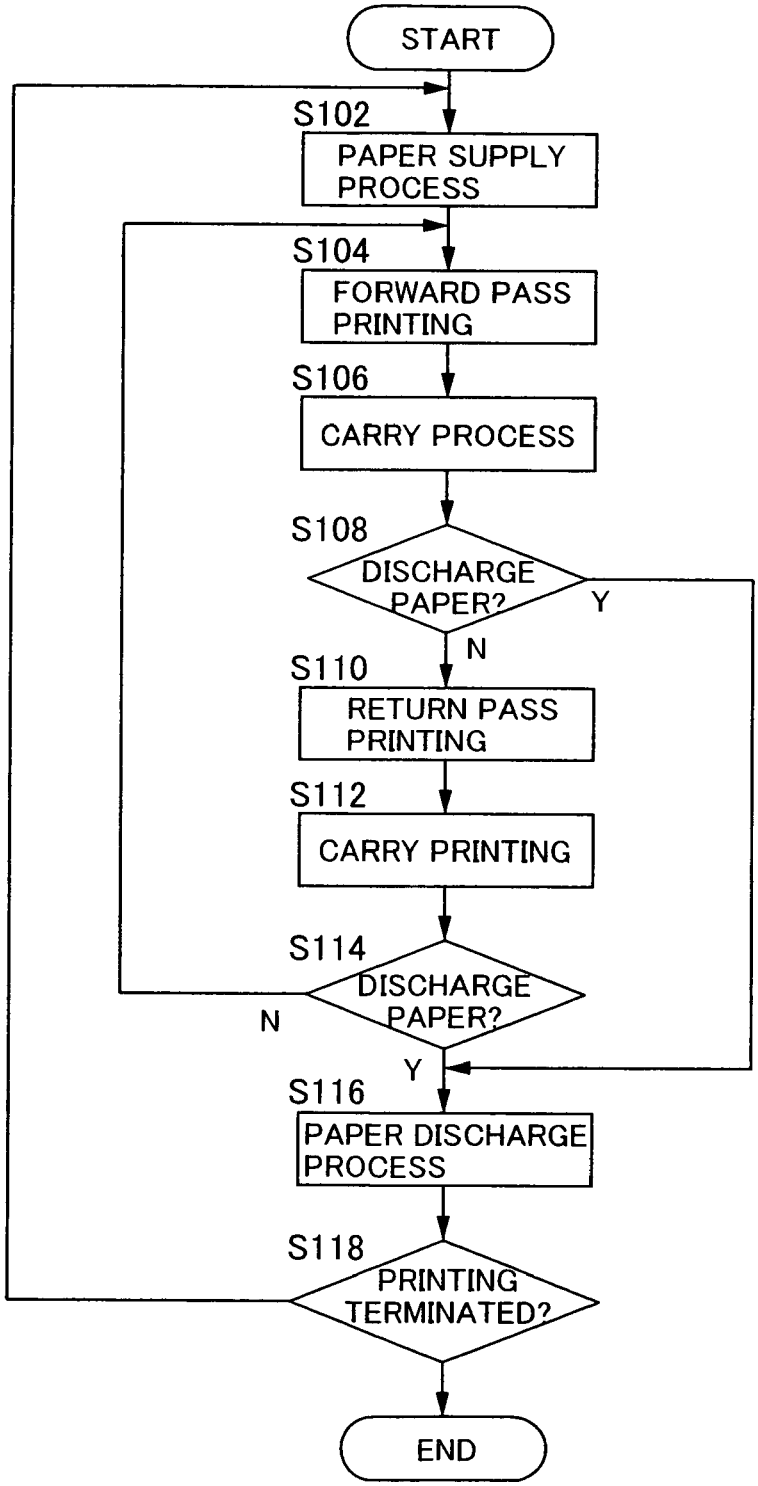
FIG. 10 is a flowchart illustrating an example of a printing method.

The following is a description of the printing operation of the above-described inkjet printer 1. Here, an example of "bidirectional printing" is explained. FIG. 10 is a flowchart illustrating an example of the process flow of the printing operation of the inkjet printer 1. The processes described below are carried out by letting the controller 126 read the program stored in the main memory 127 or EEPROM 129 and controlling each unit in accordance with this program.

When the controller 126 receives the print data from the computer 1100, then printing is to be performed in accordance with this print data, and first a paper supply process is carried out (S102). In the paper supply process, a medium S to be printed is supplied into the inkjet printer 1 and carried to a print start position (also referred to as "indexing position"). The controller 126 rotates the paper supply roller 13 to feed the medium S to be printed up to the carry roller 17A. The controller 126 rotates the carry roller 17A to position the medium S that has been fed from the paper supply roller 13 at the print start position.

Next, the controller 126 carries out a printing process, in which the medium S is printed while moving the carriage 41 relative to the medium S. It should be noted that the printing operation of the present invention is performed by this printing process. Here, first, forward pass printing in which ink is ejected from the head 21 is performed while moving the carriage 41 in one direction along the guide rail 46 (S104). The controller 126 moves the carriage 41 by driving the carriage motor 42, and ejects ink by driving the head 21 in accordance with the print data. The ink ejected from the head 21 reaches the medium S, forming dots.

After printing in this manner, a carry process of carrying the medium S by a predetermined amount is executed (S106). It should be noted that the carry operation of the present invention is performed by this carry process. In this carry process, the controller 126 rotates the carry roller 17A by driving the paper feed motor 15, and carries the medium S by a predetermined amount in the carrying direction relative to the head 21. With this carry process, the head 21 can print onto a region that is different from the region printed on before.

After carrying out the carrying process in this manner, a paper discharge judgment is performed, which judges whether the paper should be ejected or not (S108). Here, a paper discharge process is carried out if there is no more data to be printed onto the medium S that is currently being printed (S116). On the other hand, if there is data left to be printed onto the medium S that is currently being printed, then no paper discharge process is carried out and return pass printing is executed (S110). In this return pass printing, printing is performed while moving the carriage 41 along the guide rail 46 in the opposite direction to the previous forward pass printing. Also here, the controller 126 moves the carriage 41 by rotatively driving the carriage motor 42 in the opposite direction as before, ejects ink by driving the head 21 based on the print data and performs printing.

After return pass printing has been executed, a carry process is executed (S112), and then a paper discharge judgment process is performed (S114). Here, if there is data left to be printed onto the medium S that is currently being printed, then no paper discharge process is carried out, the procedure returns to Step S104, and forward pass printing is executed again (S104). On the other hand, a paper discharge process is executed if there is no more data to be printed onto the medium S that is currently being printed (S116).

After the paper discharge process has been carried out, a print termination judgment is executed, in which it is judged whether printing should be terminated or not (S118). Here, based on the print data from the computer 1100, it is checked whether there is a further medium S to be printed left. If there is a further medium S to be printed left, then the procedure returns to Step S102, another paper supply process is executed, and printing begins. On the other hand, if no further medium S to be printed is left, then the printing process is terminated.

===Print Modes===

The inkjet printer 1 of the present embodiment is provided with a regular print mode and a draft print mode as the print modes. The draft print mode is a mode for executing the printing process at high speed. In the draft print mode, the printing process is executed while leaving out a portion of the image to be printed, in order to execute the printing process at high speed. That is to say, the printing process is executed while thinning out the image to be printed at a predetermined ratio. Thus, the printing speed is increased drastically, and the printing process can be executed at high speed. On the other hand, the printed image quality drops the more a part of the image to be printed is left out and thinned out. For this reason, the draft print mode is used for trial printing and test prints.

On the other hand, in the regular print mode, the printing process is executed without a drop in the printed image quality as in the draft print mode. In the regular print mode, the image to be printed is not thinned out considerably as in the draft print mode, so that a higher print quality than in the draft print mode can be ensured. Accordingly, in the regular print mode, the printing process cannot be executed with the same high speed as in the draft print mode.

Figure 11:
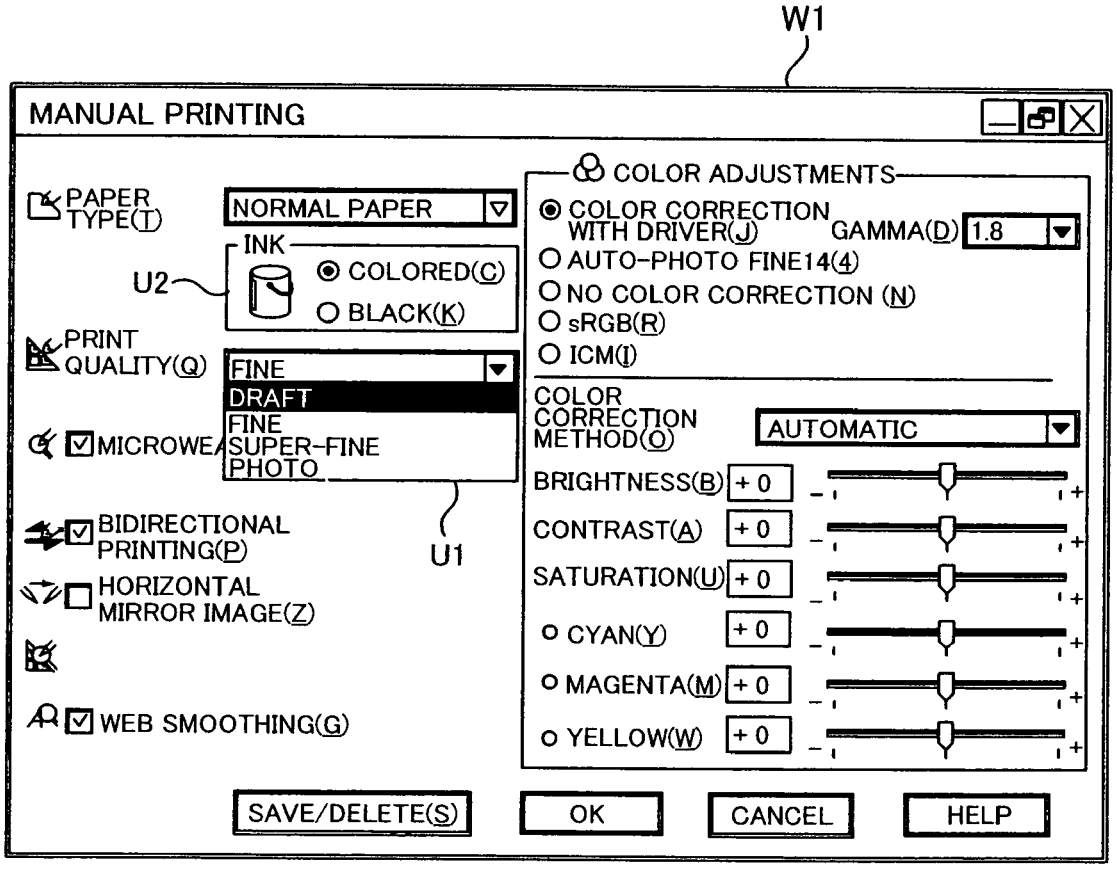
FIG. 11 is an explanatory diagram showing an example of a setting screen for setting the print quality.

FIG. 11 shows an example of a setting screen for setting the print mode. If the printing process is to be executed in the draft print mode, then the user calls up, from the setting screen of the printer driver, a setting screen W1 for setting the print quality as shown in FIG. 11, for example. Then, in a pull-down menu of the field "print quality" in this setting screen, the printing quality is set to "draft". By performing these settings, the image can be printed in the draft print mode.

It should be noted that setting the print quality here to "fine", "superfine" or "photo" corresponds to the regular print mode.

===Printing Method for the Regular Print Mode===

FIGS. 12A, 12B, 13A, 13B, 14A and 14B illustrate a printing method for the regular print mode. Here, the "interlaced mode" and the "overlap mode" are explained as examples of the printing method for the regular print mode.

<Interlaced Mode>

Figure 12A:
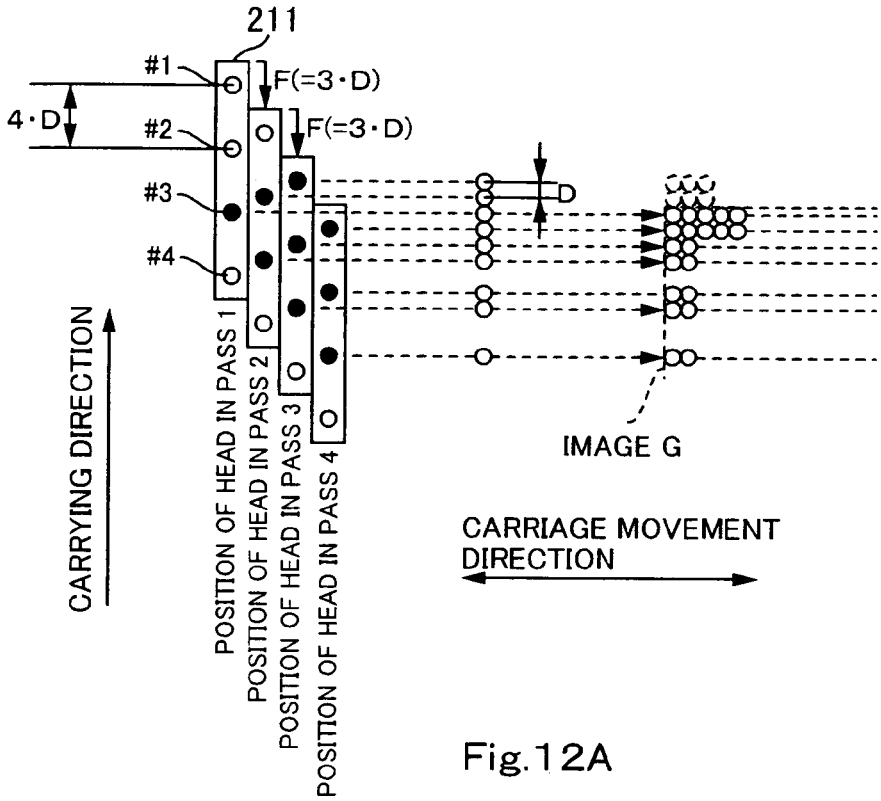
FIG. 12A is an explanatory diagram illustrating an example of the image printing procedure in an interlaced mode.
Figure 12B:
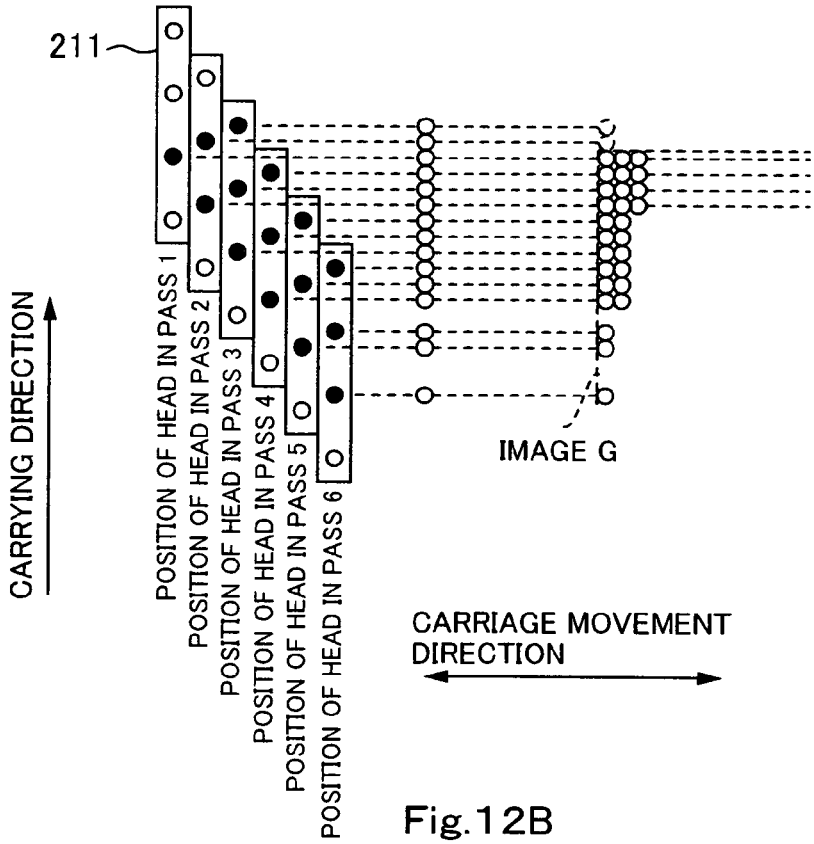
FIG. 12B is an explanatory diagram illustrating an example of the image printing procedure in an interlaced mode.

FIGS. 12A and 12B diagrammatically show a method for printing an image G by forming dots on the medium S in the interlaced mode. It should be noted that for the sake of explanation, the nozzle groups 211 ejecting ink (corresponding to the nozzle groups 211Y, 211M, 211C and 211K of the present embodiment) are shown to be moving with respect to the medium S, but these figures merely show the relative positions between the nozzle groups 211 and the medium S, and in actuality it is the medium S that moves in the carrying direction. In the diagrams, the nozzles represented by black circles are the nozzles that eject ink, and the nozzles represented by white circles are nozzles that do not eject ink. FIG. 12A shows the positions of the nozzle groups 211 (head 21) and the manner in which dots are formed in passes 1 to 4, and FIG. 12B shows the positions of the nozzle groups 211 (head 21) and the manner in which dots are formed in passes 1 to 6.

Here, "pass" means an operation in which the head 21 including the nozzle groups 211 is moved once in its movement direction due to the movement of the carriage 41. In the "interlaced mode", by repeatedly executing such a "pass", dots are formed next to one another in the movement direction of the carriage 41 in each pass, and the image G is printed by forming successive raster lines constituting the image G to be printed. It should be noted that "raster line" refers to a row of pixels lined up in the movement direction of the carriage 41 and is also referred to as "scanning line." "Pixels" are the square boxes that are determined virtually on the medium S in order to define the positions where ink droplets are caused to land so as to record dots.

In the interlaced mode, every time the medium S is carried in the carrying direction by a constant carry amount F, the nozzles record a raster line immediately above the raster line that was recorded in the immediately prior pass. In order to carry out recording in this way with a constant carry amount F, the number N (integer) of nozzles that can eject ink is set to be coprime to k and the carry amount F is set to N·D.

Here, it is shown how an image G is formed using the nozzles #1 to #4 of the nozzles #1 to #180 of the nozzle group 211. It should be noted that since the nozzle pitch of the nozzle group 211 is 4D, not all the nozzles can be used so that the condition for the interlaced mode, that is, "N and k are coprime", is satisfied. Accordingly, the case that is explained here is that an image G is formed in the interlaced mode using simply three nozzles #1 to #3. Furthermore, because three nozzles are used, the medium S is carried by a carry amount 3·D. As a result, by using a nozzle group 211 with a nozzle pitch of 180 dpi (4·D) for example, dots are formed on the paper with a dot spacing of 720 dpi (=D).

The figures show the manner in which continuous raster lines are formed, with the first raster line being formed by the nozzle #1 in pass 3, the second raster line being formed by the nozzle #2 in pass 2, the third raster line being formed by the nozzle #3 in pass 1, and the fourth raster line being formed by the nozzle #1 in pass 4. It should be noted that only the nozzle #3 ejects ink in pass 1 and only the nozzle #2 and the nozzle #3 eject ink in pass 2. The reason for this is that if ink is ejected from all of the nozzles in pass 1 and pass 2, continuous raster lines cannot be formed on the medium S. In pass 3 and thereafter, the three nozzles (#1 to #3) eject ink and the paper is carried by a constant carry amount F (=3·D), and thus continuous raster lines are formed with a dot spacing D. Thus, raster lines are formed successively in each pass, and the image G is printed.

Figure 13A:
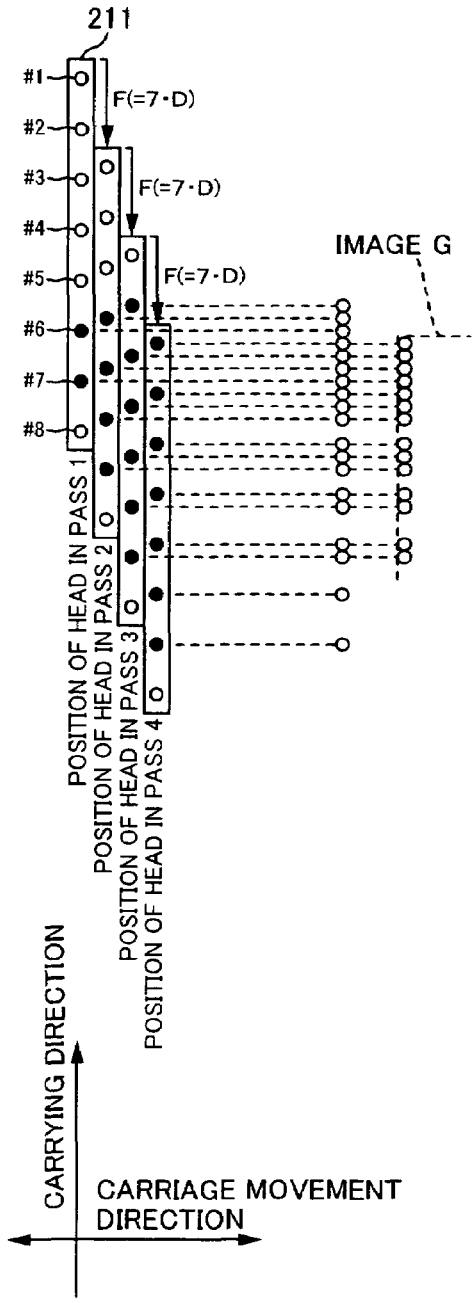
FIG. 13A is an explanatory diagram illustrating an image printing procedure in another interlaced mode.
Figure 13B:
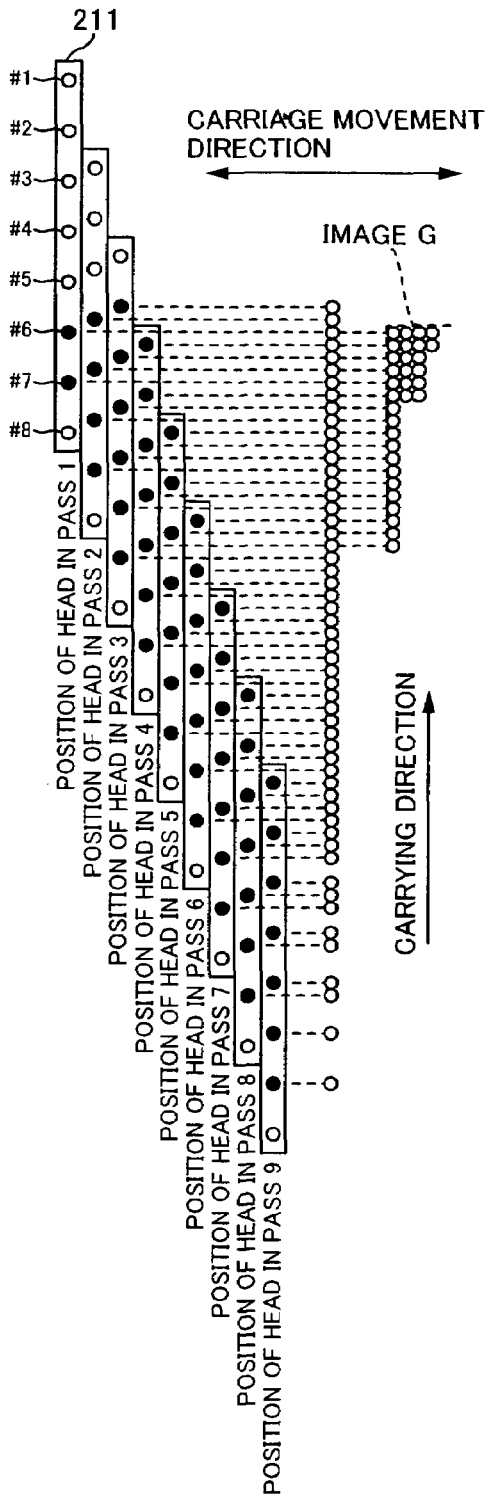
FIG. 13B is an explanatory diagram illustrating an image printing procedure in another interlaced mode.

FIG. 13A and FIG. 13B illustrate another method of the interlaced mode. Here, the number of nozzles used is different. The nozzle pitch, for example, is the same as in the case of the above-described explanatory diagrams, so that the description thereof is omitted. FIG. 13A shows the positions of the nozzle group 211 and the manner in which dots are formed in passes 1 to 4, and FIG. 13B shows the positions of the nozzle group 211 and the manner in which dots are formed in passes 1 to 9.

These figures illustrate an example in which #1 to #8 of the nozzles #1 to #180 of the nozzle group 211 are used to print an image G on the medium S. Here, since the nozzle pitch of the nozzle groups 211 is 4D, not all the nozzles can be used so that the condition for the interlaced mode, that is, "N and k are coprime", is satisfied. Accordingly, the case that is explained here is that the interlaced mode is performed using simply seven nozzles #1 to #7. The carry amount of the medium S is set to 7·D, since seven nozzles #1 to #7 are used.

These diagrams show the manner in which continuous raster lines are formed, with the first raster line being formed by the nozzle #2 in pass 3, the second raster line being formed by the nozzle #4 in pass 2, the third raster line being formed by the nozzle #6 in the pass 1, and the fourth raster line being formed by the nozzle #1 in the pass 4. It should be noted that after pass 3, all seven nozzles (#1 to #7) eject ink and the medium S is carried by a constant carry amount F (=7·D) to form continuous raster lines with a dot spacing D.

Compared to the above-described interlaced mode, the number of nozzles used for ejecting ink is larger. Therefore, the number N of nozzles that eject ink is increased, so that the carry amount F during a single carry is increased, and thus a faster printing speed is attained. In this manner, in the interlaced mode, it is advantageous to increase the number of nozzles that can eject ink because this increases the printing speed.

<Overlap Mode>

Figure 14A:
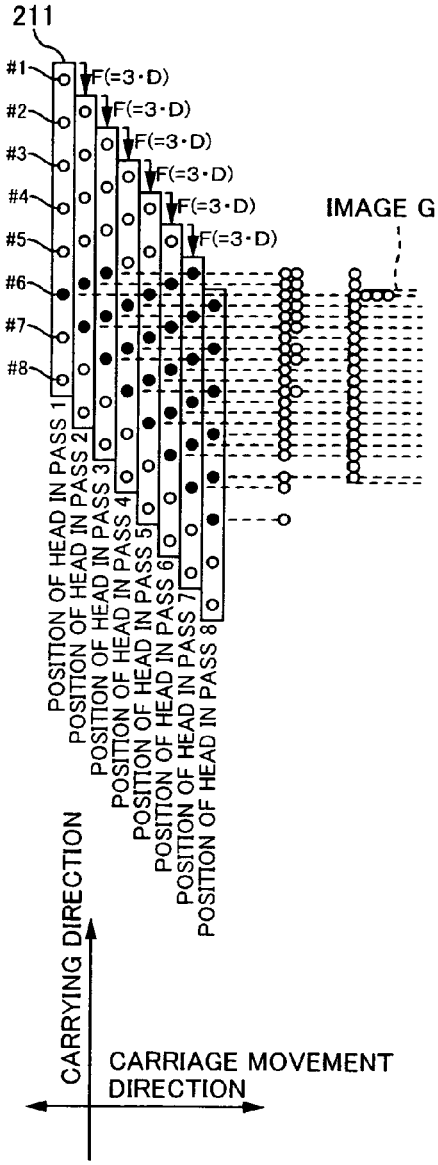
FIG. 14A is an explanatory diagram illustrating an example of the image printing procedure in an overlap mode.
Figure 14B:
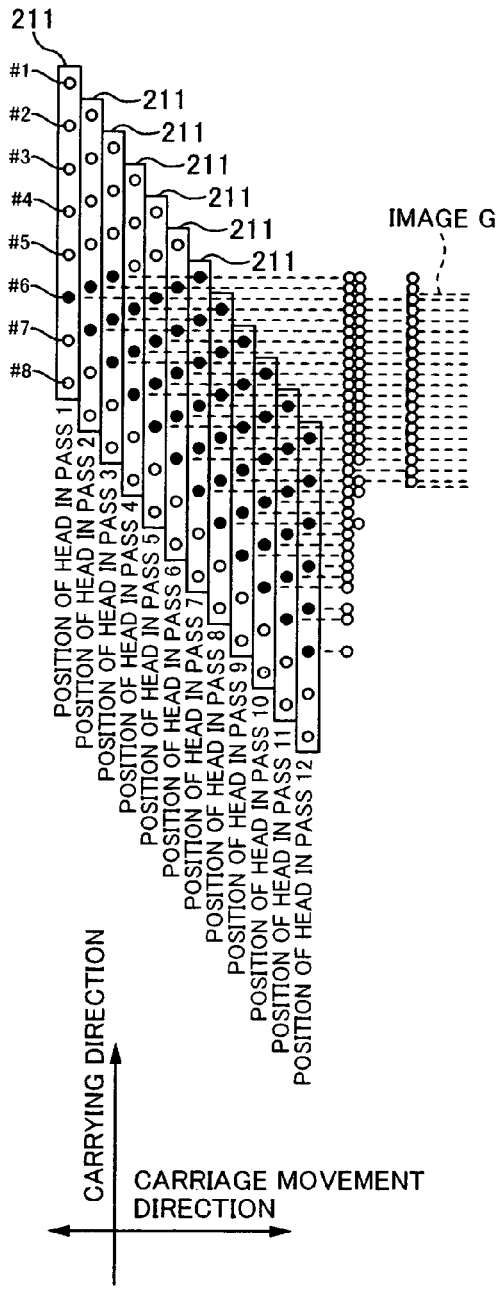
FIG. 14B is an explanatory diagram illustrating an example of the image printing procedure in an overlap mode.

FIG. 14 schematically illustrates a method for printing an image G on a medium S with the overlap mode. FIG. 14A shows how dots are formed at the positions of a nozzle group 211 (corresponding to nozzle groups 211Y, 211M, 211C and 211*k* of this embodiment) in passes 1 to 8, and FIG. 14B shows how dots are formed at the positions of the nozzle group 211 in passes 1 to 12. In the previously described interlaced mode, a single raster line was formed by a single nozzle. In the overlap mode, however, a single raster line for example is formed with two or more nozzles.

In the overlap mode, each time the medium S is carried by the constant carry amount F in the carrying direction, the nozzles form dots intermittently at every other or every several dots. Then, by letting another nozzle form dots in another pass to complement the intermittent dots that have already been formed, a single raster line is completed by a plurality of nozzles. The overlap number M is defined as the number M of passes needed to complete a single raster line. In the figure, since each nozzle forms dots intermittently at every other dot, dots are formed in every pass either at the odd-numbered pixels or at the even-numbered pixels. Since a single raster line is formed using two nozzles, the overlap number is M=2. It should be noted that the overlap number is M=1 in the case of the interlaced mode.

In the overlap mode, the following conditions (1) to (3) are required in order to perform the recording with a constant carry amount:

(1) N/M is an integer.

(2) N/M is coprime to k.

(3) The carry amount F is set to (N/M)·D.

In FIG. 14, the nozzle number of the nozzle group 211 is 180. However, since the nozzle pitch of the nozzle group 211 is 4D (k=4), not all the nozzles can be used, in order to fulfill the condition that "N/M and k are coprimes", which is one of the conditions for printing in the overlap mode. Accordingly, an example is shown here in which an image G is formed using the nozzles #1 to #6 of the nozzles #1 to #180 of the nozzle group 211. Since six nozzles are used, the medium S is carried by a carry amount 3·D. As a result, using a nozzle group with a nozzle pitch of 180 dpi (4·D) for example, dots are formed on the medium S with a dot spacing of 720 dpi (=D). Furthermore, in a single pass, the nozzles form dots intermittently in the carriage movement direction at every other dot. In the figure, raster lines are already completed in which two dots are drawn in the carriage movement direction. For example, in FIG. 14A, the first through the sixth raster lines have already been completed. Raster lines in which only one dot is drawn are raster lines in which dots have been formed intermittently at every other dot. For example, in the seventh and tenth raster lines, dots are formed intermittently every other dot. It should be noted that the seventh raster line, in which dots have been intermittently formed at every other dot, is completed by having the nozzle #1 fill it up in pass 9.

The figures show the manner in which continuous raster lines are formed, with the first raster line being formed by the nozzle #4 in pass 3 and the nozzle #1 in pass 7, the second raster line being formed by the nozzle #5 in pass 2 and the nozzle #2 in pass 6, the third raster line being formed by the nozzle #6 in pass 1 and the nozzle #3 in pass 5, and the fourth raster line being formed by the nozzle #4 in pass 4 and the nozzle #1 in pass 8. It should be noted that in the passes 1 to 6, some of the nozzles #1 to #6 do not eject ink. The reason for this is that if ink is ejected from all of the nozzles in the passes 1 to 6, continuous raster lines cannot be formed on the medium S. It should be noted that after pass 7, all six nozzles (#1 to #6) eject ink and the medium S is carried by a constant carry amount F (=3·D) to form continuous raster lines with a dot spacing D.

The following shows a summary of the formation position in the carriage movement direction of dots that are formed in the respective passes.

| | Pass | | | | | | | |
|---|---|---|---|---|---|---|---|---|
| | 1 | 2 | 3 | 4 | 5 | 6 | 7 | 8 |
| Recorded pixel | odd | even | odd | even | even | odd | even | odd |

Here, "odd" means that dots are formed at odd-numbered pixels of the pixels lined up in the carriage movement direction (pixels in a raster line). Moreover, "even" in the table means that dots are formed at even-numbered pixels of the pixels lined up in the carriage movement direction. For example, in pass 3, the nozzles form dots at odd-numbered pixels. When a single raster line is formed by M nozzles, k×M passes are required in order to complete a number of raster lines corresponding to the nozzle pitch. For example, in this embodiment, a single raster line is formed by two nozzles, so that 8 (4×2) passes are required in order to complete four raster lines. As can be seen from Table 1, in the four passes during the first half, dots are formed in the order of odd-even-odd-even. Consequently, when the four passes during the first half have finished, dots are formed at even-numbered pixels in raster lines adjacent to raster lines in which dots are formed at odd-numbered pixels. In the four passes during the second half, dots are formed in the order of even-odd-even-odd. In other words, in the four passes during the second half, dots are formed in reverse order with respect to the four passes during the first half. Consequently, dots are formed so as to fill up gaps between the dots that have been formed in the passes during the first half.

Also in the overlap mode, when the number N of nozzles that can eject ink is increased, the carry amount F during a single carry is increased, and thus the printing speed is increased, as in the above-described interlaced mode. Therefore, in the overlap mode, it is advantageous to increase the number of nozzles that can eject ink because this increases the printing speed.

===Printing Method for the Draft Print Mode===

Figure 15:
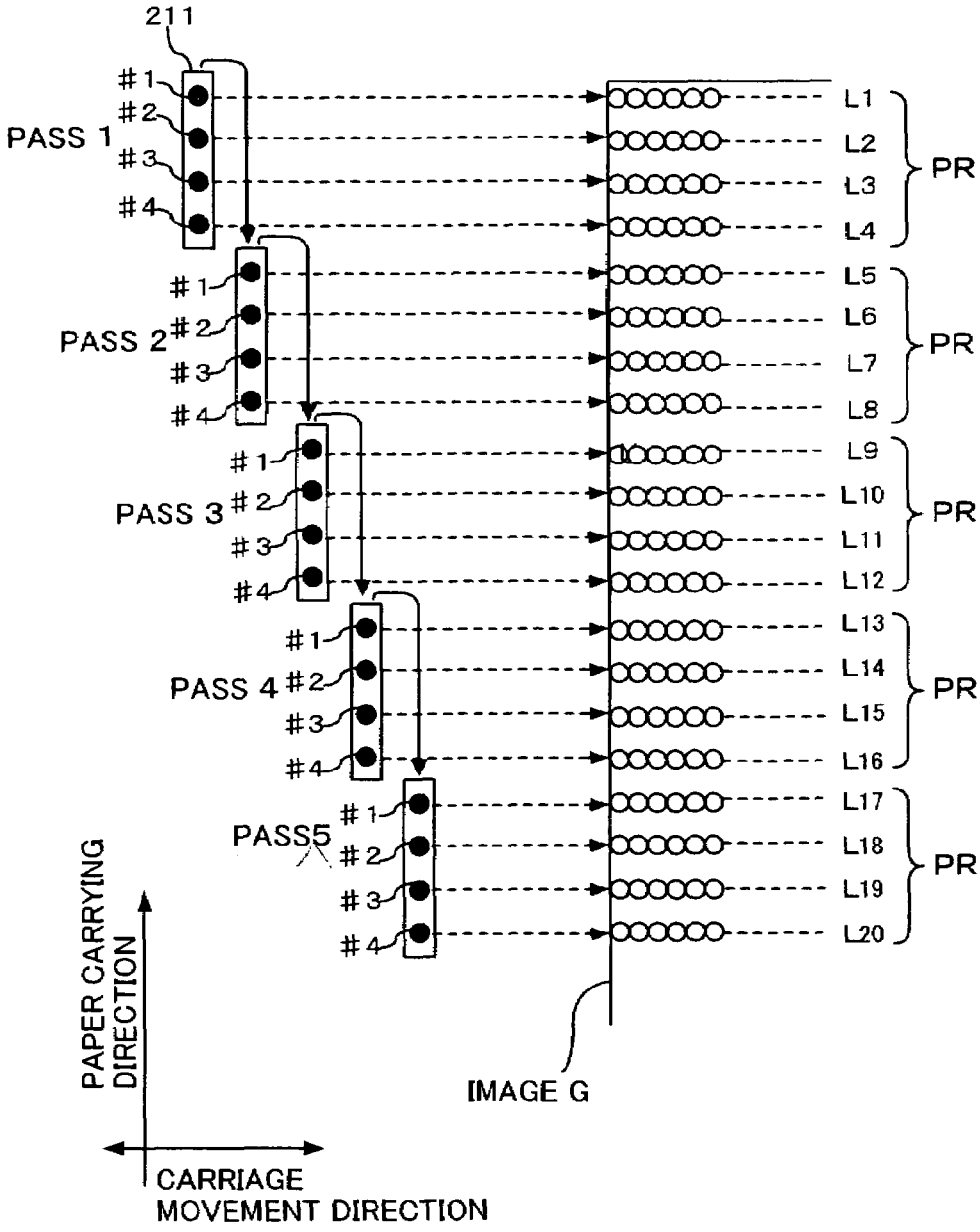
FIG. 15 is an explanatory diagram illustrating an example of a printing method for the draft print mode.

The following is a detailed explanation of a printing method for the draft print mode. FIG. 15 illustrates an example of a printing method for the draft print mode. In the "interlaced mode" and the "overlap mode" of the above-described regular print mode, printing was not carried out using all nozzles, but in this draft print mode, the printing process is executed using all usable nozzles. It should be noted that here, a simple example is explained in which the nozzle group 211 has four nozzles #1 to #4. Moreover, the nozzles ejecting ink are shown as black circles.

Also in this draft print mode, as in the above-described two print modes, namely the "interlaced mode" and the "overlap mode", dots are formed on the medium S by ejecting ink from the nozzles #1 to #4 when the head 21 moves in the movement direction of the carriage 41. The dots formed on the medium S form dot rows lined up in the movement direction of the carriage 41, and form raster lines L1 to L4 of the image G that is printed. However, in this draft print mode, before executing the next pass after one pass has been finished, the carry amount of the medium S to be carried differs between the "interlaced mode" and the "overlap mode." That is to say, in order to print the image G with high speed, the carry amount of the medium S in the draft print mode is set to a value that is much larger than in the regular print modes of the "interlaced mode" or the "overlap mode."

Here, as shown in FIG. 15, the carry amount of the medium S between passes is set such that the region PR that is printed in one pass does not overlap with the region PR that is printed in the next pass. In other words, the carry amount of the medium S is set in accordance with the length in the carrying direction of the nozzle group 211. That is to say, here, there is no process of forming raster lines in a given pass, then in between the formed raster lines forming different raster lines in different passes to gradually fill the spaces between the raster lines in order to form the image G, as in the cases of the "interlaced mode" and the "overlap mode".

Four of the raster lines L1 to L20 formed here are formed in each pass by the nozzles #1 to #4 of the nozzle group 211. As shown in the figure, the raster lines L1 to L20 are formed at a spacing corresponding to the nozzle spacing (nozzle pitch) of the nozzles #1 to #4. The nozzle spacing (nozzle pitch) of the nozzles #1 to #4 is very large, so that the resolution of the printed image G is lower than in the "interlaced mode" or the "overlap mode." On the other hand, since the carry amount of the medium S between the passes 1 to 5 is very large, the print speed in the draft print mode can be increased drastically, and the image G can be printed very quickly.

===Processing of the Printer Driver===

As mentioned above, in the regular print mode, in which the printing process is executed by such print modes as the "interlaced mode" or the "overlap mode", a different number of raster lines is formed than in the draft print mode, and the resolution of the printed image is different. Therefore, when executing the printing process, if the draft print mode is set, the processing executed by the printer driver 1110 is different from the case that a regular print mode is set.

The printer driver 1110 carries out a resolution conversion process in accordance with the set print mode, when performing the resolution conversion process of converting the image data (text data, image data etc.) that has been output from the application program 1104 with the resolution conversion processing section 1112 into the resolution to be printed on the medium S. That is to say, if the print mode is set to the regular print mode, then the resolution conversion processing section 1112 executes a resolution conversion process of converting the image data into a resolution in accordance with this regular print mode (this corresponds to the first resolution of the present invention). Further, if the print mode is set to the draft print mode, then the resolution conversion processing section 1112 executes a resolution conversion process of converting the image data into a resolution in accordance with this draft print mode (this corresponds to the second resolution of the present invention). Further, if the print mode is set to yet another print mode, then the resolution conversion processing section 1112 executes a resolution conversion process of converting the image data into a resolution in accordance with that other print mode.

It should be noted that since in the draft print mode the number of raster lines that are formed is lower than in the regular print mode, as noted above, the resolution that is set in the draft print mode is lower than the resolution corresponding to the regular print mode.

Figure 16:
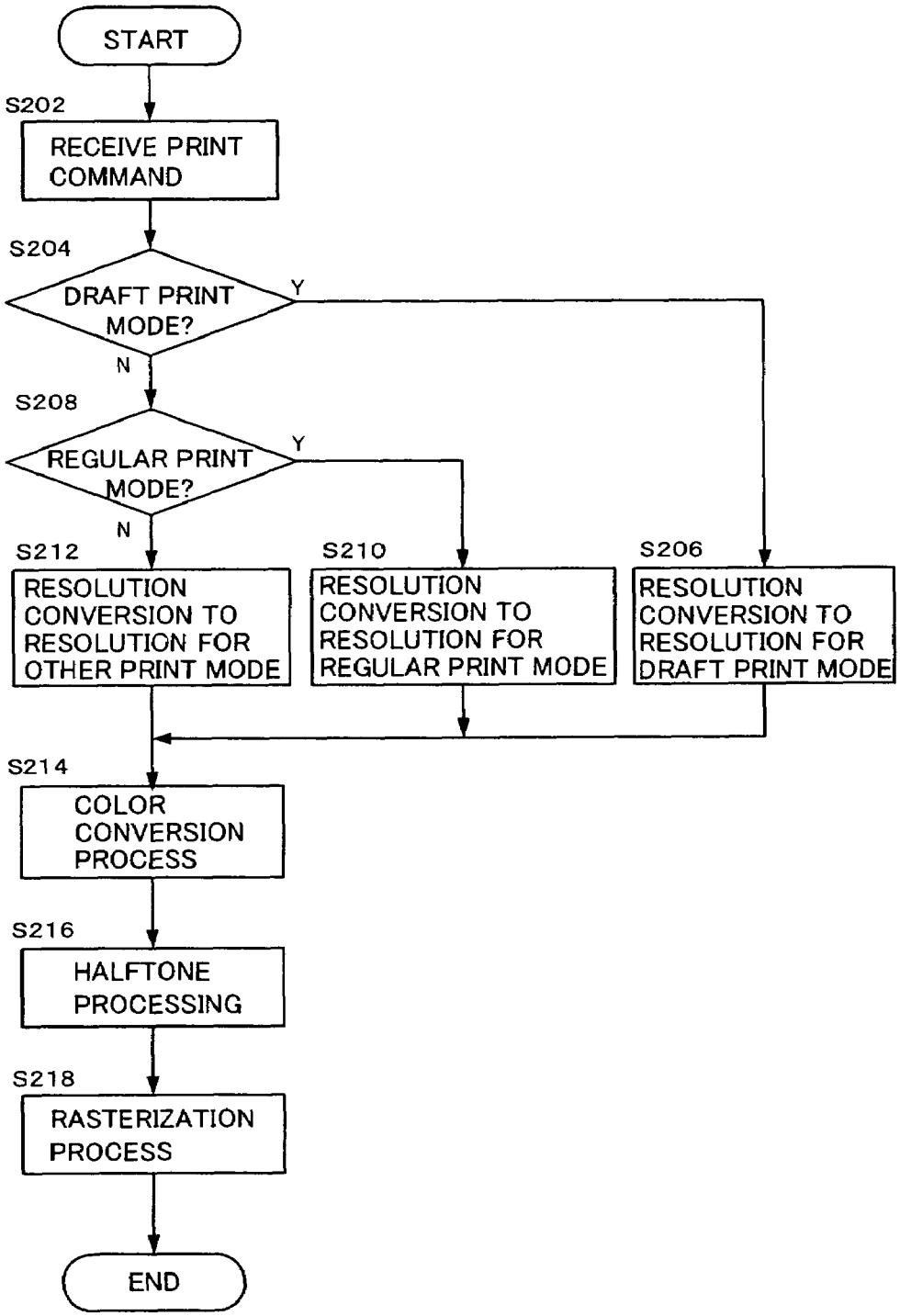
FIG. 16 is a flowchart illustrating a processing procedure of the printer driver.

FIG. 16 is a flowchart outlining the processing procedure of the printer driver 1110 in the printing process.

When the printer driver 1110 receives a print command from the user or the like (S202), then it is first checked whether or not the set print mode is set to the "draft print mode" (S204). If the print mode is set to the "draft print mode," then the procedure advances to Step S206, and the resolution conversion processing section 1112 executes a process of converting the image data output from the application program 1104 into the resolution corresponding to the draft print mode. That is to say, if the resolution corresponding to the draft print mode is for example "120 dpi (vertically)×360 dpi (horizontally)", then a process of converting the image data to this resolution is executed (S206).

On the other hand, if the print mode is not set to the "draft print mode," then the procedure advances next to Step S208, and the printer driver 1110 checks whether or not the print mode is set to the regular print mode. Here, if the print mode is set to the regular print mode, then the procedure advances to Step S210, and the resolution conversion processing section 1112 executes a process of converting the image data output from the application program 1104 to the resolution corresponding to the regular print mode. That is to say, if the resolution corresponding to the regular print mode is for example "360 dpi (vertically)×360 dpi (horizontally)", then a process of converting the image data to this resolution is executed (S210).

On the other hand, if the print mode is not set to the "regular print mode," then the procedure advances next to Step S212, the printer driver 1110 judges that the printer is in another print mode, and the resolution conversion processing section 1112 executes a process of converting the image data into a resolution corresponding to this other print mode. That is to say, if the resolution corresponding to the other print mode is for example "720 dpi (vertically)×720 dpi (horizontally)", then a process of converting the image data to this resolution is executed (S212).

After performing this process of converting the image data into the resolution of the corresponding print mode, the printer driver 1110 lets the color conversion processing section 1114 carry out a color conversion process of converting the image data generated by this conversion (RGB image data) into CMYK data expressed in CMYK color space (S214).

Next, the printer driver 1110 lets the halftone processing section 1116 carry out a halftone process of converting the image data obtained by the color conversion process (CMYK image data) into data of a number of gradations that can be formed by the inkjet printer 1 (S216).

Then, the printer driver 1110 lets the rasterization processing section 1118 carry out a rasterization process of converting the data obtained by the halftone process into the data order to be transferred to the inkjet printer 1 (S218). Then, the printer driver 1110 outputs the above rasterized data to the inkjet printer 1.

===Conventional Problems (for the Case of Color Printing)===

<Conventional Nozzle Arrangement>

Figure 17:
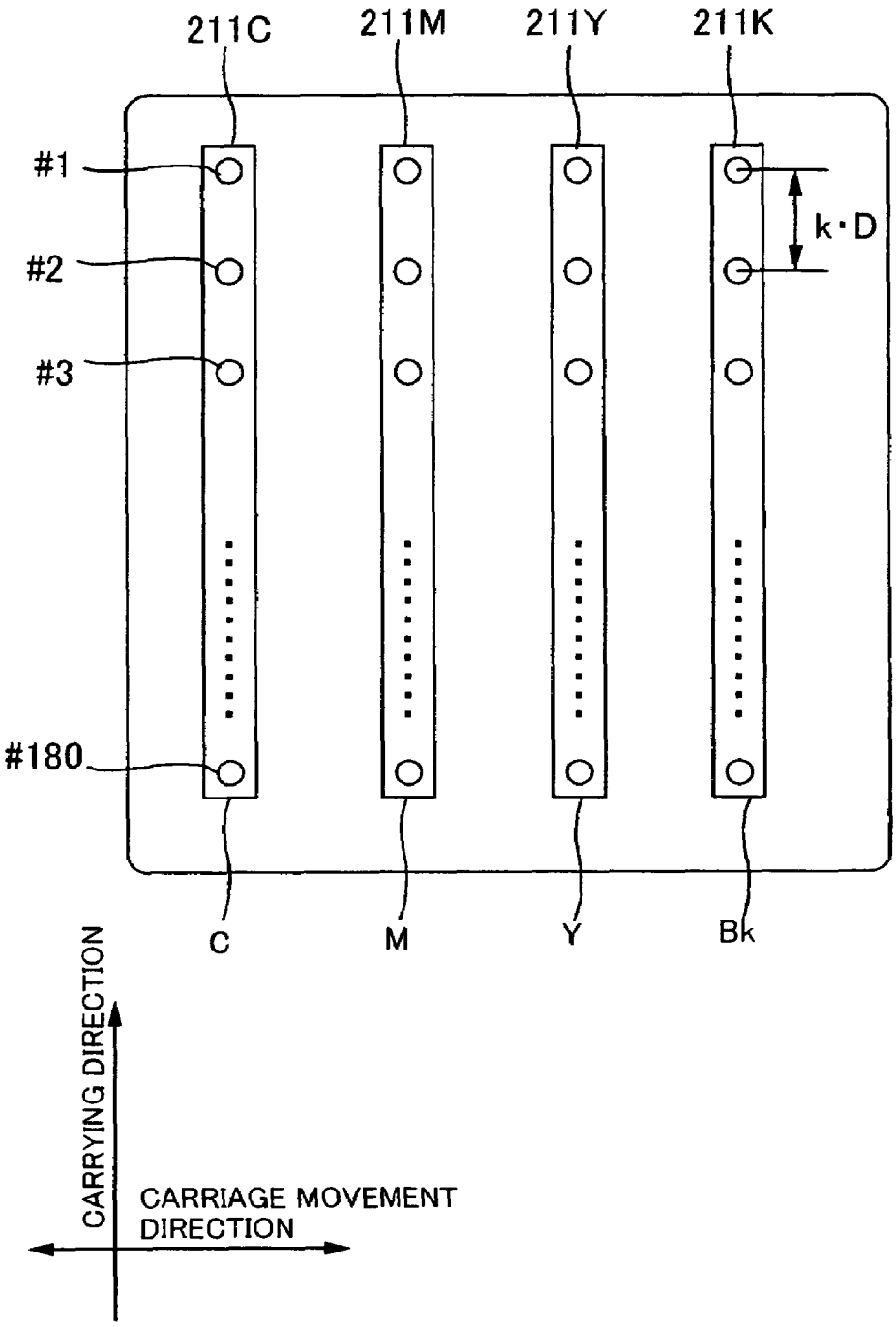
FIG. 17 is an explanatory diagram showing an example of a conventional nozzle arrangement.

FIG. 17 shows an example of a conventional nozzle arrangement. As shown in this figure, the head 21 is provided with a yellow nozzle group 211Y ejecting yellow (Y) ink, a magenta nozzle group 211M ejecting magenta (M) ink, a cyan nozzle group 211C ejecting cyan (C) ink, a black nozzle group 211K ejecting black (K) ink.

These nozzle groups 211Y, 211M, 211C and 211K are arranged next to each other at a spacing in the movement direction of the carriage 41. The nozzle groups 211Y, 211M, 211C and 211K are arranged such that their positions in the carrying direction are the same. That is to say, the nozzles #1 to #180 of the nozzle groups 211Y, 211M, 211C and 211K are arranged such that nozzles with the same numbers are positioned at the same positions in the carrying direction. Here, the nozzle spacing (nozzle pitch) of the nozzle groups 211Y, 211M, 211C and 211K is set evenly to "k·D".

<Problems>

The following problems occur when carrying out the printing process in the draft print mode with the head 21 provided with the nozzle groups 211Y, 211M, 211C and 211K of this arrangement.

Figure 18:
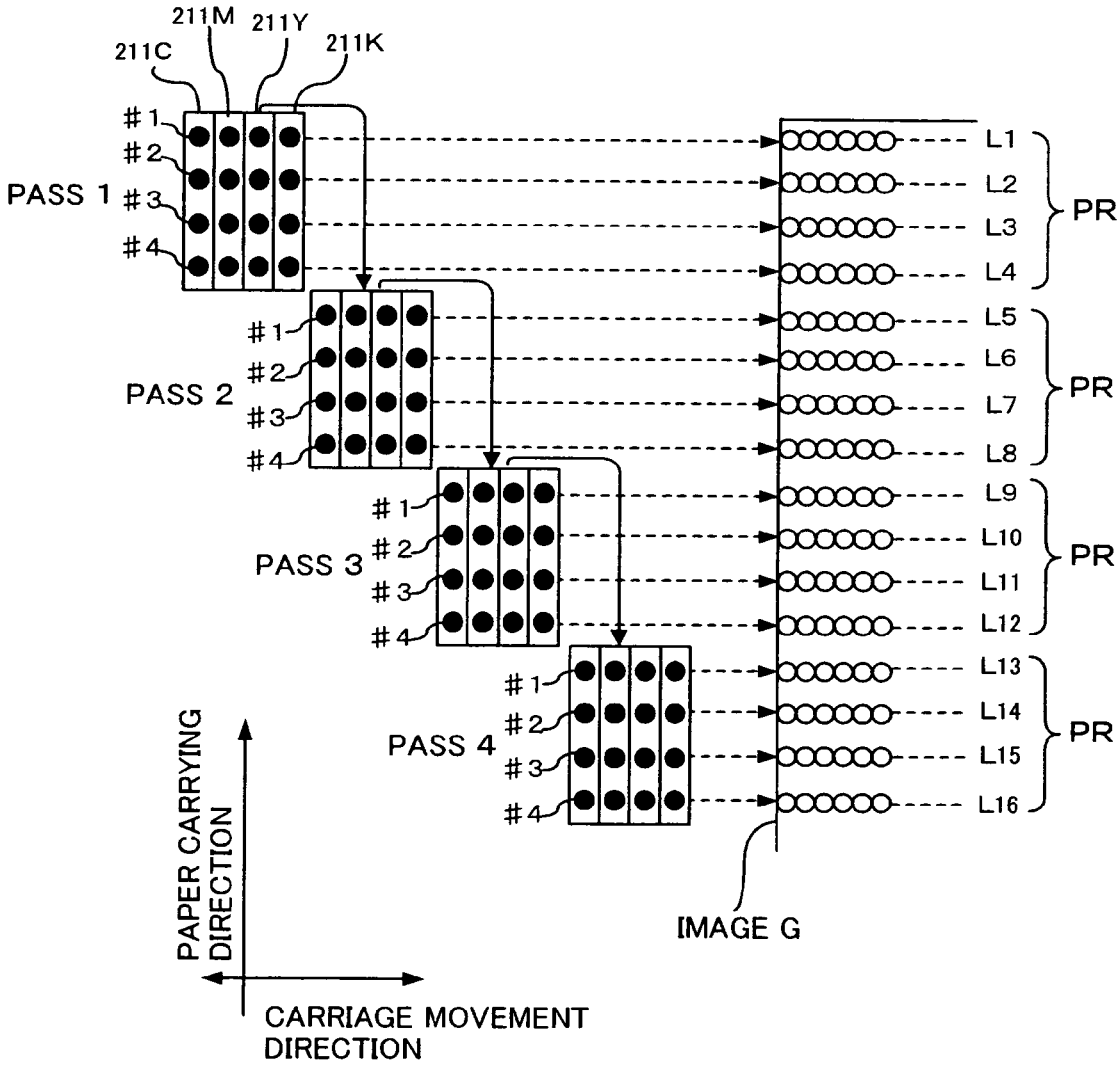
FIG. 18 is an explanatory diagram illustrating the problems of the prior art.

FIG. 18 is a more detailed illustration of this problem. When ink is ejected from the nozzles #1 to #4 of the nozzle groups 211Y, 211M, 211C and 211K while the head 21 provided with the nozzle groups 211Y, 211M, 211C and 211K of the arrangement shown in FIG. 17 moves in the movement direction of the carriage 41, then the ink ejected from the nozzles #1 to #4 of the nozzle groups 211Y, 211M, 211C and 211K is ejected onto the same lines L1 to L16 for each of the nozzles #1 to #4, as shown in FIG. 18. That is to say, the ink ejected from the nozzles #1 to #4 of the yellow nozzle group 211Y, the ink ejected from the nozzles #1 to #4 of the magenta nozzle group 211M, the ink ejected from the nozzles #1 to #4 of the cyan nozzle group 211C, and the ink ejected from the nozzles #1 to #4 of the black nozzle group 211K is all ejected onto the same lines L1 to L16 for each of the nozzles #1 to #4.

Thus, the dot rows formed by the ink ejected from the nozzles #1 to #4 of the nozzle groups 211Y, 211M, 211C and 211K is formed overlapping for each of the nozzles #1 to #4. That is to say, the dot rows formed by the ink ejected from the nozzles #1 to #4 of the yellow nozzle group 211Y, the dot rows formed by the ink ejected from the nozzles #1 to #4 of the magenta nozzle group 211M, the dot rows formed by the ink ejected from the nozzles #1 to #4 of the cyan nozzle group 211C, and the dot rows formed by the ink ejected from the nozzles #1 to #4 of the black nozzle group 211K are all formed overlapping on the same lines L1 to L16 for each of the nozzles #1 to #4. The raster lines L1 to L16 constituting the printed image are thus formed by the overlapping dot rows.

Therefore, there are large gaps in which no dots are formed between the raster lines L1 to L16. These gaps are formed as "blank spaces" in the printed image. Therefore, there was the problem that the printed image is coarse, and overall the colors appear thin.

Figure 19:
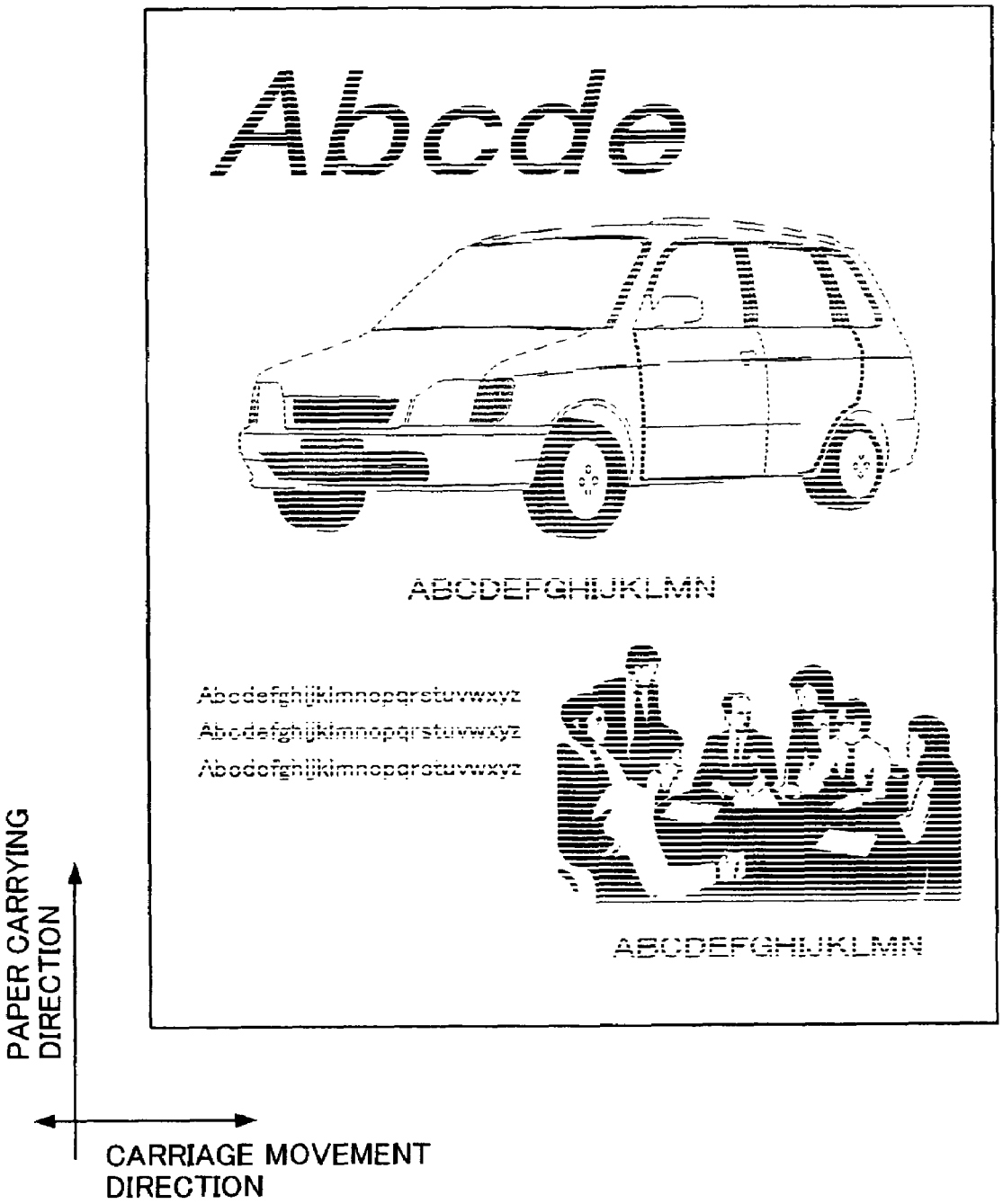
FIG. 19 is an explanatory diagram illustrating the problems of the prior art.

FIG. 19 shows an example of a printed image printed in the draft print mode of a conventional inkjet printer. The image printed in the draft print mode has large gaps between the raster lines constituting the image, so that as shown in the figure, many white stripes extending in the movement direction of the carriage 41 are formed along the carrying direction. Thus, a stripe pattern appears on the overall printed image, so that there is the problem that the printed image appears coarse and overall the colors appear thin. Accordingly, it is desirable to be able to execute the printing process in the draft print mode at a print speed that is not slower than conventionally, yet improves the appearance of the printed image.

===The Print Mode of the Present Embodiment (for the Case of Color Printing)===

<Nozzle Arrangement>

As shown in FIG. 7, in the inkjet printer 1 of the present embodiment, the nozzle groups 211Y, 211M, 211C and 211K provided on the head 21 are not all arranged at the same position in the carrying direction, but the nozzle groups 211Y, 211M, 211C and 211K are arranged at staggered positions in the carrying direction.

In the present embodiment, the cyan nozzle group 211C, the magenta nozzle group 211M, and the yellow nozzle group 211Y or the black nozzle group 211K are arranged at positions that are offset from each other in the carrying direction. The yellow nozzle group 211Y and the black nozzle group 211K are arranged at the same position with respect to the carrying direction.

Figure 20:
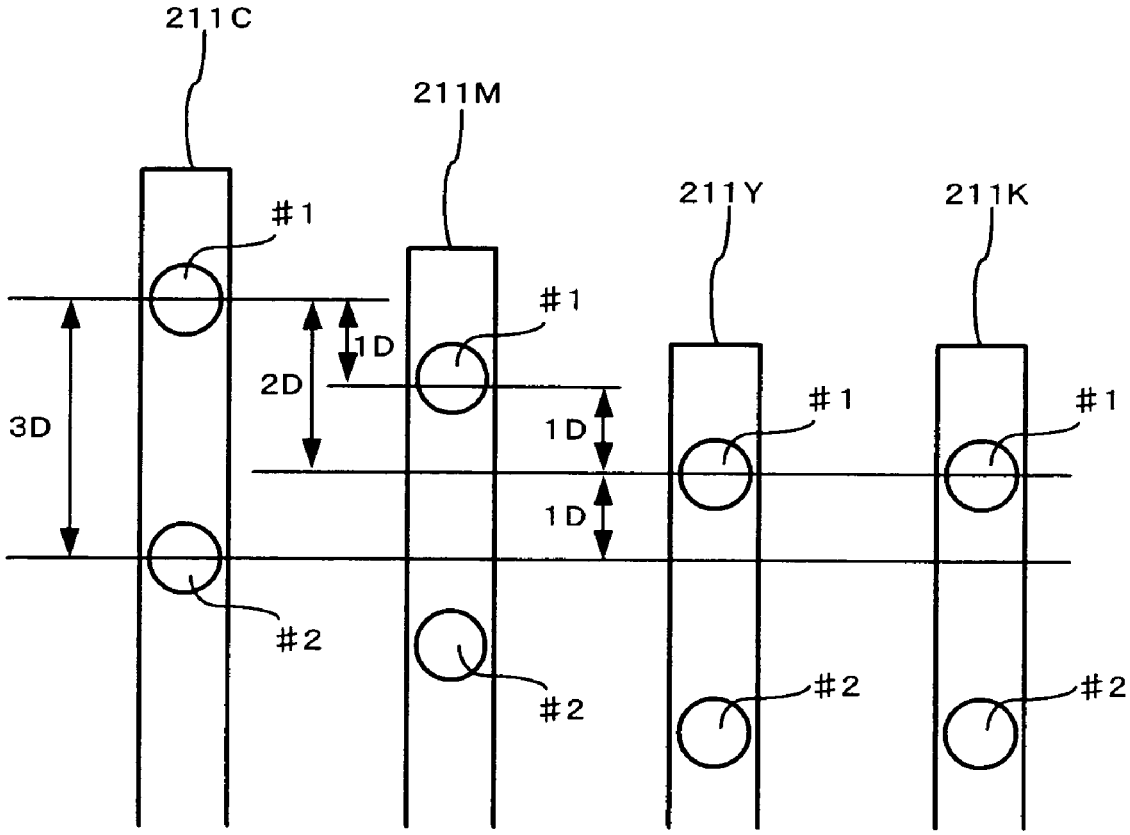
FIG. 20 is an explanatory diagram illustrating the offset width between the nozzle groups.

FIG. 20 illustrates the offset width of the respective nozzle groups 211Y, 211M, 211C and 211K. The nozzle spacing (nozzle pitch) of the nozzle groups 211Y, 211M, 211C and 211K is set to "3·D". It should be noted that here, "D" is the minimum dot pitch in the carrying direction (that is, the spacing at the highest resolution of the dots formed on the medium S). That is to say, the nozzle spacing (nozzle pitch) of the nozzle groups 211Y, 211M, 211C and 211K is set to three times the minimum dot pitch D in the carrying direction.

The cyan nozzle group 211C, the magenta nozzle group 211M and the yellow nozzle group 211Y or the black nozzle group 211K are offset from another by 1D (the dot pitch) in the carrying direction. That is to say, the offset width between the cyan nozzle group 211C and the magenta nozzle group 211M is set to 1D (dot pitch), and the offset width between the magenta nozzle group 211M and the yellow nozzle group 211Y or the black nozzle group 211K is also set to 1D (dot pitch). It should be noted that the offset width between the cyan nozzle group 211C and the yellow nozzle group 211Y or the black nozzle group 211K is 2D (dot pitches).

Thus, nozzles having the same number among the nozzles #1 to #180 of the nozzle groups 211C, 211M, 211Y and 211K are offset from one another in the carrying direction. That is to say, nozzles having the same numbers among the nozzles #1 to #180 of the cyan nozzle group 211C, the nozzles #1 to #180 of the magenta nozzle group 211M and the nozzles #1 to #180 of the yellow nozzle group 211Y or the black nozzle group 211K are arranged at an offset from one another in the carrying direction. It should be noted that nozzles having the same numbers among the nozzles #1 to #180 of the yellow nozzle group 211Y and the nozzles #1 to #180 of the black nozzle group 211K are arranged at the same positions with respect to the carrying direction.

The offset width between the nozzles having the same number of the nozzles #1 to #180 of the cyan nozzle group 211C and the nozzles #1 to #180 of the magenta nozzle group 211M is set to 1D (dot pitch). The offset width between the nozzles having the same number of the nozzles #1 to #180 of the magenta nozzle group 211M and the nozzles #1 to #180 of the yellow nozzle group 211Y or the black nozzle group 211K is also set to 1D (dot pitch). The offset width between the nozzles having the same number of the nozzles #1 to #180 of the cyan nozzle group 211C and the nozzles #1 to #180 of the yellow nozzle group 211Y or the black nozzle group 211K is 2D (dot pitches).

Two nozzles having the same number among the nozzles #1 to #180 of these nozzles groups 211Y, 211M, 211C and 211K and arranged at positions that are offset from one another in the carrying direction correspond to a first dot formation section and a second dot formation section in accordance with the present invention. That is to say, the nozzle #1 belonging to either the cyan nozzle group 211C or the magenta nozzle group 211M and the nozzle #1 belonging to either the yellow nozzle group 211Y or the black nozzle group 211K correspond to the first dot formation section and the second dot formation section in accordance with the present invention. Also, for example the nozzle #180 belonging to either the cyan nozzle group 211C or the magenta nozzle group 211M and the nozzle #180 belonging to either the yellow nozzle group 211Y or the black nozzle group 211K correspond to the first dot formation section and the second dot formation section in accordance with the present invention.

Furthermore, two nozzles having the same number among the nozzles #1 to #180 of these nozzles groups 211Y, 211M, 211C and 211K and arranged at the same positions in the carrying direction correspond to a third dot formation section (other dot formation section) in accordance with the present invention, and a first dot formation section or second dot formation section in accordance with the present invention that are arranged at the same position in a predetermined direction as this third dot formation section. That is to say, for example the nozzle #1 of the yellow nozzle group 211Y and the nozzle #1 of the black nozzle group 211K correspond to the third dot formation section (other dot formation section) and the first dot formation section or second dot formation section in accordance with the present invention. Moreover, for example the nozzle #2 of the yellow nozzle group 211Y and the nozzle #2 of the black nozzle group 211K correspond to the third dot formation section (other dot formation section) and the first dot formation section or second dot formation section in accordance with the present invention.

Furthermore, three nozzles having the same number among the nozzles #1 to #180 of these nozzles groups 211Y, 211M, 211C and 211K and arranged at positions that are offset from one another in the carrying direction correspond to a first dot formation section, a second dot formation section and a fourth dot formation section in accordance with the present invention. That is to say, for example the nozzle #1 of the cyan nozzle group 211C, the nozzle #1 of the magenta nozzle group 211M, and the nozzle #1 of the yellow nozzle group 211Y and the black nozzle group 211K correspond to the first dot formation section, the second dot formation section and the fourth dot formation section in accordance with the present invention. Moreover, for example the nozzle #180 of the cyan nozzle group 211C, the nozzle #180 of the magenta nozzle group 211M, and the nozzle #180 of the yellow nozzle group 211Y and the black nozzle group 211K correspond to the first dot formation section, the second dot formation section and the fourth dot formation section in accordance with the present invention.

Furthermore, of two nozzles with different nozzle numbers but ejecting ink of the same color, among the nozzles #1 to #180 of the nozzle groups 211Y, 211M, 211C and 211K, one of the two nozzles corresponds to the first dot formation section or the second dot formation section in accordance with the present invention, and the other nozzle corresponds to the fifth dot formation section in accordance with the present invention. For example, in the case of the nozzle #1 and the nozzle #2 of the cyan nozzle group 211C, one of these nozzles #1 and #2 corresponds to the first dot formation section or the section dot formation section of the present invention, whereas the other corresponds to the fifth dot formation section of the present invention. Also, for example, in the case of the nozzle #1 and the nozzle #180 of the magenta nozzle group 211M, one of these nozzles #1 and #180 corresponds to the first dot formation section or the second dot formation section of the present invention, whereas the other corresponds to the fifth dot formation section of the present invention.

<Printing Method>

The following is a description of the case that an image is printed in the draft print mode by the head 21 having nozzle groups 211Y, 211M, 211C and 211K with this arrangement.

Figure 21:
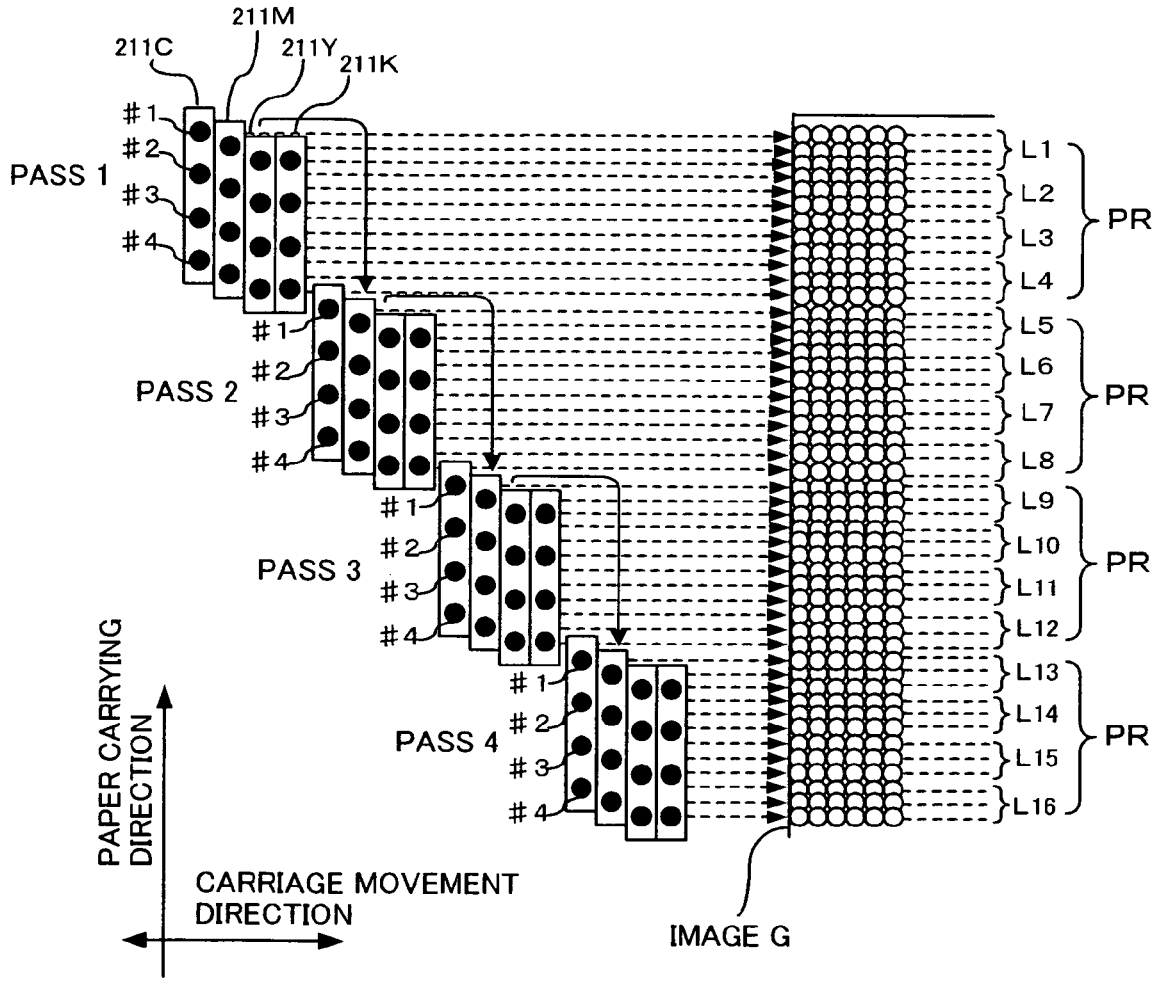
FIG. 21 is an explanatory diagram illustrating a printing method for draft printing in accordance with an embodiment of the present invention.

FIG. 21 illustrates the way an image is formed when printing the image in the draft printing mode with the head 21 of the present embodiment. It should be noted that here, a simple example is explained in which the nozzle groups 211Y, 211M, 211C and 211K have four nozzles #1 to #4 each. Moreover, the nozzles ejecting ink are shown as black circles.

The nozzle groups 211Y, 211M, 211C and 211K are not all arranged at the same position in the carrying direction, but are arranged at positions that are offset from one another, so that when the head 21 is moved once in the carriage movement direction, the nozzles #1 to #4 of the nozzle groups 211Y, 211M, 211C and 211K can eject ink along different lines, as shown in the figure.

That is to say, here, the nozzles #1 to #4 of the cyan nozzle group 211C, the nozzles #1 to #4 of the magenta nozzle group 211M, and the nozzles #1 to #4 of the yellow nozzle group 211Y or the black nozzle group 211K are arranged at positions that are offset from one another in the carrying direction, so that the ink ejected from the nozzles #1 to #4 of the cyan nozzle group 211C, the ink ejected from the nozzles #1 to #4 of the magenta nozzle group 211M, and the ink ejected from the nozzles #1 to #4 of the yellow nozzle group 211Y or the black nozzle group 211K can be ejected along different lines.

Thus, the nozzles #1 to #4 of the nozzle groups 211Y, 211M, 211C and 211K can form dot rows that extend along different lines. That is to say, the dot rows formed by the ink ejected from the nozzles #1 to #4 of the cyan nozzle group 211C, the dot rows formed by the ink ejected from the nozzles #1 to #4 of the magenta nozzle group 211M and the dot rows formed by the ink ejected from the nozzles #1 to #4 of the yellow nozzle group 211Y or the black nozzle group 211K can be formed extending along different lines.

Figure 22:
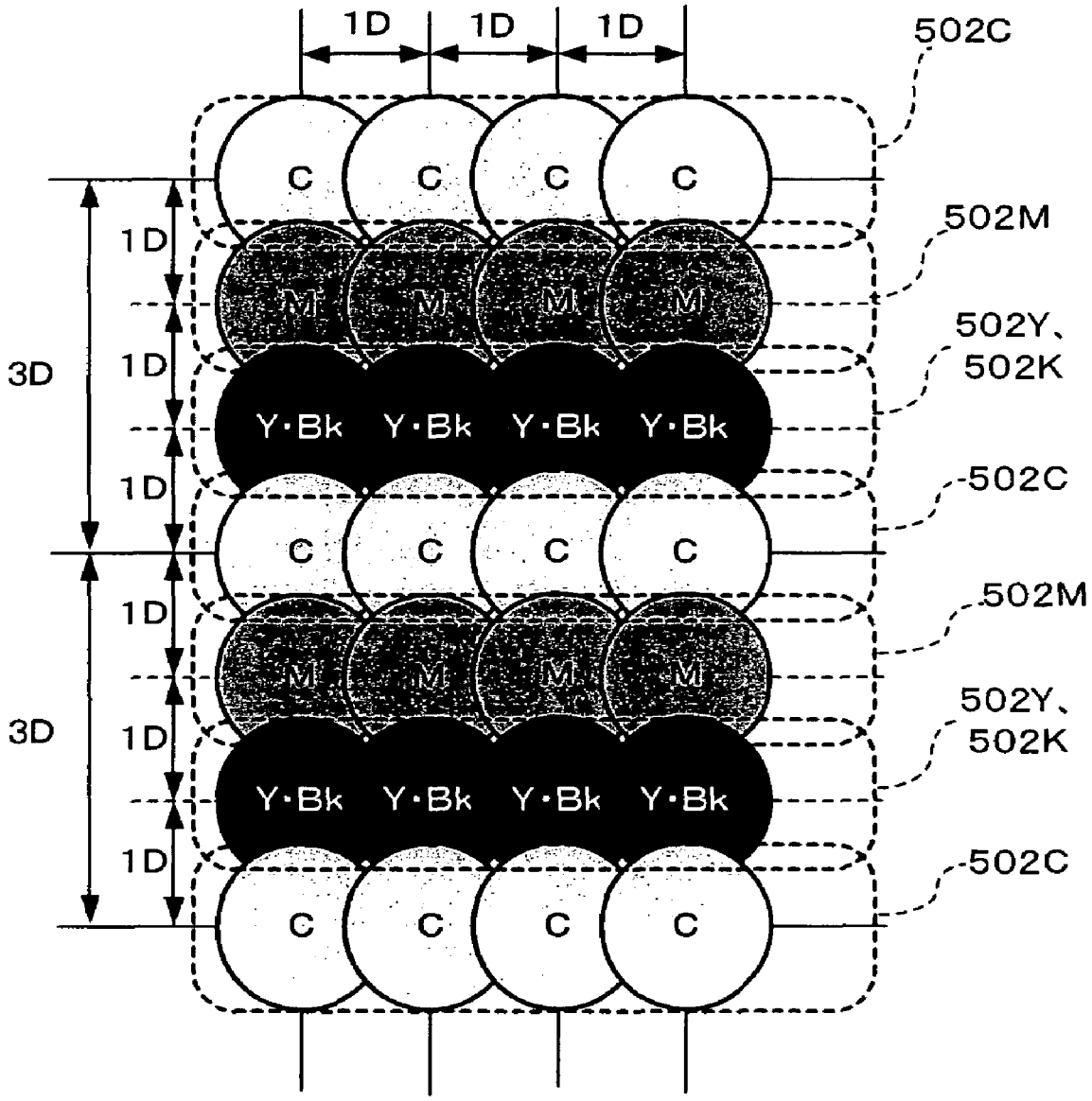
FIG. 22 is an explanatory diagram illustrating an image printed by draft printing in accordance with an embodiment of the present invention.

FIG. 22 shows an enlarged and detailed view of the configuration of the printed image. As shown in this figure, the cyan nozzle group 211C and the magenta nozzle group 211M are offset by 1D (dot pitch) from one another, so that the cyan dot rows 502C formed by the ink ejected from the nozzles #1 to #4 of the cyan nozzle group 211C are formed at respective offsets of 1D (dot pitch) to the magenta dot rows 502M formed by the ink ejected from the nozzles #1 to #4 of the magenta nozzle group 211M. Moreover, the magenta nozzle group 211M is offset by 1D (dot pitch) from the yellow nozzle group 211Y and the black nozzle group 211K, so that the magenta dot rows 502M formed by the ink ejected from the nozzles #1 to #4 of the magenta nozzle group 211M are formed at respective offsets of 1D (dot pitch) to the yellow dot rows 502Y and the black dot rows 502K formed by the ink ejected from the nozzles #1 to #4 of the yellow nozzle group 211Y and the black nozzle group 211K. It should be noted that the cyan dot rows 502C are formed at an offset of 2D (dot pitches) with respect to the yellow dot rows 502Y and the black dot rows 502K.

Accordingly, the dot rows 502C, 502M, 502Y and 502K formed by the ink ejected from the nozzles #1 to #4 of the nozzle groups 211Y, 211M, 211C and 211K are respectively formed at offsets of 1D (dot pitch), as shown in FIG. 22. Thus, the four raster lines L1 to L4 are formed.

When one pass has been terminated and the next pass is executed, then the cyan nozzle group 211C, the magenta nozzle group 211M and the yellow nozzle group 211Y or the black nozzle group 211K are arranged at positions that are offset by 1D (dot pitch) from one another in the carrying direction, as shown in FIG. 21, so that the dot rows 502C formed by the ink ejected from the nozzles #1 to #4 of the cyan nozzle group 211C, the dot rows 502M formed by the ink ejected from the nozzles #1 to #4 of the magenta nozzle group 211M, and the dot rows 502Y and 502K formed by the ink ejected from the nozzles #1 to #4 of the yellow nozzle group 211Y and the black nozzle group 211K are formed at positions that are respectively offset by 1D (dot pitch) from one another. Thus, the four raster lines L5 to L8 are formed.

By repeatedly executing such a pass, the dot rows 502C, 502M, 502Y and 502K formed by ink ejected respectively from the nozzles #1 to #4 of the nozzle groups 211Y, 211M, 211C and 211K are also formed at positions that are respectively offset by 1D (dot pitch) from one another. Thus, a further eight raster lines L9 to L16 can be formed.

Thus, also in the draft print mode, it is possible to form dot rows at different positions by ink that is ejected from the nozzles #1 to #180 of the nozzle groups 211Y, 211M, 211C and 211K, so that it can be prevented, as much as possible, that gaps appear as blank portions between the formed dot rows. Thus, it can be prevented that the printed image is coarse or overall thin, so that the appearance of the printed image can be improved.

<Configuration of the Printed Image>

The following is a description of the configuration of the image printed in this manner. One pixel constituting the printed image is constituted by a cyan (C) dot formed by ink ejected from the nozzles #1 to #180 of the cyan nozzle group 211C, a magenta (M) dot formed by ink ejected from the nozzles #1 to #180 of the magenta nozzle group 211M, a yellow (Y) dot formed by ink ejected from the nozzles #1 to #180 of the yellow nozzle group 211Y and a black (K) dot formed by ink ejected from the nozzles #1 to #180 of the black nozzle group 211K.

If an image is printed in the draft print mode with the inkjet printer 1 according to the present embodiment, then the cyan (C) dots, the magenta (M) dots, the yellow (Y) dots and the black (K) dots are respectively formed at positions that are offset from another by 1D (dot pitch) in the carrying direction. Therefore, the image printed in this draft print mode is printed by forming a single pixel with dots of four different colors formed at positions that are respectively offset by 1D (dot pitch) from one another.

Figure 23:
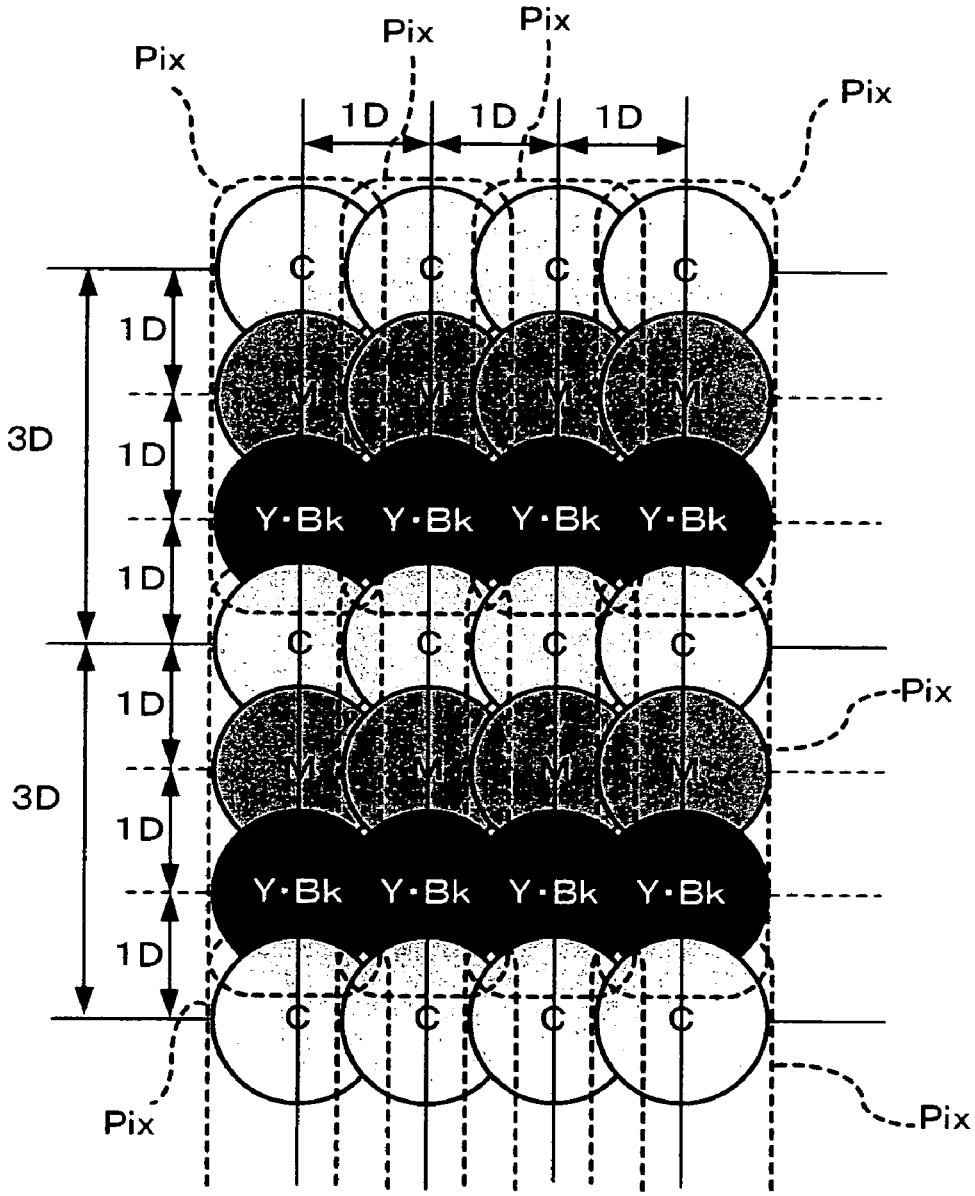
FIG. 23 is an explanatory diagram illustrating the configuration of a printed image.

FIG. 23 illustrates the configuration of the printed image in more detail. Here, a cyan (C) dot, a magenta (M) dot, and a yellow (Y) dot, or a black (K) dot, are formed at positions that are respectively offset from one another by 1D (dot pitch) in the carrying direction, so that the image is printed by forming a single pixel Pix with these four types of dots having different colors.

<Processing in the Printer Driver>

When the draft print mode is set as the print mode, the printer driver 1110 lets the resolution conversion processing section 1112 convert the image data (text data, image data etc.) output from the application program 1104 into a resolution corresponding to the draft print mode. Then, the printer driver 1110 converts the image data (RGB image data) generated by this conversion into CMYK data with the color conversion processing section 1114, and subjects the image data obtained by this color conversion process (CMYK image data) to a halftone process with the halftone processing section 1116, whereafter it executes a rasterization process in which the data obtained by this halftone process is changed by the rasterization processing section 1118 into the data order to be transferred to the inkjet printer 1.

Here, if the print mode is set to the draft print mode, the printer driver 1110 rasterizes the data obtained in the halftone process such that those of the nozzles #1 to #180 of the nozzle groups 211C, 211M, 211Y and 211K of the inkjet printer 1 that have the same number eject ink to form the same pixel. That is to say, the rasterization process for generating the data to be transferred to the inkjet printer 1 is executed in such a manner that the nozzle #1 of the cyan nozzle group 211C, the nozzle #1 of the magenta nozzle group 211M, the nozzle #1 of the yellow nozzle group 211Y and the nozzle #1 of the black nozzle group 211K all eject ink to form the same pixel. Moreover, the rasterization process for generating the data to be transferred to the inkjet printer 1 is executed in such a manner that the nozzle #2 of the cyan nozzle group 211C, the nozzle #2 of the magenta nozzle group 211M, the nozzle #2 of the yellow nozzle group 211Y and the nozzle #2 of the black nozzle group 211K all eject ink to form the same pixel.

Thus, as shown in FIG. 23, a pixel can be configured and printed with four different types of ink ejected from the nozzles #1 to #180 of the nozzle groups 211C, 211M, 211Y and 211K.

<Summary>

With the inkjet printer 1 as described above, the nozzles #1 to #180 of the cyan nozzle group 211C, the nozzles #1 to #180 of the magenta nozzle group 211M, the nozzles #1 to #180 of the yellow nozzle group 211Y and the nozzles #1 to #180 of the black nozzle group 211K are respectively arranged at positions that are offset by 1D (dot pitch) in the carrying direction, so that in the draft print mode, dot rows can be formed at positions that are offset from one another in the carrying direction, with ink ejected from the nozzles #1 to #180 of the nozzle groups 211C, 211M, 211Y and 211K. Thus, in the draft print mode, it is possible to prevent, to the extent possible, gaps from occurring and appearing as blank space between the dot rows formed by ink that is ejected from the nozzles #1 to #180 of the nozzle groups 211C, 211M, 211Y and 211K. Thus, it can be prevented that the printed image appears coarse or overall thin. Therefore, the appearance of the printed image can be improved.

===About the Arrangement of the Nozzle Groups (for the Case of Color Printing)===

<1>

In the present embodiment, as shown in FIGS. 7 and 19, the yellow nozzle group 211Y and the black nozzle group 211K are arranged at the same position in the carrying direction, whereas the other nozzle groups, that is, the cyan nozzle group 211C and the magenta nozzle group 211M are arranged at positions that are offset from the yellow nozzle group 211Y and the black nozzle group 211K in the carrying direction. This arrangement is done for the following reasons.

The darkness of the ink ejected from the nozzles #1 to #180 of the yellow nozzle group 211Y is lower than that of the magenta or the cyan ink, so that even if it were ejected at a position that is offset from the black ink ejected by the nozzles #1 to #180 of the black nozzle group 211K, it would be hardly possible to print an image with a dark color. By contrast, the darkness of the color of the ink ejected from the nozzles #1 to #180 of the cyan nozzle group 211C and the magenta nozzle group 211M is darker than that of yellow (Y), so that by arranging them at positions that are offset from the black nozzle group 211K in the carrying direction, the overall printed image can be made to appear darker.

Furthermore, if the yellow nozzle group 211Y and the black nozzle group 211K are arranged at the same position in the carrying direction, then the dot rows formed by ink ejected from the nozzles #1 to #180 of the nozzle groups 211Y and 211K are formed on the same lines. Therefore, when bidirectional printing is performed, portions in which dot rows of yellow (Y) ink are formed on dot rows of black (K) ink are formed alternating with portions in which dot rows of black (K) ink are formed on dot rows of yellow (Y) ink, so that there can be irregularities through inversion. Accordingly, in order to cancel such inversion irregularities, it is also possible not to eject ink from the nozzles #1 to #180 of the yellow nozzle group 211Y when performing draft printing. That is to say, in the draft print mode, an image is printed using only the three nozzle groups 211C, 211M and 211Y of the cyan nozzle group 211C, the magenta nozzle group 211M and the black nozzle group 211K.

<2>

In the above-described embodiment, the cyan nozzle group 211C, the magenta nozzle group 211M and the yellow nozzle group 211Y or black nozzle group 211K are arranged at positions that are respectively offset by 1D (dot pitch) in the carrying direction, and the black nozzle group 211K is arranged at one end. The black nozzle group 211K is arranged at one end for the following reasons. By arranging the black nozzle group 211K at one end, the dots formed by the ink of the other colors, such as cyan (C) or magenta (M), project from the black (K) dots, so that the color hue can be easily adjusted. By making the color hue easily adjustable, it is possible to realize a colorful expression even in the draft print mode.

===Examples of Other Nozzle Arrangements (for the Case of Color Printing)===

<1>

Figure 24:
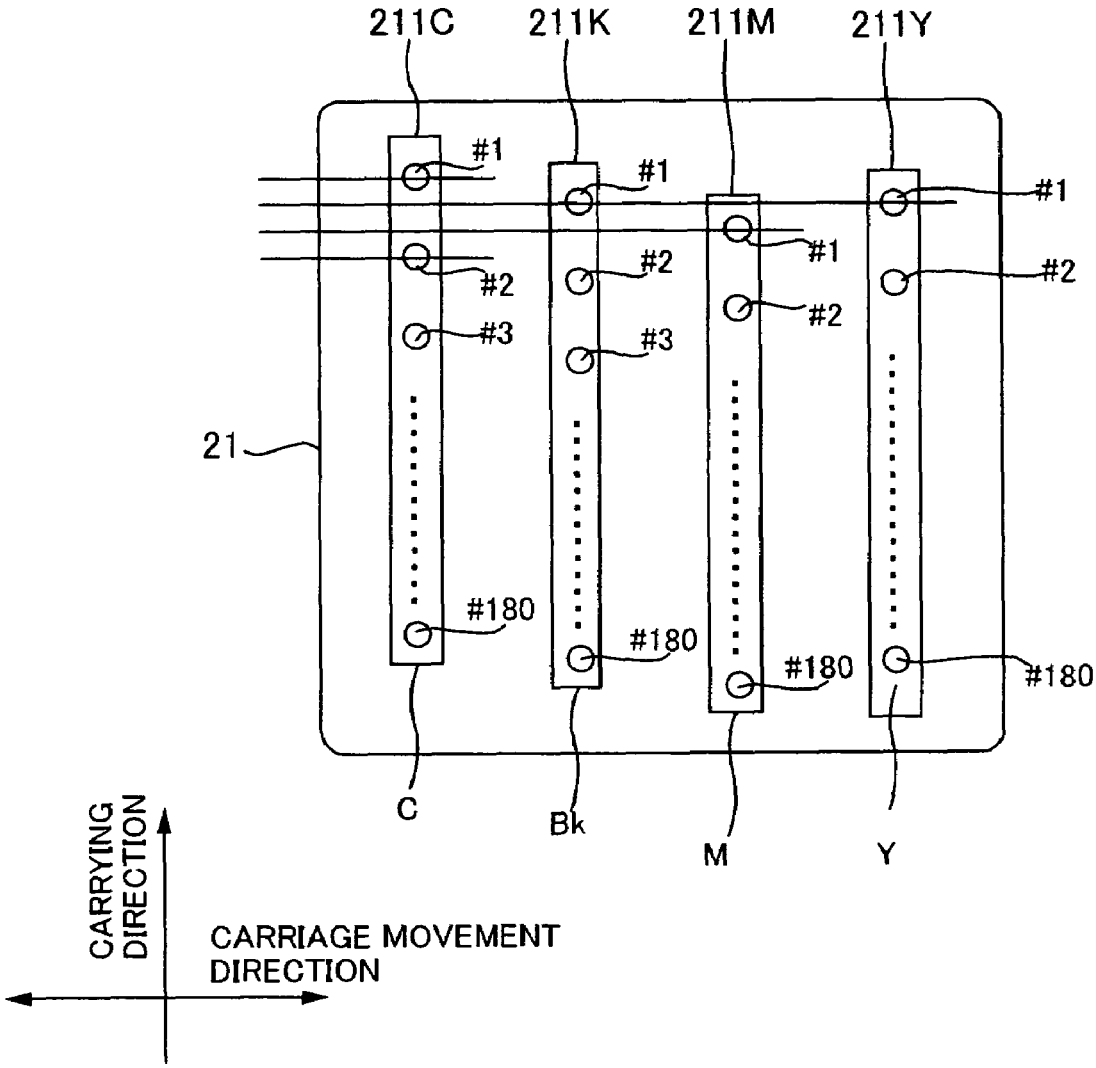
FIG. 24 is an explanatory diagram illustrating an arrangement example of another nozzle group.

In the above-described embodiment, the nozzles #1 to #180 of the black nozzle group 211K are arranged on one end of the nozzles #1 to #180 of all nozzle groups 211C, 211M, 211Y and 211K, but there is no limitation to this arrangement, and it is also possible that the black nozzle group 211K is arranged in the middle with respect to the carrying direction of the nozzles #1 to #180 of all nozzle groups 211C, 211M, 211Y and 211K. FIG. 24 shows an example in which the nozzles #1 to #180 of the black nozzle group 211K are arranged in the middle, with respect to the carrying direction, of the nozzles #1 to #182 of all nozzle groups 211C, 211M, 211Y and 211K. Thus, if the nozzles #1 to #180 of the black nozzle group 211K are arranged in the middle, with respect to the carrying direction, among the nozzles #1 to #180 of all nozzle groups 211C, 211M, 211Y and 211K, then the dots formed by the black (K) ink are formed sandwiched between dots formed by other colored inks, that is, cyan (C) and magenta (M) inks in this case. Thus, black can be expressed darker.

Figure 25:
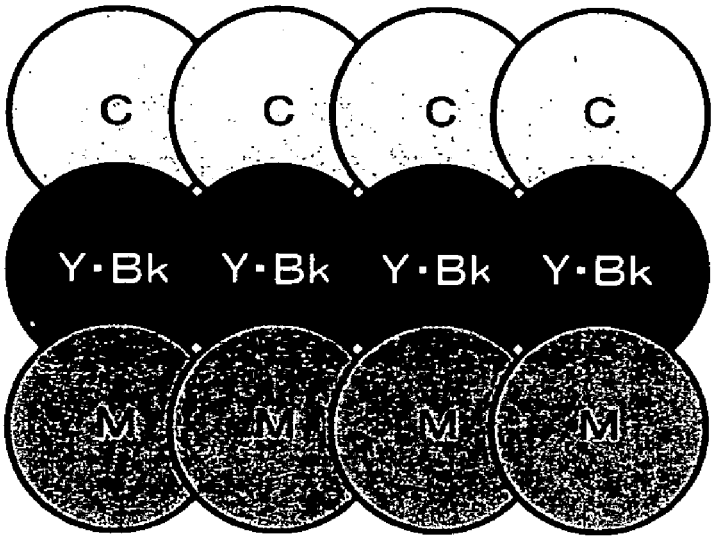
FIG. 25 is an explanatory diagram illustrating how dots are formed by the nozzle groups shown in FIG. 24.

FIG. 25 shows how dots are formed in the draft print mode in the case that the nozzles #1 to #180 of the black nozzle group 211K are arranged in the middle, with respect to the carrying direction, of the nozzles #1 to #180 of all nozzle groups 211C, 211M, 211Y and 211K. As shown in this figure, the black (K) dots are formed sandwiched between cyan (C) dots and magenta (M) dots. Therefore, the black (K) dots are more conspicuous than the dots of the other colors so that black (K) can be made to appear darker.

It should be noted that here the yellow nozzle group 211Y and the black nozzle group 211K are arranged at the same position in the carrying direction. Needless to say, it is not necessarily required to arrange the yellow nozzle group 211Y at the same position in the carrying direction as the black nozzle group 211K. That is to say, it is also possible to arrange the yellow nozzle group 211Y at the same position in the carrying direction as the cyan nozzle group 211C or the magenta nozzle group 211M.

<2>

In the above-described embodiment, the nozzle spacing (nozzle pitch) of the nozzle groups 211C, 211M, 211Y and 211K is set to "3·D", so that one of all the nozzle groups 211C, 211M, 211Y and 211K is arranged at the same position in the carrying direction as one of the other nozzle groups, but there is no limitation to this if the nozzle spacing (nozzle pitch) of the nozzle groups 211C, 211M, 211Y and 211K is set to a value other than "3·D".

Figure 26:
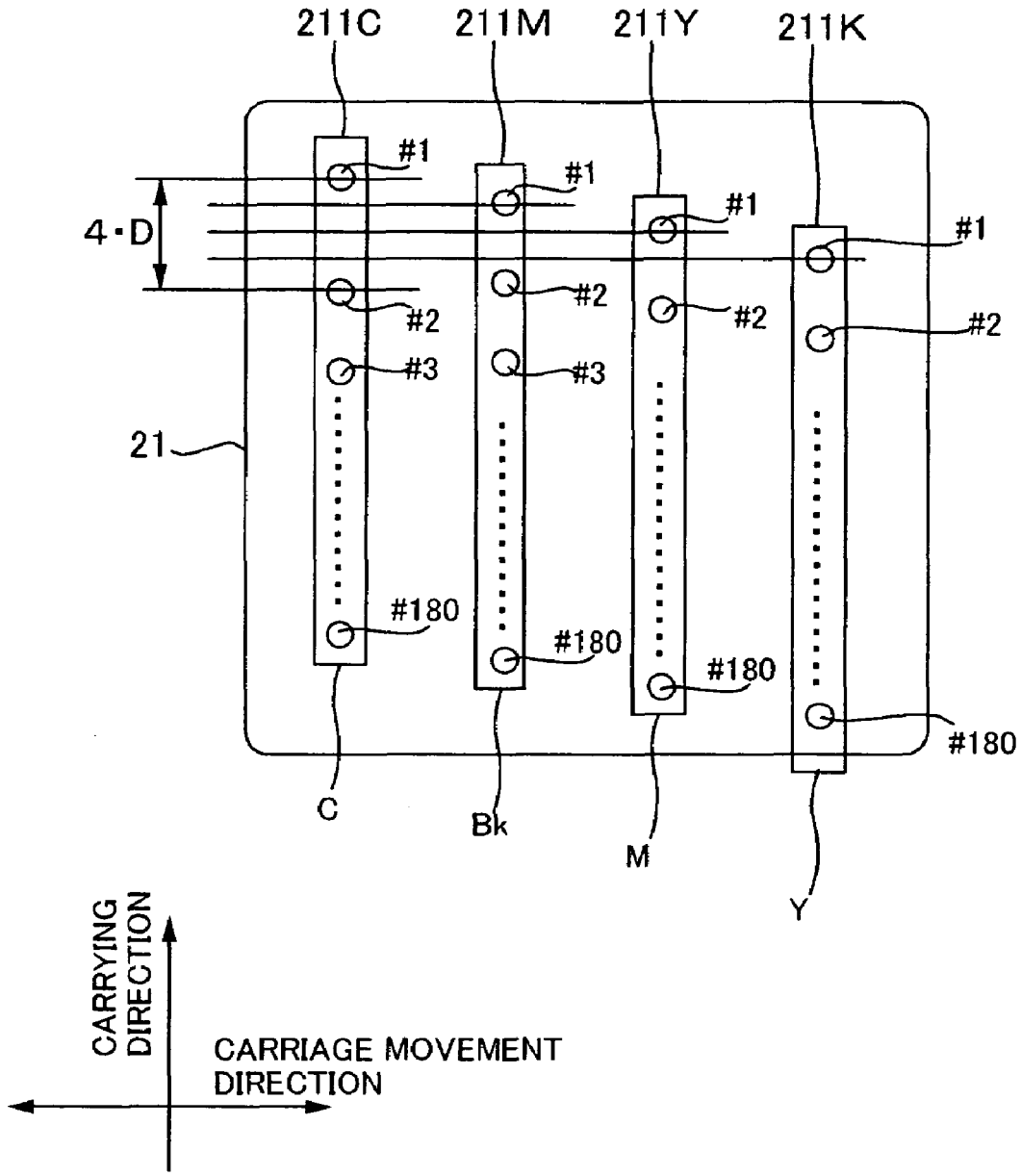
FIG. 26 is an explanatory diagram illustrating another nozzle group arrangement example.

FIG. 26 shows an example of the arrangement of the nozzle groups 211C, 211M, 211Y and 211K for the case that the nozzle spacing (nozzle pitch) of the nozzle groups 211C, 211M, 211Y and 211K is set to "4·D". The cyan nozzle group 211C, the magenta nozzle group 211M, the yellow nozzle group 211Y and the black nozzle group 211K are arranged at positions that are offset from another by 1D (the dot pitch) in the carrying direction. If the nozzle spacing (nozzle pitch) of the nozzle groups 211C, 211M, 211Y and 211K is set to "4·D" in this manner, then the nozzle groups 211C, 211M, 211Y and 211K can all be arranged at positions that are respectively offset from another by 1D (dot pitch) in the carrying direction. Also in the draft print mode with this arrangement, it can be prevented that there is a gap between the dot rows, so that it can be prevented that the printed image appears coarse or becomes thin overall. Therefore, the appearance of the printed image can be improved.

It should be noted that if the nozzle spacing (nozzle pitch) of the nozzle groups 211C, 211M, 211Y and 211K is set to "4·D", then the order of the nozzle groups 211C, 211M, 211Y and 211K does not necessarily have to be in this order, and the order of the cyan nozzle group 211C, the magenta nozzle group 211M, the yellow nozzle group 211Y and the black nozzle group 211K can be changed. Also, if the nozzle spacing (nozzle pitch) of the nozzle groups 211C, 211M, 211Y and 211K is set to "4·D", then the nozzle groups 211C, 211M, 211Y and 211K do not necessarily have to be arranged at positions that are respectively offset from another by 1D (dot pitch) in the carrying direction. That is to say, it is also possible for two of the nozzle rows to be arranged at the same positions in the carrying direction, as in the above-described embodiment.

Moreover, the "k" of the "k·D" in the nozzle spacing (nozzle pitch) of the nozzle groups 211C, 211M, 211Y and 211K can also be set to 2 or to 5 or greater.

Furthermore, in addition to the cyan nozzle group 211C, the magenta nozzle group 211M, the yellow nozzle group 211Y and the black nozzle group 211K, it is also possible to provide nozzle groups ejecting other colors of ink, such as a nozzle group ejecting light cyan ink, a nozzle group ejecting light magenta ink, a nozzle group ejecting dark yellow ink or a nozzle group ejecting violet ink. Also these nozzle groups can be arranged at positions that are offset in the carrying direction from other nozzle groups, or at positions that are the same in the carrying direction as that of other nozzle groups.

Furthermore, it is not necessarily required to provide all of the cyan nozzle group 211C, magenta nozzle group 211M, yellow nozzle group 211Y and the black nozzle group 211K.

===Conventional Problems (for the Case of Monochrome Printing)===

The following problems occur when monochrome printing is executed in the draft print mode. When monochrome printing is executed in the conventional draft print mode, then the image G is printed by ejecting black (K) ink from the nozzles #1 to #180 of the black nozzle group 211K onto the medium S, using only the black nozzle group 211K, as when executing monochrome printing in the regular print mode. Since the ink is ejected only with the nozzles #1 to #180 of the black nozzle group 211K, there are large gaps between the raster lines formed on the medium S. These gaps are formed as "blank spaces" in the printed image G, so that there is the problem that the printed image G becomes coarse or appears to be thin overall.

In a printed image that was formed by monochrome printing with a conventional inkjet printer in the draft print mode, like in the case of color printing, there are large gaps between the raster lines constituting the image, as shown in FIG. 19. Therefore, as shown in the figure, a large number of white stripes extending in the movement direction of the carriage 41 appear along the carrying direction. Thus, a stripe pattern appears on the overall printed image, so that there is the problem that the printed image appears coarse and overall the colors appear thin. Accordingly, it is desirable to be able to execute the printing process in the draft print mode at a print speed that is not slower than conventionally, yet improves the appearance of the printed image.

===The Printing Method of the Present Embodiment (for the Case of Monochrome Printing)===

In order to overcome this problem with the inkjet printer 1 of the present embodiment, when executing monochrome printing in the draft print mode, the image is formed by ejecting ink not only from the black nozzle group 211K as conventionally, but is printed by ejecting various inks from the nozzles #1 to #180 of the cyan nozzle group 211C, the magenta nozzle group 211M, and the yellow nozzle group 211Y, in addition to the black nozzle group 211K. This process is explained in detail in the following.

It should be noted that in the case of monochrome printing, the nozzle groups 211Y, 211M, 211C and 211K provided on the head 21 can be arranged at positions that are offset from one another in the carrying direction, as in the case of the above-described color printing, or they can be provided at the same positions in the carrying direction as conventionally, as shown in FIG. 17.

<Color Conversion Table>

In the present embodiment, in order to execute monochrome printing by ejecting the various inks from the nozzles #1 to #180 of the cyan nozzle group 211C, the magenta nozzle group 211M and the yellow nozzle group 211Y in addition to the black nozzle group 211K, the printer driver 1110 is provided with a separate, new color conversion table, in addition to the conventional color conversion table used when executing the color conversion process.

Figure 27:
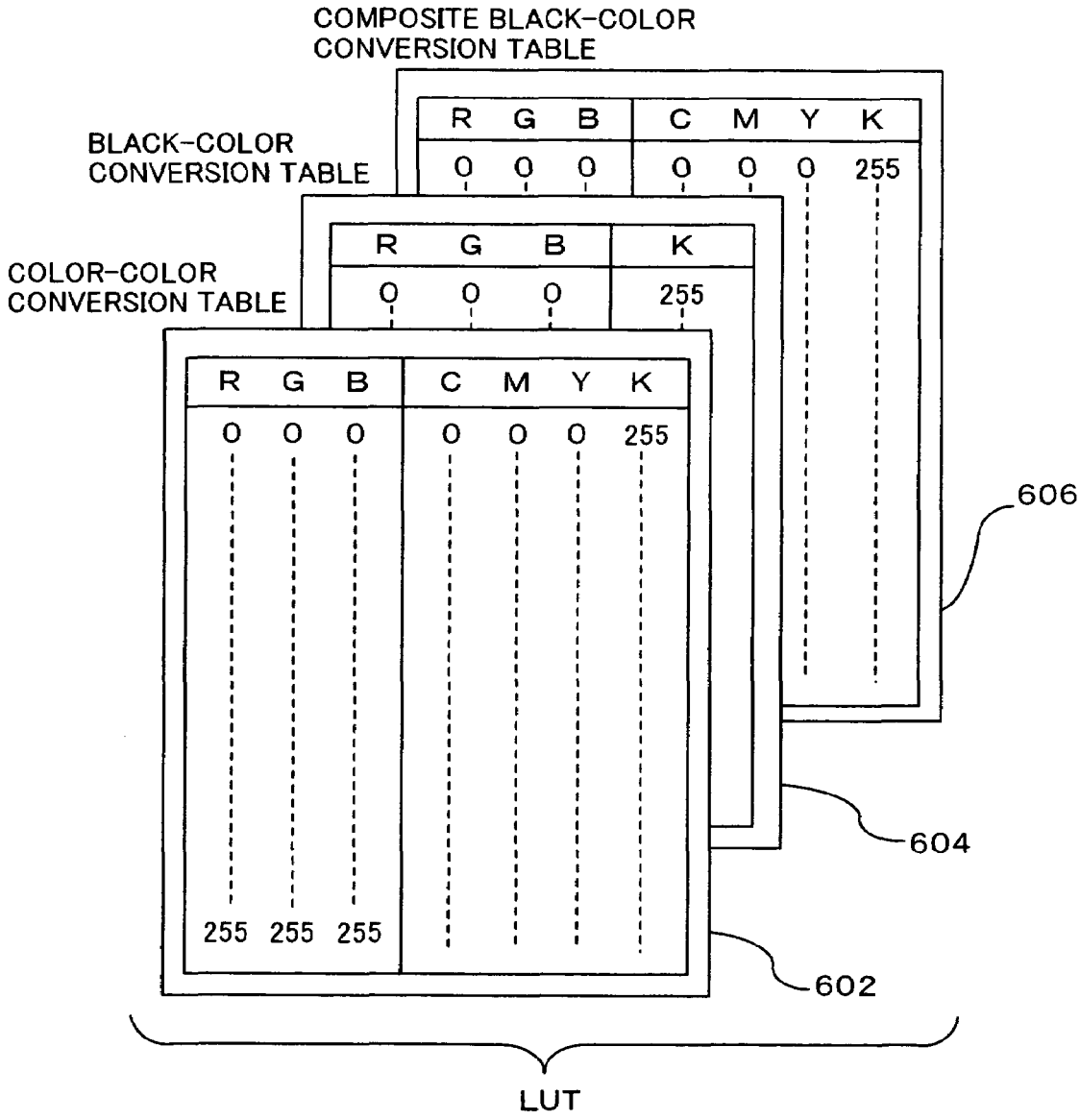
FIG. 27 is an explanatory diagram illustrating the color conversion table of the printer driver.

FIG. 27 illustrates an example of a color conversion table of the printer driver 1110 of the present embodiment. Here, the printer driver 1110 includes three types of color conversion tables, namely a color-color conversion table 602, a black-color conversion table 604 and a composite black-color conversion table 606, as the color conversion table LUT. Here, the color-color conversion table 602 and the black-color conversion table 604 are the color conversion tables with which the printer driver 1110 has been provided conventionally. On the other hand, the composite black-color conversion table 606 is a color conversion table with which the printer driver 1110 of the present embodiment is provided in order to execute the monochrome printing of the present embodiment in the draft print mode.

The color-color conversion table 602 is a color conversion table for converting the RGB image data of a predetermined resolution (for example, 120 dpi (vertically)×360 dpi (horizontally)) obtained in the resolution conversion process with the resolution conversion processing section 1112 into color CMYK data expressed in CMYK color space. As shown in the figure, this color-color conversion table 602 is configured as a list in which the RGB data to be converted is associated with the CMYK data into which it is to be converted. The RGB data is given by the values of the RGB elementary colors, that is R (red), G (green) and B (blue). Here, the values of the RGB elementary colors are displayed as 256 gradations (8 bits), that is, the values 0 to 255. Moreover, also the CMYK data is given by the values of the CMYK elementary colors, that is C (cyan), M (magenta), Y (yellow) and K (black). Like for RGB, also the values of the CMYK elementary colors are displayed as 256 gradations (8 bits), that is, the values 0 to 255.

During the color conversion, the printer driver 1110 takes the RGB data of the pixels constituting the RGB image data obtained from the resolution conversion process as the data to be converted, retrieves the corresponding CMYK data from the color-color conversion table 602, and obtains the CMYK data by taking the retrieved CMYK data as the CMYK data corresponding to that pixel. The printer driver 1110 executes this conversion process individually for the RGB data of each pixel of the RGB image data, and ultimately converts all RGB image data into CMYK image data.

Moreover, the black-color conversion table 604 is a color conversion table for converting the RGB image data obtained in the resolution conversion process into K data expressed only by black. As shown in the figure, this black-color conversion table 604 is configured as a list in which the RGB data to be converted is associated with the K data into which it is to be converted. The RGB data is given by the values of the RGB elementary colors. Similar to the case of the color-color conversion table, also the values of the RGB elementary colors are displayed as 256 gradations (8 bits), that is, the values 0 to 255. On the other hand, the K data is given by the values of the elementary color K (black). Like for RGB, also the values of the elementary color K are displayed as 256 gradations (8 bits), that is, the values 0 to 255.

During the color conversion, the printer driver 1110 takes the RGB data of the pixels constituting the RGB image data obtained from the resolution conversion process as the data to be converted, retrieves the corresponding K data from the black-color conversion table, and obtains the K data by taking the retrieved K data as the K data corresponding to that pixel. The printer driver 1110 executes this conversion process individually for the RGB data of each pixel of the RGB image data, and ultimately converts all RGB image data into K image data.

Moreover, the composite black-color conversion table 606 is a color conversion table for converting the RGB image data obtained in the resolution conversion process into monochrome CMYK data expressed in CMYK color space. That is to say, this composite black-color conversion table 606 converts the RGB image data into data (monochrome CMYK data) for outputting so-called composite black representing black (K) by combining the colors cyan (C), magenta (M) and yellow (Y). It should be noted that here, also black (K) is used in addition to cyan (C), magenta (M) and yellow (Y) to output the composite black.

As shown in the figure, this composite black-color conversion table 606 is configured as a list in which the RGB data to be converted is associated with the CMYK data into which it is to be converted. The RGB data is given by the values of the RGB elementary colors, that is R (red), G (green) and B (blue). Here, the values of the RGB elementary colors are displayed as 256 gradations (8 bits), that is, the values 0 to 255. On the other hand, the CMYK data are similarly given by the values of the CMYK elementary colors, that is C (cyan), M (magenta), Y (yellow) and K (black). Like for RGB, also the values of the CMYK elementary colors are displayed as 256 gradations (8 bits), that is, the values 0 to 255.

During the color conversion, the printer driver 1110 takes the RGB data of the pixels constituting the RGB image data obtained from the resolution conversion process as the data to be converted, retrieves the corresponding CMYK data from the color conversion table, and obtains the CMYK data by taking the retrieved CMYK data as the CMYK data corresponding to that pixel. The printer driver 1110 executes this conversion process individually for the RGB data of each pixel of the RGB image data, and ultimately converts all RGB image data into CMYK image data.

<Color Conversion Table to be Referenced>

FIG. 28 lists the color conversion tables 602, 604 and 606 that are referenced by the printer driver 1110 of the present embodiment by print mode. If the print mode is set to the regular print mode and color printing has been selected as the printing method, then the printer driver 1110 selects the color-color conversion table 602 as the color conversion table LUT to be referenced. Thus, the color conversion processing section 1114 performs the color conversion process by referencing the color-color conversion table 602. If the print mode is set to the regular print mode and monochrome printing has been selected as the printing method, then the printer driver 1110 selects the black-color conversion table 604 as the color conversion table LUT to be referenced. Thus, the color conversion processing section 1114 performs the color conversion process by referencing the black-color conversion table 604.

On the other hand, if the print mode is set to the draft print mode and color printing has been selected as the printing method, then, like in the case of the regular print mode, the printer driver 1110 selects the color-color conversion table 602 as the color conversion table LUT to be referenced. Thus, the color conversion processing section 1114 performs a color conversion process by looking up the color-color conversion table 602. If the print mode is set to the draft print mode and monochrome printing has been selected as the printing method, then the printer driver 1110 selects the composite black-color conversion table 606 as the color conversion table LUT to be referenced. Thus, the color conversion processing section 1114 performs a color conversion process by looking up the composite black-color conversion table 606.

It should be noted that the setting of the printing method of the image, that is, the settings of whether the printing method is color printing or monochrome printing is performed by selecting either "color (C)" or "black (K)" in the field U2 for ink shown in FIG. 11.

<Processing Procedure of the Printer Driver>

Figure 29:
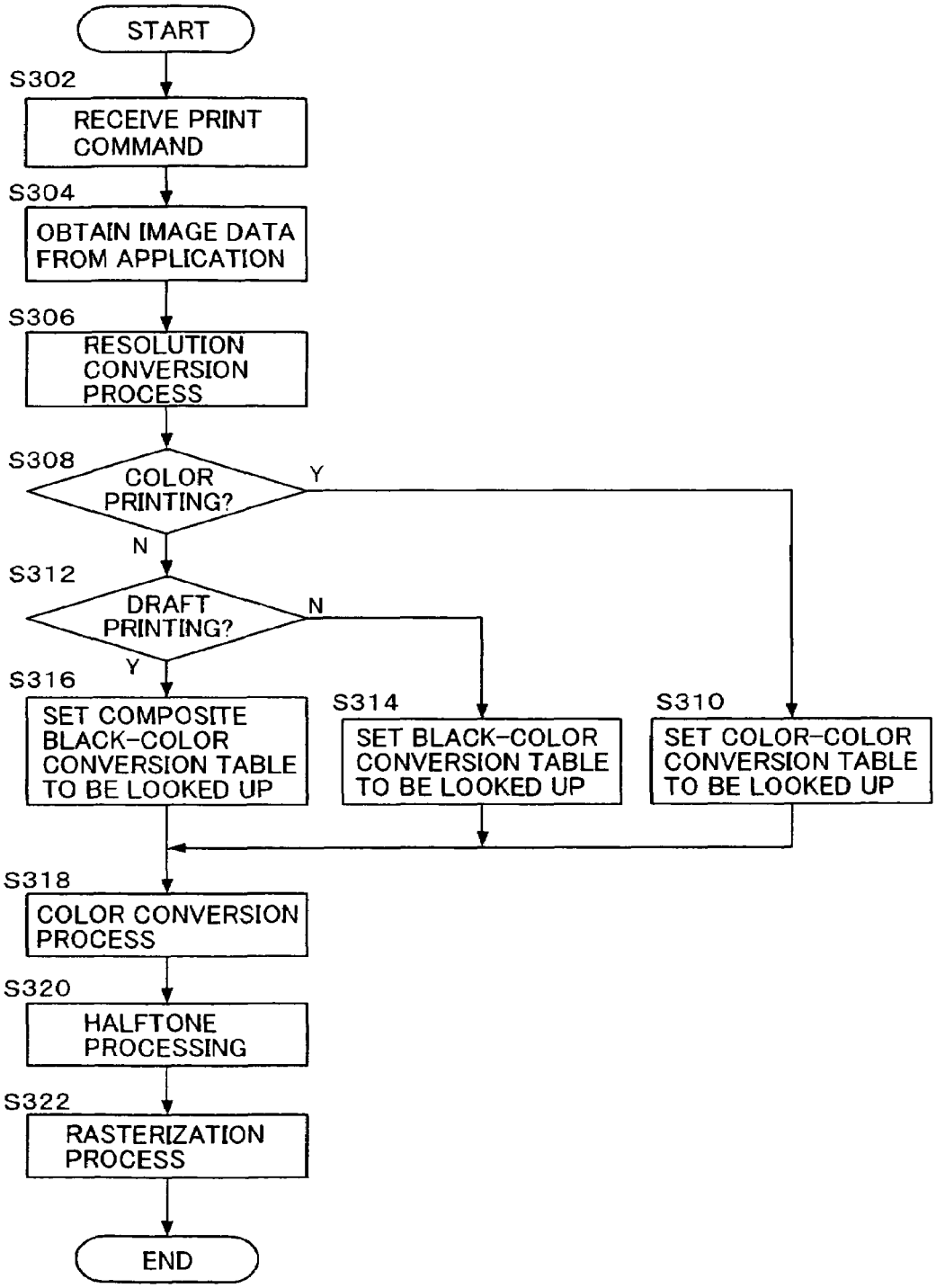
FIG. 29 is an explanatory diagram illustrating an example of the process performed by the printer driver in the draft print mode.

FIG. 29 illustrates an example of the processing procedure of the printer driver 1110.

When the printer driver 1110 obtains a print command from the user (S302), next a resolution conversion process is performed in which the image data output from the application program 1104 is converted to the resolution used when printing on the medium S (S304). Here, as illustrated in FIG. 16, a resolution conversion process corresponding to the set print mode is carried out. That is to say, if the print mode is set to the regular print mode, then the resolution conversion processing section 1112 executes a process of converting the resolution of the image data into the resolution corresponding to the regular print mode. If the print mode is set to the draft print mode, then it executes a process of converting the resolution of the image data into the resolution corresponding to this draft print mode.

After performing this resolution conversion process, the printer driver 1110 subjects the image data of a predetermined resolution obtained from the resolution conversion process (RGB image data) to a color conversion process with the color conversion processing section 1114. At this time, the printer driver 1110 first checks whether or not the printing method is color printing (S308). Here, if the printing method is color printing, the color-color conversion table 602 is set as the color conversion table LUT that the color conversion processing section 1114 looks up during the color conversion process (S310). After this, the procedure advances to Step S318, and the printer driver 1110 performs the color conversion process with the color conversion processing section 1114, taking the color-color conversion table 602 as the table to be referenced.

On the other hand, if the printing method is not color printing, then it is judged whether the printing method is monochrome printing, and next the procedure advances to Step S312, and it is checked whether or not the set print mode is the draft print mode (S312). Here, if the set print mode is not the draft print mode, it is judged that it is the regular print mode, and the black-color conversion table 604 is set as the color conversion table LUT that the color conversion processing section 1114 looks up during the color conversion (S314). After this, the procedure advances to Step S318, and the printer driver 1110 performs the color conversion process with the color conversion processing section 1114, taking the black-color conversion table 604 as the table LUT to be referenced.

On the other hand, if the set print mode is the draft print mode, then the composite black-color conversion table 606 is set as the color conversion table LUT that the color conversion processing section 1114 references during the color conversion process (S316). After this, the procedure advances to Step S318, and the printer driver 1110 performs the color conversion process with the color conversion processing section 1114, taking the composite black-color conversion table 606 as the table to be referenced (S318).

After the color conversion processing section 1114 has carried out the color conversion process by referencing the various different color conversion tables 602, 604 and 606 in this way, next the printer driver 1110 lets the halftone processing section 1116 perform a halftone process of converting the image data obtained in the color conversion process (color CMYK image data, monochrome CMYK image data or K image data) into data of a number of gradations that can be formed by the inkjet printer 1 (S320).

Then, the printer driver 1110 lets the rasterization processing section 1118 carry out a rasterization process of converting the data obtained by the halftone process into the data order to be transferred to the inkjet printer 1 (S322). Then, the printer driver 1110 outputs the above rasterized data to the inkjet printer 1.

<Actual Printing Operation>

In the present embodiment, when monochrome printing is executed in the draft print mode, the printing process is performed based on the monochrome CMYK data generated by a color conversion process with the composite black-color conversion table 606 as explained above, so that in the actual printing operation, printing is performed by ejecting ink of the four colors cyan (C), magenta (M), yellow (Y) and black (K) from the nozzles #1 to #180 of the four nozzle groups, namely the cyan nozzle group 211C, the magenta nozzle group 211M, the yellow nozzle group 211Y and the black nozzle group 211K, onto the medium S.

Figure 30:
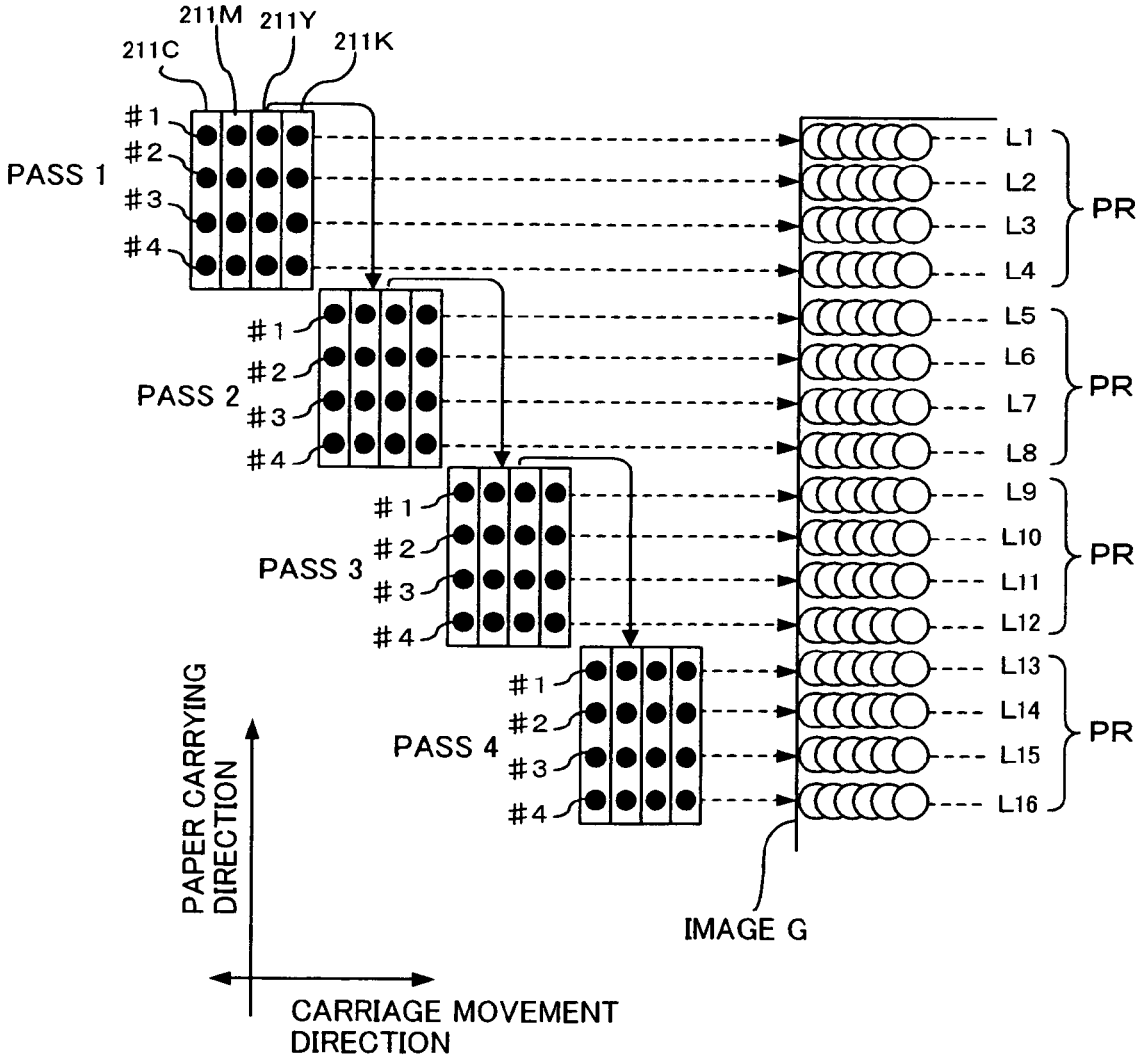
FIG. 30 is an explanatory diagram illustrating the printing state when monochrome printing is executed in the draft print mode.

FIG. 30 diagrammatically illustrates simply a printing state of how monochrome printing is executed in the draft print mode with the inkjet printer 1 of the present embodiment. It should be noted that here, a simple example is explained in which the nozzle groups 211C, 211M, 211Y and 211K have four nozzles #1 to #4 each. Moreover, the nozzles #1 to #4 ejecting ink are shown as black circles.

When the carriage 41 moves in the carriage movement direction, ink is ejected respectively from the nozzles #1 to #4 of each nozzle group, that is, the cyan nozzle group 211C, the magenta nozzle group 211M, the yellow nozzle group 211Y and the black nozzle group 211K. As shown in FIG. 30, the ink ejected from the nozzles #1 to #4 of the nozzle groups 211Y, 211M, 211C and 211K is ejected onto the same lines L1 to L4 for each of the nozzles #1 to #4. That is to say, the ink ejected from the nozzles #1 to #4 of the yellow nozzle group 211Y, the ink ejected from the nozzles #1 to #4 of the magenta nozzle group 211M, the ink ejected from the nozzles #1 to #4 of the cyan nozzle group 211C, and the ink ejected from the nozzles #1 to #4 of the black nozzle group 211K is all ejected onto the same lines L1 to L4 for each of the nozzles #1 to #4.

The ink ejected from the nozzles #1 to #4 of the nozzle groups 211Y, 211M, 211C and 211K is formed overlapping on the medium S for each of the nozzles #1 to #4, so that dot rows as shown in the figure are formed. The dots that are formed here are formed by overlapping ink that is ejected from the nozzles #1 to #4 of the yellow nozzle group 211Y, ink that is ejected from the nozzles #1 to #4 of the magenta nozzle group 211M, ink that is ejected from the nozzles #1 to #4 of the cyan nozzle group 211C and ink that is ejected from the nozzles #1 to #4 of the black nozzle group 211K, so that the dots are very large. That is to say, different to dots that are formed using only the black nozzle group 211K by only black (K) ink that is ejected from that black nozzle group 211K, as conventionally, dots are formed by overlapping ink of the various colors cyan (C), magenta (M), yellow (Y) and black (K) in type, so that the dots are very large. These large dots form dot rows that are formed lining up in the carriage movement direction and constitute the raster lines L1 to L4 of the printed image G.

Thus, the raster lines L1 to L4 of the printed image G are formed with large dots by overlapping ink of the various colors cyan (C), magenta (M), yellow (Y) and black (K), so that the gaps between the raster lines L1 to L4 can be made small. Therefore, it is possible to prevent, to the extent possible, that there are "blank portions" in the printed image G. Thus, the occurrence of such problems as that the printed image G becomes coarse or that the color appears thin overall can be prevented.

Figure 31A:
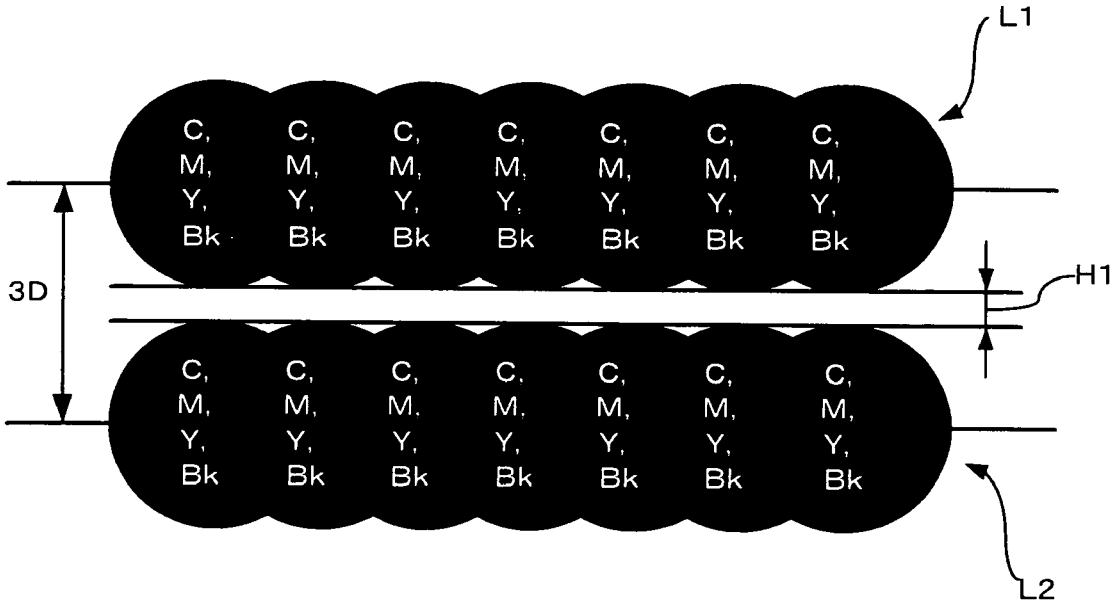
FIG. 31A is an explanatory diagram illustrating the configuration of a printed image when monochrome printing is executed in the draft print mode of an embodiment of the present invention.
Figure 31B:
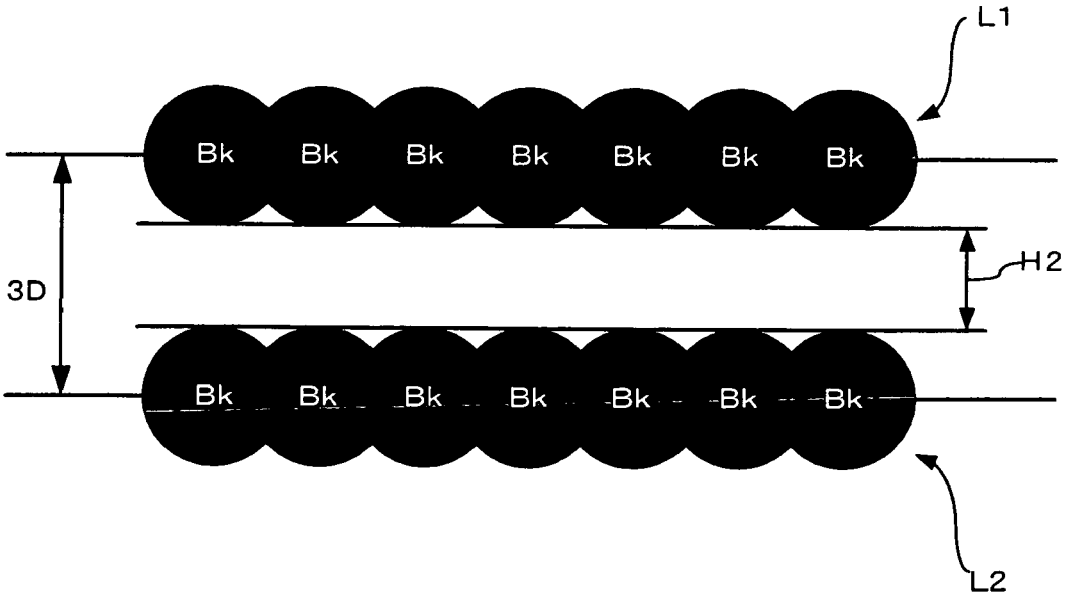
FIG. 31B is an explanatory diagram illustrating the configuration of a printed image when monochrome printing is executed in the conventional draft print mode.

FIG. 31A is a detailed illustration of the configuration of a printed image G for the case that monochrome printing is executed in the draft print mode of the inkjet printer 1 of the present embodiment. FIG. 31B is a detailed illustration of the configuration of a printed image G for the case that monochrome printing is executed in the draft print mode of a conventional inkjet printer 1.

In the inkjet printer 1 of the present embodiment, yellow (Y) ink that is ejected from the nozzles #1 to #4 of the yellow nozzle group 211Y, magenta (M) ink that is ejected from the nozzles #1 to #4 of the magenta nozzle group 211M, cyan (C) ink that is ejected from the nozzles #1 to #4 of the cyan nozzle group 211C and black (K) ink that is ejected from the nozzles #1 to #4 of the black nozzle group 211K overlaps as shown in FIG. 31A, so that the dots are formed as very large. These very large dots form dot rows that are formed lining up in a straight line in the carriage movement direction and constitute the raster lines L1 and L2 of the printed image G. Therefore, the gap H1 formed between the raster lines L1 and L2 becomes very small, as shown in the figure.

On the other hand, in the conventional inkjet printer 1, dots are formed on the medium S using only the black nozzle group 211K to eject only black (K) ink from the nozzles #1 to #180 of that black nozzle group 211K, so that the image is printed only with those dots, as shown in FIG. 31B. The dots formed here are very small, since they are formed only with the black (K) ink, so that as shown in the figure, a large gap H2 appears as a blank portion between the raster lines L1 and L2 constituting the printed image G. This leads to a lowering of the print density, so that it is very difficult to prevent the printed image G from becoming coarse or thin.

By contrast, with the present embodiment, the gap between the raster lines L1 and L2 constituting the printed image G can be made very small, so that the blank portions in the printed image G can be largely eradicated, and thus, the darkness of the printed image G is increased, so that the printed image G is prevented from becoming coarse or thin, and the appearance of the printed image G can be improved.

Also when one pass has been terminated and the next pass is executed, ink is ejected from the nozzles #1 to #4 of the yellow nozzle group 211Y, the magenta nozzle group 211M, the cyan nozzle group 211C and the black nozzle group 211K, as shown in FIG. 30, so that the ink is ejected onto the same lines L5 to L8 on the medium S from the respective nozzles #1 to #4. The ink ejected from the nozzles #1 to #4 of the nozzle groups 211Y, 211M, 211C and 211K is formed overlapping on the medium S for each of the nozzles #1 to #4, so that dot rows as shown in the figure are respectively formed. Also the dots formed here are formed by overlapping ink of the various colors cyan (C), magenta (M), yellow (Y) and black (K), as in the case described above, so that the dots become very large. These dots form dot rows that are formed lining up in the carriage movement direction and constitute the raster lines L5 to L8 of the printed image G. Thus, the gaps formed between the raster lines L5 to L8 can be made small, and therefore it can prevented "blank portions" from occurring in the printed image G.

By repeatedly executing this pass, the ink ejected from the nozzles #1 to #4 of the nozzle groups 211Y, 211M, 211C and 211K is formed overlapping on the medium S for each of the nozzles #1 to #4, so that dot rows are formed as shown in the figure. Thus, the raster lines L9 to L12 constituting the printed image G are formed. Therefore, the gaps between the raster lines L9 to L12 can be made small, and thus it can prevent "blank portions" from occurring in the printed image G.

<Summary>

In the inkjet printer 1 as described above, when monochrome printing is executed in the draft print mode, ink is ejected from the nozzles #1 to #180 of the cyan nozzle group 211C, the magenta nozzle group 211M and the yellow nozzle group 211Y in addition to the black nozzle group 211K, so that an image is printed by so-called composite black that expresses black (K) by a combination of the respective colors cyan (C), magenta (M) and yellow (Y). Therefore, different to the case that the image is printed by ejecting ink only from the black nozzle group 211K as conventionally, cyan (C) ink, magenta (M) ink, yellow (Y) ink and black (K) ink are overlapped, thus larger dots can be formed. Thus, it is possible to suppress the occurrence of "blank portions" in the printed image G to the extent possible, and it can be prevented that the printed image becomes coarse or that the color appears thin overall.

===Other Configuration Example (for the Case of Monochrome Printing)===

Figure 32:
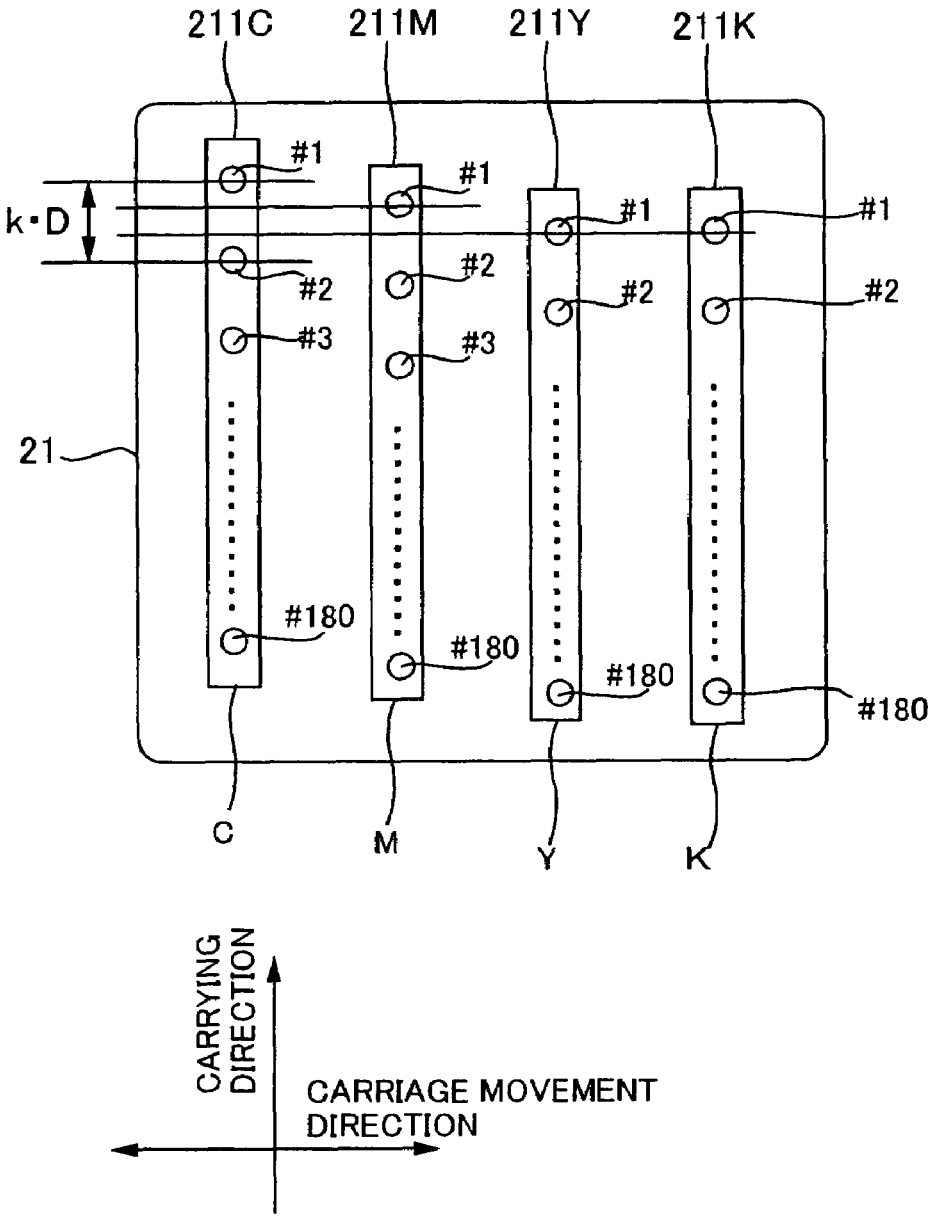
FIG. 32 is an explanatory diagram illustrating other nozzle groups.
Figure 33:
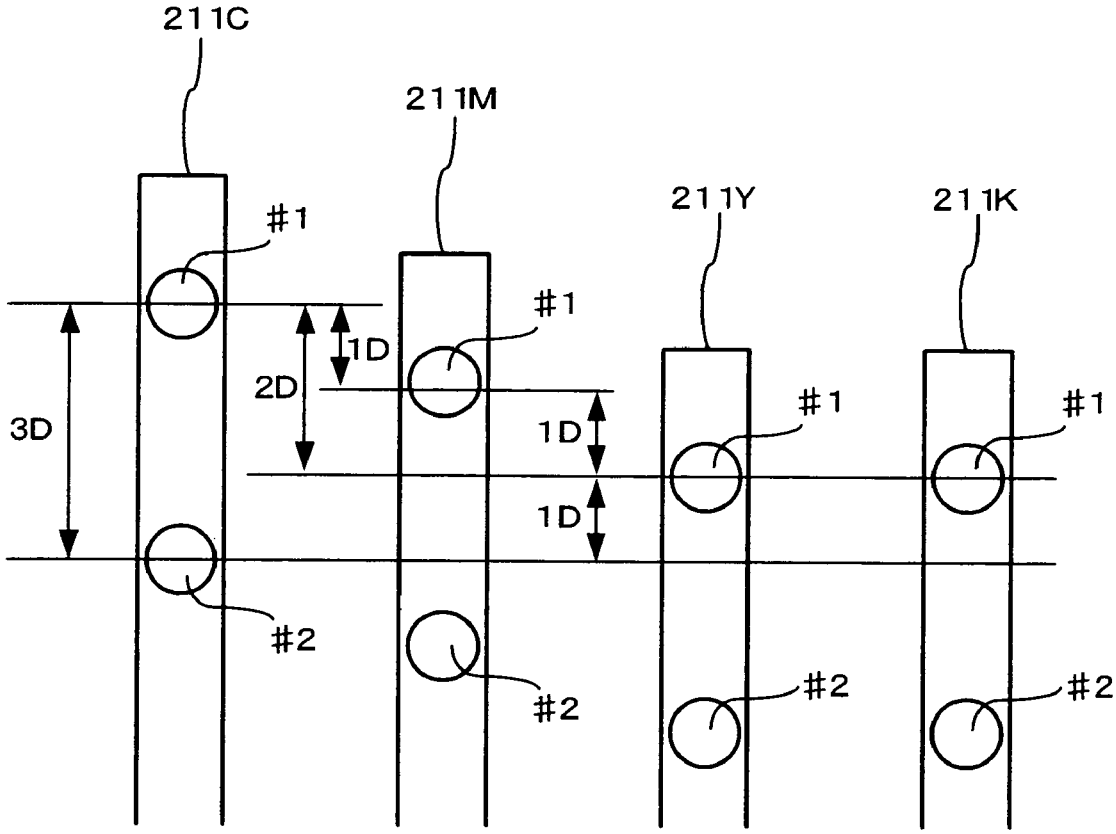
FIG. 33 is an explanatory diagram illustrating the arrangement of the other nozzle groups.
Figure 34:
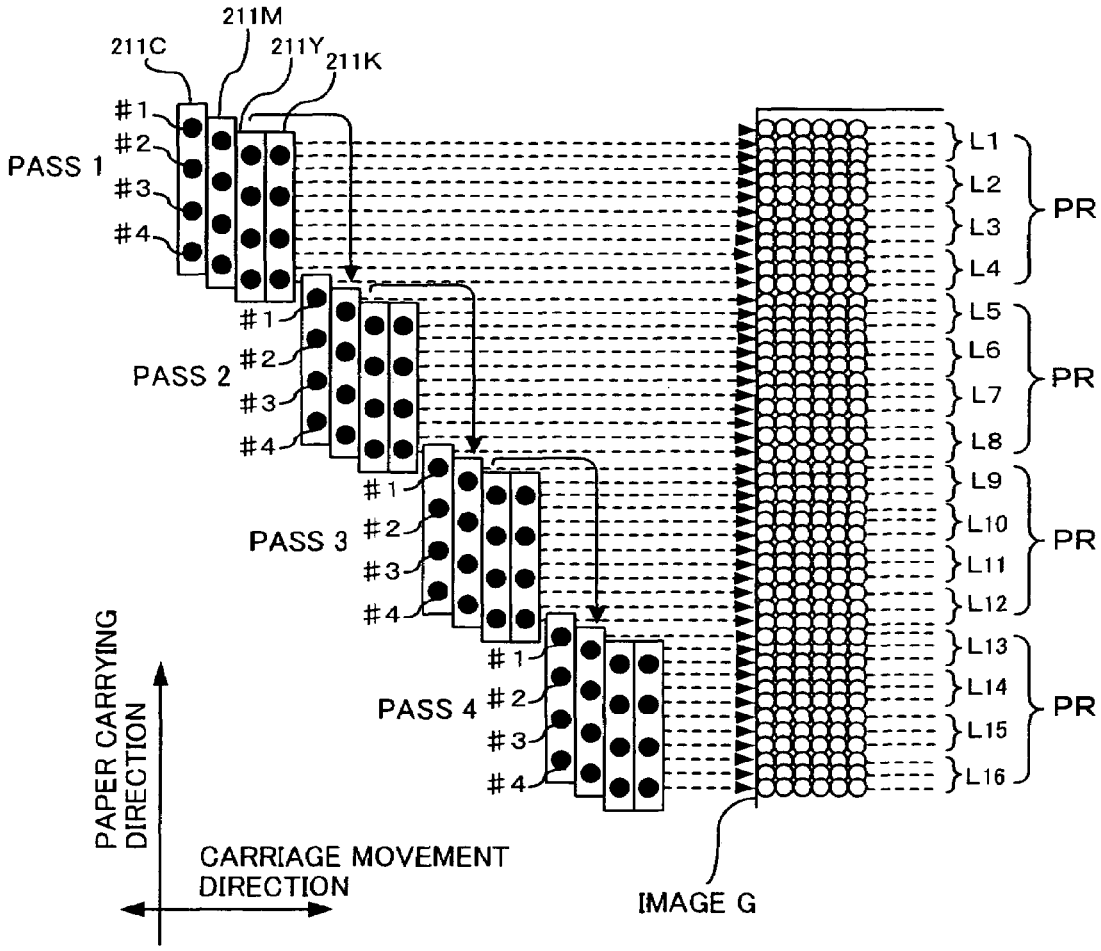
FIG. 34 is an explanatory diagram of an image printed by the other nozzle groups in the draft print mode.
Figure 35:
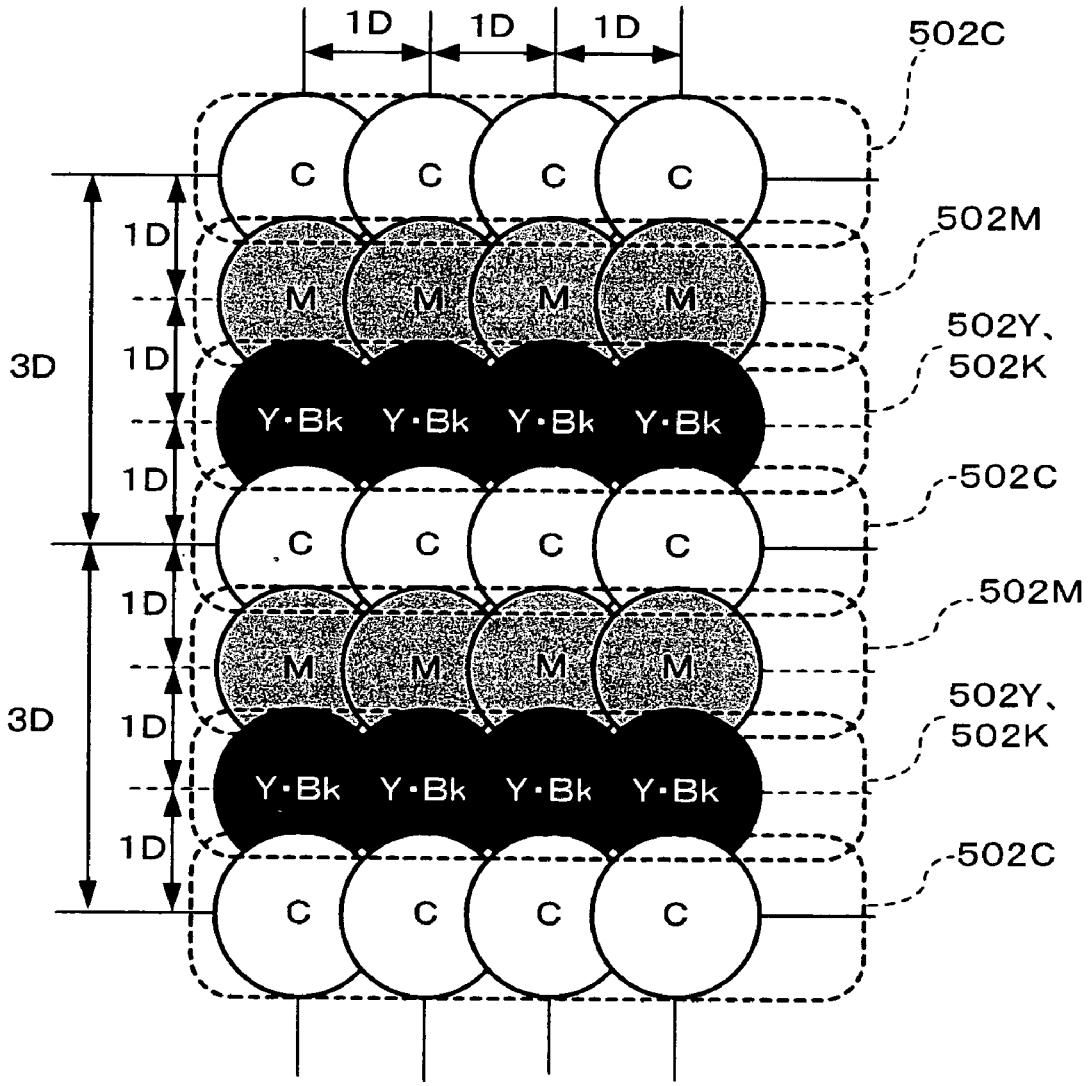
FIG. 35 is an explanatory diagram of the configuration of an image printed by the other nozzle groups in the draft print mode.
Figure 36:
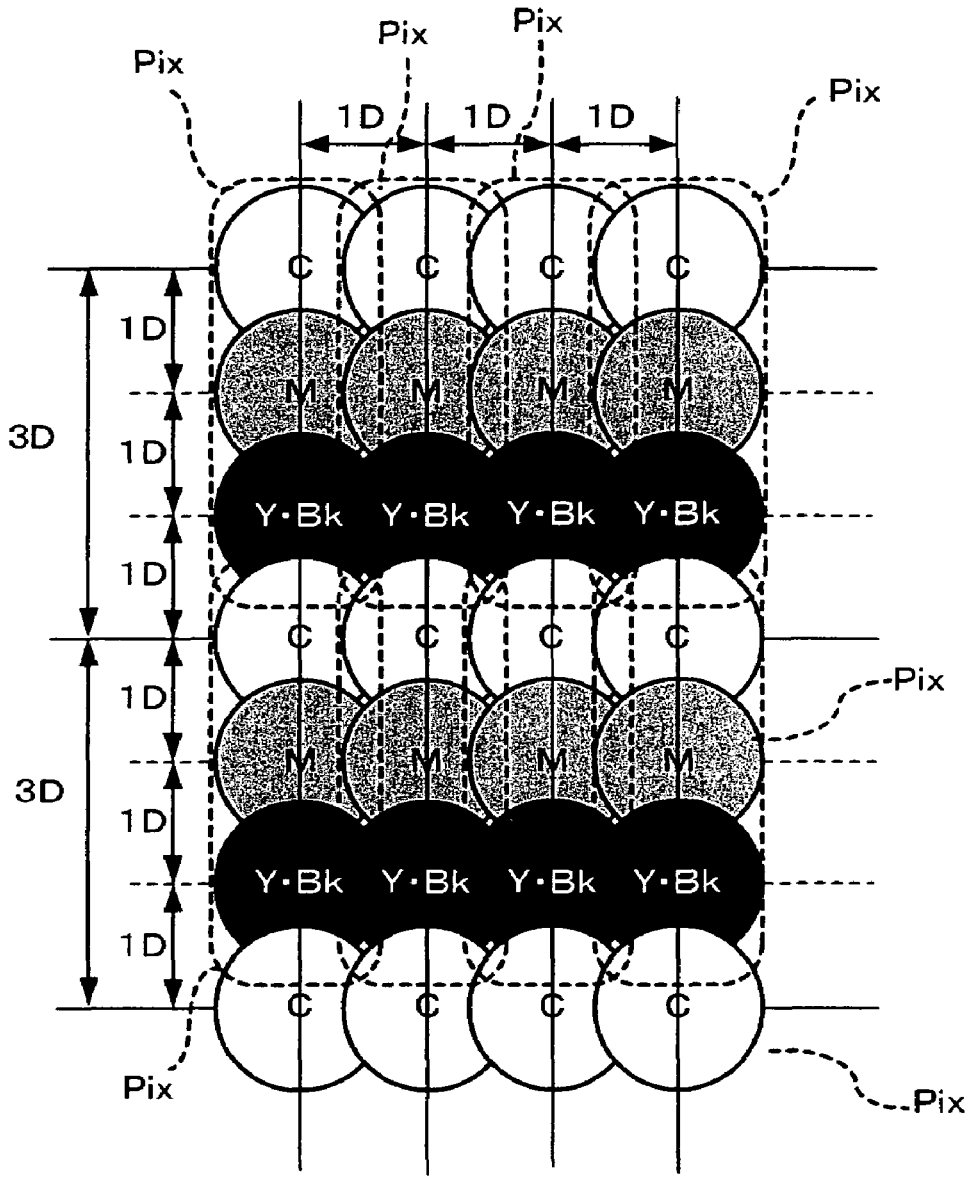
FIG. 36 is an explanatory diagram of the configuration of the pixels of an image printed by the other nozzle groups in the draft print mode.

FIG. 32 to FIG. 36 are diagrams illustrating another configuration example of an inkjet printer 1 of the present embodiment. FIG. 32 is an explanatory diagram illustrating the nozzle groups 211Y, 211M, 211C and 211K of the head 21 of this inkjet printer 1. FIG. 33 is an explanatory diagram illustrating the arrangement nozzle groups 211Y, 211M, 211C and 211K of the head 21 of this inkjet printer 1 in more detail. FIG. 34 is an explanatory diagram illustrating an image printed in the draft print mode of this inkjet printer 1. FIG. 35 is an explanatory diagram illustrating in greater detail a configuration of an image printed in the draft print mode of this inkjet printer 1. FIG. 36 is an explanatory diagram illustrating the pixels constituting the printed image in more detail.

<Nozzle Arrangement>

As shown in FIG. 32, in this inkjet printer 1, the nozzle groups 211Y, 211M, 211C and 211K provided on the head 21 are not all arranged at the same position in the carrying direction, but the nozzle groups 211Y, 211M, 211C and 211K are arranged at positions that are offset from one another in the carrying direction.

In the present embodiment, the cyan nozzle group 211C, the magenta nozzle group 211M and the yellow nozzle group 211Y or the black nozzle group 211K are arranged at staggered positions in the carrying direction, respectively. The yellow nozzle group 211Y and the black nozzle group 211K are arranged at the same position with respect to the carrying direction.

FIG. 33 illustrates the offset width of the nozzle groups 211Y, 211M, 211C and 211K. The nozzle spacing (nozzle pitch) of the nozzle groups 211Y, 211M, 211C and 211K is set to "3·D". It should be noted that here, "D" is the minimum dot pitch in the carrying direction (that is, the spacing at the highest resolution of the dots formed on the medium S). That is to say, the nozzle spacing (nozzle pitch) of the nozzle groups 211Y, 211M, 211C and 211K is set to three times the minimum dot pitch D in the carrying direction.

The cyan nozzle group 211C, the magenta nozzle group 211M, the yellow nozzle group 211Y or the black nozzle group 211K are offset from another by 1D (the dot pitch) respectively in the carrying direction. That is to say, the offset width between the cyan nozzle group 211C and the magenta nozzle group 211M is set to 1D (dot pitch), and the offset width between the magenta nozzle group 211M and the yellow nozzle group 211Y or the black nozzle group 211K is also set to 1D (dot pitch). It should be noted that the offset width between the cyan nozzle group 211C and the yellow nozzle group 211Y or the black nozzle group 211K is 2D (dot pitches).

Thus, nozzles having the same number of the nozzles #1 to #180 of the nozzle groups 211C, 211M, 211Y and 211K are provided offset from one another in the carrying direction. That is to say, nozzles having the same numbers among the nozzles #1 to #180 of the cyan nozzle group 211C, the nozzles #1 to #180 of the magenta nozzle group 211M, the nozzles #1 to #180 of the yellow nozzle group 211Y or the nozzles #1 to #180 of the black nozzle group 211K are arranged at an offset from one another in the carrying direction. It should be noted that nozzles having the same numbers among the nozzles #1 to #180 of the yellow nozzle group 211Y and the nozzles #1 to #180 of the black nozzle group 211K are arranged at the same positions with respect to the carrying direction.

The offset width between the nozzles having the same number of the nozzles #1 to #180 of the cyan nozzle group 211C and the nozzles #1 to #180 of the magenta nozzle group 211M is set to 1D (dot pitch). The offset width between the nozzles having the same number of the nozzles #1 to #180 of the magenta nozzle group 211M and the nozzles #1 to #180 of the yellow nozzle group 211Y or the black nozzle group 211K is also set to 1D (dot pitch). The offset width between the nozzles having the same number of the nozzles #1 to #180 of the cyan nozzle group 211C and the nozzles #1 to #180 of the yellow nozzle group 211Y or the black nozzle group 211K is 2D (dot pitches).

<Printing Method>

The following is a description of the case that an image is printed in the draft print mode by the head 21 having nozzle groups 211Y, 211M, 211C and 211K with this arrangement.

FIG. 34 illustrates the way an image G is formed when printing the image G in the draft printing mode with the head 21 of the present embodiment. It should be noted that here, a simple example is explained in which the nozzle groups 211Y, 211M, 211C and 211K have four nozzles #1 to #4 each. Moreover, the nozzles ejecting ink are shown as black circles.

The nozzle groups 211Y, 211M, 211C and 211K are not all arranged at the same position in the carrying direction, but are arranged at positions that are offset from one another, so that when the head 21 is moved once in the carriage movement direction, the respective nozzles #1 to #4 of the nozzle groups 211Y, 211M, 211C and 211K can eject ink along different lines, as shown in the figure.

That is to say, here, the nozzles #1 to #4 of the cyan nozzle group 211C, the nozzles #1 to #4 of the magenta nozzle group 211M, and the nozzles #1 to #4 of the yellow nozzle group 211Y or the black nozzle group 211K are arranged at positions that are offset from one another in the carrying direction, so that the ink ejected from the nozzles #1 to #4 of the cyan nozzle group 211C, the ink ejected from the nozzles #1 to #4 of the magenta nozzle group 211M, and the ink ejected from the nozzles #1 to #4 of the yellow nozzle group 211Y or the black nozzle group 211K can be ejected along different lines.

Thus, the nozzles #1 to #4 of the nozzle groups 211Y, 211M, 211C and 211K can form dot rows that extend along different lines. That is to say, the dot rows formed by the ink ejected from the nozzles #1 to #4 of the cyan nozzle group 211C, the dot rows formed by the ink ejected from the nozzles #1 to #4 of the magenta nozzle group 211M and the dot rows formed by the ink ejected from the nozzles #1 to #4 of the yellow nozzle group 211Y or the black nozzle group 211K are formed extending along different lines.

FIG. 35 shows an enlarged and detailed view of the configuration of the printed image G. As shown in this figure, the cyan nozzle group 211C and the magenta nozzle group 211M are offset by 1D (dot pitch) from one another, so that the cyan dot rows 512C formed by the ink ejected from the nozzles #1 to #4 of the cyan nozzle group 211C are formed at respective offsets of 1D (dot pitch) to the magenta dot rows 512M formed by the ink ejected from the nozzles #1 to #4 of the magenta nozzle group 211M. Moreover, the magenta nozzle group 211M is provided offset by 1D (dot pitch) from the yellow nozzle group 211Y and the black nozzle group 211K, so that the magenta dot rows 512M formed by the ink ejected from the nozzles #1 to #4 of the magenta nozzle group 211M are formed at respective offsets of 1D (dot pitch) to the yellow dot rows 512Y and the black dot rows 512K formed by the ink ejected from the nozzles #1 to #4 of the yellow nozzle group 211Y and the black nozzle group 211K. It should be noted that the cyan dot rows 512C are formed at an offset of 2D (dot pitches) with respect to the yellow dot rows 512Y and the black dot rows 512K.

Accordingly, the dot rows 512C, 512M, 512Y and 512K formed by the ink ejected from the nozzles #1 to #4 of the nozzle groups 211Y, 211M, 211C and 211K are respectively formed at offsets of 1D (dot pitch), as shown in FIG. 35. Thus, the four raster lines L1 to L4 are formed.

When one pass has been terminated and the next pass is executed, then the cyan nozzle group 211C, the magenta nozzle group 211M and the yellow nozzle group 211Y or the black nozzle group 211K are arranged at positions that are offset by 1D (dot pitch) from one another in the carrying direction, as shown in FIG. 34, so that the dot rows 512C formed by the ink ejected from the nozzles #1 to #4 of the cyan nozzle group 211C, the dot rows 512M formed by the ink ejected from the nozzles #1 to #4 of the magenta nozzle group 211M, and the dot rows 512Y and 512K formed by the ink ejected from the nozzles #1 to #4 of the yellow nozzle group 211Y and the black nozzle group 211K are formed at positions that are respectively offset by 1D (dot pitch) from one another. Thus, the four raster lines L5 to L8 are formed.

By repeatedly executing such a pass, the dot rows 512C, 512M, 512Y and 512K formed by the ink ejected respectively from the nozzles #1 to #4 of the nozzle groups 211Y, 211M, 211C and 211K are also formed at positions that are respectively offset by 1D (dot pitch) from one another. Thus, a further eight raster lines L9 to L16 can be formed.

Thus, also in the draft print mode, it is possible to form dot rows at different positions by ink that is ejected from the nozzles #1 to #180 of the nozzle groups 211Y, 211M, 211C and 211K, so that gaps occurring which appear as blank portions between the formed dot rows can be prevented more reliably. Thus, it can be still further prevented that the printed image becomes coarse or thin overall, and thus the appearance off the printed image can be improved still further.

<Configuration of the Printed Image>

The following is a description of the configuration of the image G printed in this manner. One pixel constituting the printed image G is constituted by a cyan (C) dot formed by ink ejected from the nozzles #1 to #180 of the cyan nozzle group 211C, a magenta (M) dot formed by ink ejected from the nozzles #1 to #180 of the magenta nozzle group 211M, a yellow (Y) dot formed by ink ejected from the nozzles #1 to #180 of the yellow nozzle group 211Y and a black (K) dot formed by ink ejected from the nozzles #1 to #180 of the black nozzle group 211K.

If an image is printed in the draft print mode with the inkjet printer 1 according to the present embodiment, then the cyan (C) dots, the magenta (M) dots, the yellow (Y) dots and the black (K) dots are respectively formed at positions that are offset from another by 1D (dot pitch) in the carrying direction. Therefore, the image G printed in this draft print mode is printed by forming a single pixel with dots of four different types of colors formed at positions that are respectively offset by 1D (dot pitch) from one another.

FIG. 36 illustrates the configuration of the printed image G in more detail. Here, the cyan (C) dots, the magenta (M) dots, the yellow (Y) dots and the black (K) dots are formed at positions that are respectively offset from one another by 1D (dot pitch) in the carrying direction, so that the image is printed by forming a single pixel Pix with dots of four different types of colors.

<Other Nozzle Arrangements (1)>

Figure 37:
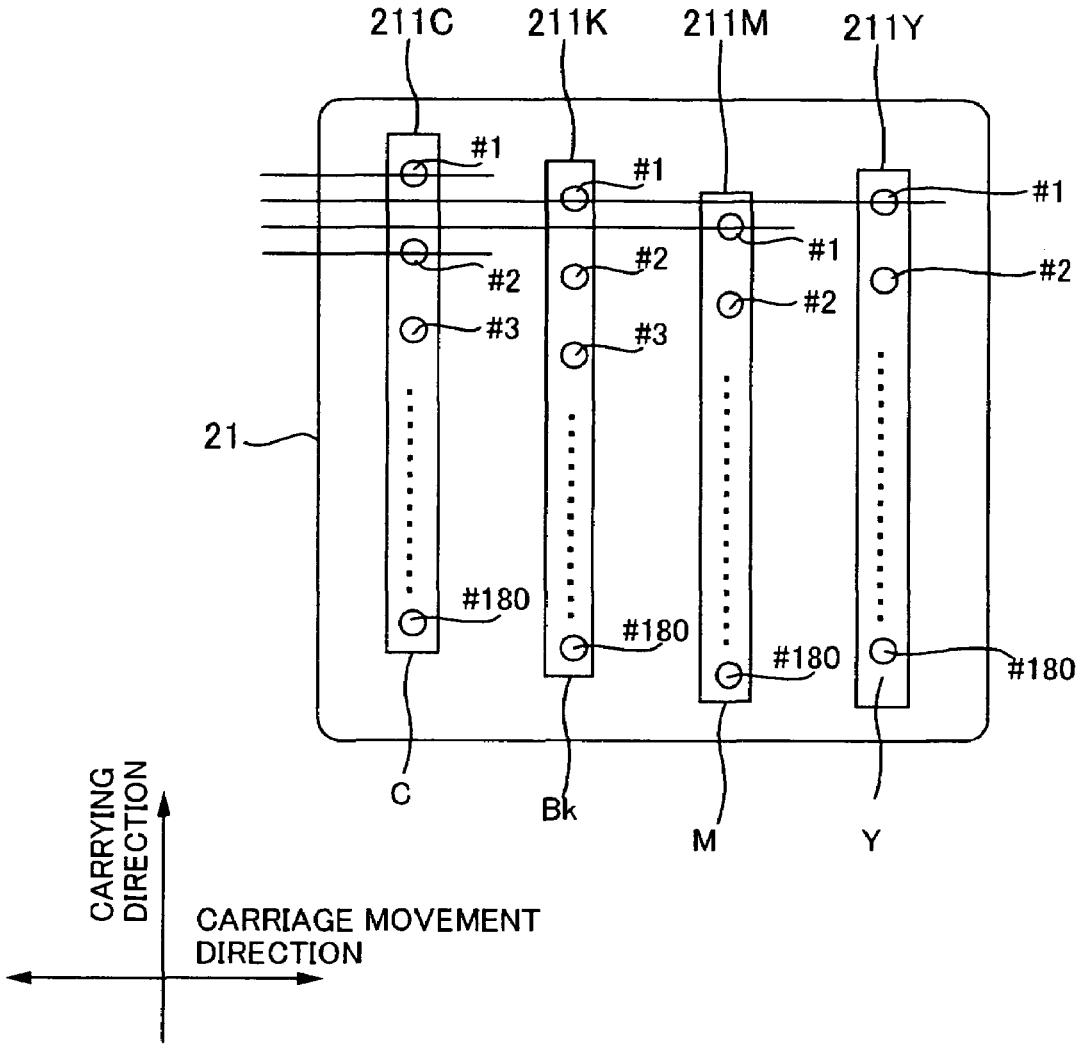
FIG. 37 is an explanatory diagram illustrating an arrangement example of the other nozzle groups.

In the above-described embodiment, the nozzles #1 to #180 of the black nozzle group 211K are arranged on one end of the nozzles #1 to #180 of all nozzle groups 211C, 211M, 211Y and 211K, but there is no limitation to this arrangement, and it is also possible that the nozzles #1 to #180 of the black nozzle group 211K are arranged in the middle, with respect to the carrying direction, of the nozzles #1 to #180 of all nozzle groups 211C, 211M, 211Y and 211K. FIG. 37 shows an example in which the nozzles #1 to #180 of the black nozzle group 211K are arranged in the middle, with respect to the carrying direction, of the nozzles #1 to #180 of all nozzle groups 211C, 211M, 211Y and 211K. Thus, if the nozzles #1 to #180 of the black nozzle group 211K are arranged in the middle, with respect to the carrying direction, among the nozzles #1 to #180 of all nozzle groups 211C, 211M, 211Y and 211K, then the dots formed by the black (K) ink are formed sandwiched between dots formed by other colored inks, that is, cyan (C) and magenta (M) inks in this case. Thus, the black ink can be expressed more darkly.

Figure 38:
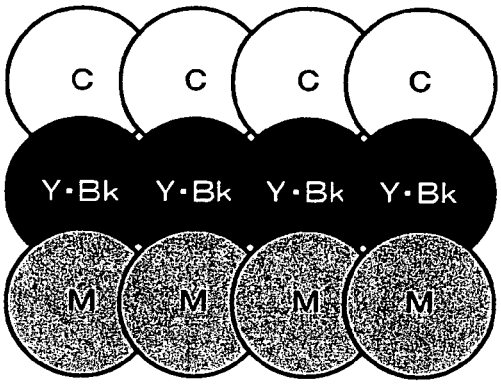
FIG. 38 is an explanatory diagram illustrating how dots are formed by the nozzle groups shown in FIG. 37.

FIG. 38 shows how dots are formed in the draft print mode in the case that the nozzles #1 to #180 of the black nozzle group 211K are arranged in the middle, with respect to the carrying direction, of the nozzles #1 to #180 of all nozzle groups 211C, 211M, 211Y and 211K. As shown in this figure, the black (K) dots are formed sandwiched between cyan (C) dots and magenta (M) dots. Therefore, the black (K) dots are more conspicuous than the dots of the other colors so that black (K) can be made to appear darker.

It should be noted that here the yellow nozzle group 211Y and the black nozzle group 211K are arranged at the same position in the carrying direction. Needless to say, it is not necessarily required to arrange the yellow nozzle group 211Y at the same position in the carrying direction as the black nozzle group 211K. That is to say, it is also possible to arrange the yellow nozzle group 211Y at the same position in the carrying direction as the cyan nozzle group 211C or the magenta nozzle group 211M.

<Other Nozzle Arrangements (2)>

In the above-described embodiment, the nozzle spacing (nozzle pitch) of the nozzle groups 211C, 211M, 211Y and 211K is set to "3·D", so that one of all the nozzle groups 211C, 211M, 211Y and 211K is arranged at the same position in the carrying direction as one of the other nozzle groups, but there is no limitation to this if the nozzle spacing (nozzle pitch) of the nozzle groups 211C, 211M, 211Y and 211K is set to a value other than "3·D".

Figure 39:
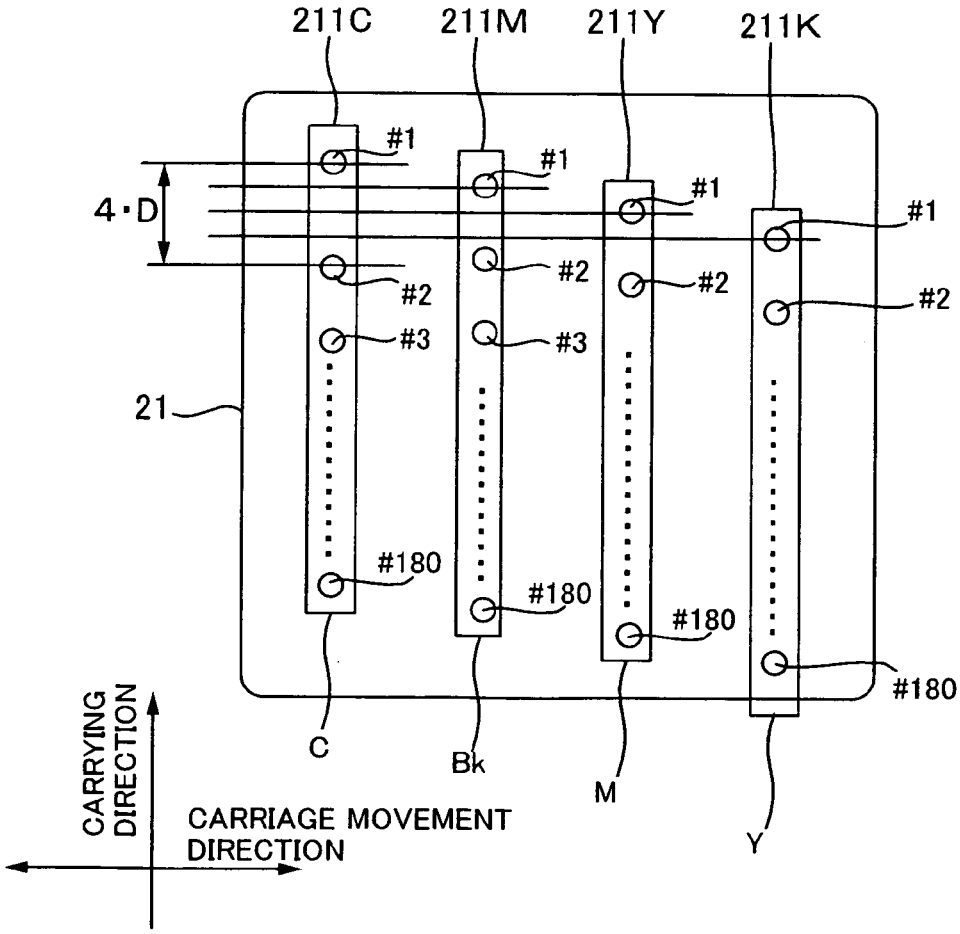
FIG. 39 is an explanatory diagram illustrating an arrangement example of the other nozzle groups.

FIG. 39 shows an example of the arrangement of the nozzle groups 211C, 211M, 211Y and 211K for the case that the nozzle spacing (nozzle pitch) of the nozzle groups 211C, 211M, 211Y and 211K is set to "4·D". The cyan nozzle group 211C, the magenta nozzle group 211M, the yellow nozzle group 211Y and the black nozzle group 211K are arranged at positions that are offset from another by 1D (the dot pitch) in the carrying direction. If the nozzle spacing (nozzle pitch) of the nozzle groups 211C, 211M, 211Y and 211K is set to "4·D" in this manner, then the nozzle groups 211C, 211M, 211Y and 211K can all be arranged at positions that are respectively offset from another by 1D (dot pitch) in the carrying direction. Also in the draft print mode with this arrangement, it can be prevented that there is a gap between the dot rows, so that it can be prevented that the printed image appears coarse or becomes thin overall. Therefore, the appearance of the printed image can be improved.

It should be noted that if the nozzle spacing (nozzle pitch) of the nozzle groups 211C, 211M, 211Y and 211K is set to "4·D", then the order of the nozzle groups does not necessarily have to be in this order, and the order of the cyan nozzle group 211C, the magenta nozzle group 211M, the yellow nozzle group 211Y and the black nozzle group 211K can also be different. Also, if the nozzle spacing (nozzle pitch) of the nozzle groups 211C, 211M, 211Y and 211K is set to "4·D", then the nozzle groups 211C, 211M, 211Y and 211K do not necessarily have to be arranged at positions that are respectively offset from another by 1D (dot pitch) in the carrying direction. That is to say, it is also possible to arrange them such that two of the nozzle rows are arranged at the same positions in the carrying direction, as in the above-described embodiment.

Moreover, the "k" of the "k·D" in the nozzle spacing (nozzle pitch) of the nozzle groups 211C, 211M, 211Y and 211K can also be set to 2 or to 5 or more.

Furthermore, in addition to the cyan nozzle group 211C, the magenta nozzle group 211M, the yellow nozzle group 211Y and the black nozzle group 211K, it is also possible to provide nozzle groups ejecting other colors of ink, such as a nozzle group ejecting light cyan ink, a nozzle group ejecting light magenta ink, a nozzle group ejecting dark yellow ink or a nozzle group ejecting violet ink. Also these nozzle groups can be arranged at positions that are offset in the carrying direction from other nozzle groups, or arranged at same positions in the carrying direction as that of other nozzle groups.

Furthermore, it is not necessarily required to provide all the nozzle groups of the cyan nozzle group 211C, magenta nozzle group 211M, yellow nozzle group 211Y and the black nozzle group 211K.

===Other Embodiments===

In the foregoing, a printing apparatus, such as a printer, according to the present invention was described by way of examples. However, the foregoing embodiments are for the purpose of elucidating the present invention and are not to be interpreted as limiting the present invention. The invention can of course be altered and improved without departing from the gist thereof and includes functional equivalents. In particular, the embodiments noted below are also included in the printing apparatus according to the invention.

In these embodiments, some or all of the configurations achieved by hardware can be replaced by software, and conversely, some of the configurations that are achieved by software can be replaced by hardware.

It is possible to perform some of the processes that are performed by the inkjet printer 1 by the computer 1100 instead, and it is also possible to provide a dedicated processing device between the inkjet printer 1 and the computer 1100, and perform some of the processes using this processing device.

<Regarding the Carrying Mechanism>

In the foregoing embodiments, a configuration including the paper feed motor 15, the carry roller 17A and the paper discharge roller 17B was disclosed as the carry mechanism of the present invention, but the carry mechanism of the present invention is not limited to such a mechanism, and as long as it is a mechanism that can carry the medium S, any mechanism is possible.

<Regarding the Print Head>

In the foregoing embodiments, a head 21 provided with a plurality of nozzle groups 211C, 211M, 211Y and 211K, each having a plurality of nozzles #1 to #180 was explained as the print head of the present invention, but the print head of the present invention is not limited to such a print head, and as long as it is a print head that can print images by forming dots on the medium S, any print head is possible.

Moreover, the print head of the present invention is not limited to a print head provided with nozzles that print an image by ejecting ink as described above, and as long as it is a print head that prints an image by forming dots on the medium S, such as a dot impact-type print head or a bubble jet-type print head, a print head performing any type of printing is suitable.

<Regarding the Predetermined Direction>

In the above-described embodiments, the carrying direction was given as an example of the "predetermined direction" of the present invention, but the "predetermined direction" of the present invention is not limited to this direction, and as long as it is a direction in which the medium S is carried by the carrying mechanism, any direction is possible.

<About the Direction Intersecting with the Predetermined Direction>

In the above-described embodiments, the movement direction of the carriage 41, which intersects the predetermined direction (carrying direction) was given as an example of the "direction intersecting with the predetermined direction", but there is no limitation to this, and as long as it is a direction in which the print head (head 21 for example), which prints the image on the medium S, moves, it is not necessarily required that it is a direction that intersects the predetermined direction (the carrying direction).

<Regarding the Printed Image>

The "printed image" in accordance with the invention is not limited to images printed by such colors as cyan (C), magenta (M), yellow (Y) and black (K), and can also be an image printed by other colors, such as light cyan (LC), light magenta (LM) or dark yellow (DY).

<Regarding the Pixel Data>

In the above-described embodiments, the data of the pixels constituting the image to be printed was 2-bit data, that is, constituted by four types of data, namely "00" (no dot formation), "01" (small dot formation), "10" (medium dot formation) and "11" (large dot formation), but the present invention is not limited to this, and the pixel data can also be constituted by two types of data, namely "0" (no dot formation) and "1" (dot formation), or can be constituted by five or more types of data.

<Regarding the Dots>

In the above-described embodiments, substantially circular dots were formed, but the present invention is not limited to this, and it is also possible that the dots are formed as elliptical dots or as dots of other shapes. That is to say, as long as they constitute the pixels of the printed image, the dots can have any shape or form.

<Regarding the Dot Formation Sections>

In the above-described embodiments, dot formation sections forming dots by ejecting ink onto the medium S were given as examples of the dot formation sections (first dot formation section, second dot formation section, third dot formation section, fourth dot formation section and fifth dot formation section), but the dot formation sections of the present invention are not limited to dot formation sections forming the dots in this manner. For example, as long as they are dot formation sections that print an image by forming dots on the medium S by various kinds of methods, such as dot impact printing or bubble jet printing, any dot formation section is possible.

<Regarding the First Resolution and the Second Resolution>

In the above-described embodiments, the resolution corresponding to the regular print mode was given as an example of the first resolution and the resolution corresponding to the draft print mode was given as an example of the second resolution, but the "first resolution" and the "second resolution" of this invention are not limited to these resolutions. That is to say, it is also possible to apply a resolution corresponding to a print mode other than the above-described regular print mode as the "first resolution" of the present invention. Moreover, it is also possible to apply a resolution corresponding to a print mode other than a resolution corresponding to the above-noted "draft print mode" as the "second resolution" of the present invention. That is to say, as long as the "second resolution" is lower than the "first resolution," any resolution is possible for it.

In other words, in the above-described embodiments, the first resolution, that is, the resolution corresponding to the regular print mode can also be a resolution other than "360 dpi (vertical)×360 dpi (horizontal)" or "720 dpi (vertical)×720 dpi (horizontal)". Similarly, also the second resolution can be set to a resolution other than the resolution corresponding to the draft print mode, such as another resolution other than "120 dpi (vertical)×360 dpi (horizontal)".

Also, "when the image is printed in the second resolution" in accordance with the present invention, it is not limited to printing an image in the "draft print mode" noted above, but also includes printing an image in a resolution that is lower than a predetermined resolution (first resolution) as noted above.

<Regarding the High-Speed Print Mode>

In the above-described embodiments, the draft print mode was given as an example of a predetermined high-speed print mode, but the predetermined high-speed print mode of the present invention is not limited to the draft print mode, and as long as printing is performed in a "second resolution" that is lower than the above-noted "first resolution," the predetermined high-speed print mode also includes other print modes.

<About the Draft Print Mode>

The draft print mode is not limited to a mode in which the carry amount of the medium S between the passes is set such that the region PR printed in one pass does not overlap with the region PR printed in the next pass, as in the above-noted embodiment, and it can also be a mode in which the carry amount of the medium S between passes is set differently. That is to say, as long as the draft print mode of the present invention is a mode in which the printing process is executed by omitting a portion of the image to be printed in order to execute the printing process at high speed, any mode is possible.

<Regarding the Ink Ejection Mechanism>

In the above-described embodiments, a mechanism of ejecting ink by using piezo elements as the piezoelectric devices was explained, but the mechanism for ejecting ink in accordance with the present invention is not limited to a mechanism for ejecting ink by this method, and as long as it is a mechanism of ejecting ink, any method can be employed, for example, a method of ejecting ink by generating bubbles in the nozzles through heat or the like, and other various methods.

<Regarding the Nozzles>

In the above-described embodiments, nozzle groups 211C, 211M, 211Y and 211K provided with a plurality of nozzles #1 to #180 were given as an example of the first nozzles and the second nozzles of the present invention, but the first nozzles and the second nozzles of the present invention are not limited to being constituted by nozzle groups 211C, 211M, 211Y and 211K provided with a plurality of nozzles #1 to #180, and as long as they eject ink, any type of nozzle is possible.

Moreover, in the above-described embodiments, nozzle groups 211C, 211M, 211Y and 211K provided with nozzles #1 to #180 arranged in a straight line at a certain spacing along a predetermined direction (the carrying direction) were given as examples of the first nozzles and the second nozzles of the present invention, but there is no limitation to configuring them as nozzle groups having such a nozzle arrangement, and as long as they eject ink, any type of nozzle is possible.

<Regarding the First Nozzles>

The first nozzles ejecting black ink in accordance with the present invention are nozzles that eject black ink. There is no particular limitation regarding the darkness of the black ink ejected by the first nozzles. That is to say, the black ink ejected by the first nozzles of the present invention can be light black ink of low darkness or dark black ink of high darkness. It should be noted that if the inkjet printer 1 is capable of ejecting two or more types of black inks of different darkness, for example light black ink of low darkness and dark black ink of high darkness, then both the light black ink and the dark black ink can be ejected by first nozzles in accordance with the present invention, but it is also possible that at least one of them is ejected by a first nozzle in accordance with the present invention.

<Regarding the Second Nozzles>

In the above-described embodiments, yellow nozzles ejecting yellow (Y) ink (the yellow nozzle group 211Y), cyan nozzles ejecting cyan (C) ink (the cyan nozzle group 211C) and magenta nozzles ejecting magenta (M) ink (the magenta nozzle group 211M) are provided as the second nozzles in accordance with the present invention, but it is not necessarily required to provide these nozzles (yellow nozzle group 211Y, cyan nozzle group 211C and magenta nozzle group 211M) as the second nozzles in accordance with the present invention. That is to say, it is also possible that there are only yellow nozzles (the yellow nozzle group 211Y) or only cyan nozzles (the cyan nozzle group 211C) or only magenta nozzles (the magenta nozzle group 211M) as the second nozzles in accordance with the present invention besides the first nozzles (black nozzle group 211K).

Moreover, it is also possible that nozzles ejecting ink of a different color are provided as the second nozzles in accordance with the present invention besides the nozzles of these colors. For example, it is also possible that nozzles ejecting light cyan (LC) ink, nozzles ejecting light magenta (LM) ink, nozzles ejecting dark yellow (DY) ink, or nozzles ejecting ink of other colors are provided.

That is to say, in the present invention, there is no need to provide all of the yellow nozzles ejecting yellow (Y) ink (yellow nozzle group 211Y), the cyan nozzles ejecting cyan (C) ink (cyan nozzle group 211C) and the magenta nozzles ejecting magenta (M) ink (magenta nozzle group 211M) as the second nozzles. In other words, in the above-described embodiments, yellow nozzles (the yellow nozzle group 211Y), cyan nozzles (the cyan nozzle group 211C) and magenta nozzles (the magenta nozzle group 211M) are provided in order to output so-called composite black, in which black (K) is realized by combining the colors cyan (C), magenta (M) and yellow (Y) when monochrome printing is executed in the draft print mode, but it is sufficient if larger dots attained by overlapping ink of other colors over the ink ejected from the black nozzle group are formed on the medium S. Consequently, in accordance with the present invention, it is not necessarily required to perform printing with composite black, in which black (K) is realized by combining the colors cyan (C), magenta (M) and yellow (Y), and it is sufficient if nozzles ejecting ink of other colors than black (K) are provided as the second nozzles in accordance with the present invention.

<Regarding the Print Data>

In the above-described embodiments, the print data is generated by the printer driver 1110 installed on the computer 1100, but what is referred to here as print data is not limited to this case, and it is also possible to generate the print data outside of the printer driver 1110.

Moreover, in the above-described embodiments, the print data is generated by an external computer 1100 and sent from this computer 1100 to the inkjet printer 1, but there is no limitation to this, and it is also possible that the print data is generated inside the inkjet printer 1.

Moreover, in the above-described embodiments, the print data is generated by the rasterization processing section 1118 of the printer driver 1110, but the print data does not have to be such data, and it can be any kind of data, as long as it is data generated for being printed by the inkjet printer 1.

<Regarding the Print Data for Monochrome Printing>

In the above-described embodiments, print data generated by a color conversion process with look-up of the black-color conversion table 604 and print data generated by a color conversion process with look-up of the composite black-color conversion table 606 was given as an example of the print data for monochrome printing of the present invention, but there is no limitation to the print data for monochrome printing, and any print data is possible, as long as it is print data used for executing monochrome printing with the inkjet printer 1.

<Regarding the Ink>

The ink that is used can be pigment-type ink or dye-type ink.

As for the color of the ink, it is also possible to use in addition to the above-mentioned yellow (Y), magenta (M), cyan (C) and black (K), ink of other colors, such as light cyan (LC), light magenta (LM), dark yellow (DY), and red, violet, blue or green.

<Regarding the Printing Apparatus>

In the above-described embodiments, an inkjet printer 1 was explained as an example of a printing apparatus in accordance with the present invention, but the printing apparatus of the present invention is not limited to such a printing apparatus, and it can be any type of printing apparatus, as long as it is a printing apparatus that prints images by forming dots on a medium S, such as a bubble-jet printer, a dot impact printer or a laser-beam printer or the like.

<Regarding the Medium>

The medium S can be any of plain paper, matte paper, cut paper, glossy paper, roll paper, print paper, photo paper, and roll-type photo paper or the like. In addition to these, the medium S may be a film material such as OHP film and glossy film, a cloth material, or a metal plate material or the like. In other words, any medium can be used, as long as ink can be ejected onto it.

What is claimed is:

1. A printing apparatus comprising:

a carry mechanism performing a carry operation of carrying a medium in a predetermined direction;

a print head performing, in alternation with said carry operation, a printing operation of printing an image by forming dots on said medium while moving in a direction intersecting said predetermined direction, said print head having a first dot formation section and a second dot formation section that are provided at positions that are offset from one another in said predetermined direction and that respectively form dots of different colors as said dots; and a controller for printing said image with said print head in a first resolution and in a second resolution that is lower than said first resolution based on data of pixels constituting said image to be printed, wherein, when said image is to be printed in said second resolution, said controller causes said first dot formation section and said second dot formation section to form the respective dots, on different positions on said medium, based on data of the same pixel, wherein, when said image is to be printed in said first resolution, said controller causes said first dot formation section and said second dot formation section to form the respective dots, on a same position on said medium, based on data of the same pixel.

2. A printing apparatus according to claim 1, wherein printing said image in said second resolution includes printing said image in a predetermined high-speed print mode.

3. A printing apparatus according to claim 2, wherein said predetermined high-speed print mode is a draft print mode.

4. A printing apparatus according to claim 1, wherein said print head is provided with, in addition to said first dot formation section and said second dot formation section, one or a plurality of other dot formation sections each forming dots of a color that is different from that of said first dot formation section and said second dot formation section.

5. A printing apparatus according to claim 4, comprising, as said other dot formation section, a third dot formation section provided at the same position in said predetermined direction as either one of said first dot formation section and said second dot formation section.

6. A printing apparatus according to claim 5, wherein said third dot formation section and said first dot formation section or said second dot formation section provided at the same position as said third dot formation section in said predetermined direction are a dot formation section forming black dots and a dot formation section forming yellow dots.

7. A printing apparatus according to claim 4, comprising, as said other dot formation section, a fourth dot formation section provided at a position that is offset in said predetermined direction with respect to both said first dot formation section and said second dot formation section.

8. A printing apparatus according to claim 7, wherein, among said first dot formation section, said second dot formation section, and said fourth dot formation section, the dot formation section that is positioned in the middle in said predetermined direction is a dot formation section forming black dots.

9. A printing apparatus according to claim 8, wherein the dot formation sections other than said dot formation section that is positioned in the middle are a dot formation section forming cyan dots and a dot formation section forming magenta dots.

10. A printing apparatus according to claim 7, wherein, among said first dot formation section, said second dot formation section, and said fourth dot formation section, the dot formation section that is positioned at an end in said predetermined direction is a dot formation section forming black dots.

11. A printing apparatus according to claim 10, wherein the dot formation sections other than said dot formation section that is positioned at the end are a dot formation section forming cyan dots and a dot formation section forming magenta dots.

12. A printing apparatus according to claim 4, wherein the color of the dots formed by either one of said first dot formation section and said second dot formation section is darker than the color of the dots formed by said other dot formation section.

13. A printing apparatus according to claim 1, wherein the color of the dots formed by either one of said first dot formation section and said second dot formation section is black.

14. A printing apparatus according to claim 1, wherein the color of the dots formed by either one of said first dot formation section and said second dot formation section is black, and the color of the dots formed by the other one of said first dot formation section and said second dot formation section is cyan or magenta.

15. A printing apparatus according to claim 1, wherein said dot formation sections form said dots by ejecting ink onto said medium.

* * * * *